US008161760B2

(12) United States Patent
Cur et al.

(10) Patent No.: US 8,161,760 B2
(45) Date of Patent: Apr. 24, 2012

(54) UTILITIES GRID FOR DISTRIBUTED REFRIGERATION SYSTEM

(75) Inventors: Nihat O. Cur, St. Joseph, MI (US); Steven John Kuehl, Stevensville, MI (US); John Joseph Vonderhaar, St. Joseph, MI (US); Frank Huangtso Lin, Ann Arbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1314 days.

(21) Appl. No.: 11/769,903

(22) Filed: Jun. 28, 2007

(65) Prior Publication Data

US 2008/0156028 A1 Jul. 3, 2008

Related U.S. Application Data

(63) Continuation-in-part of application No. 11/646,754, filed on Dec. 28, 2006, now abandoned, and a continuation-in-part of application No. 11/646,972, filed on Dec. 28, 2006, now abandoned.

(51) Int. Cl.

| | |
|---|---|
| ***F25B 7/00*** | (2006.01) |
| ***F25D 17/00*** | (2006.01) |
| ***F25D 17/02*** | (2006.01) |
| ***F25D 17/04*** | (2006.01) |

(52) U.S. Cl. ..... 62/175; 62/180; 62/185; 62/186; 62/335; 62/408; 62/441

(58) Field of Classification Search ..... 62/175, 62/180, 185, 186, 335, 408, 441
See application file for complete search history.

(56) References Cited

U.S. PATENT DOCUMENTS

| | | | | |
|---|---|---|---|---|
| 2,253,657 | A * | 8/1941 | Smith | 62/126 |
| 3,507,322 | A | 4/1970 | Tetrick et al. | |
| 4,895,001 | A | 1/1990 | Jondahl | |
| 5,381,670 | A | 1/1995 | Tippmann et al. | |
| 5,440,894 | A | 8/1995 | Schaeffer et al. | |

(Continued)

FOREIGN PATENT DOCUMENTS

| | | | |
|---|---|---|---|
| AU | 531423 | B | 7/1980 |

(Continued)

*Primary Examiner* — Frantz Jules
*Assistant Examiner* — Travis Ruby
(74) *Attorney, Agent, or Firm* — Kirk W. Goodwin; Robert L. Judd

(57) ABSTRACT

A distributed refrigeration appliance system for use in a residential kitchen and other locations in a dwelling and includes multiple separate refrigeration appliance modules, a central cooling system and a cooling circuit. The system can also include one or more satellite stations having a heat exchanger and arranged for supplying chilled air to one or more refrigeration appliance modules. One or more refrigeration appliance modules can include a thermal cascade cooling device to cool the module to lower temperatures than the cooling circuit can attain. One or more refrigeration appliance modules can be refrigeration/storage modules that can provide refrigerated, unconditioned or heated storage space. The central cooling system can be a vapor compression system having a refrigerant circuit connecting the modules. Alternately, the central cooling system can cool a secondary cooling medium circuit. The refrigeration system can also have more than one refrigeration machine providing cooling to the secondary refrigeration loop.

17 Claims, 30 Drawing Sheets

U.S. PATENT DOCUMENTS

| | | | | |
|---|---|---|---|---|
| 5,657,639 | A * | 8/1997 | Lidbeck | 62/186 |
| 5,743,102 | A * | 4/1998 | Thomas et al. | 62/185 |
| 6,199,396 | B1 | 3/2001 | Aizawa | |
| 6,481,216 | B2 | 11/2002 | Simmons et al. | |
| 6,494,054 | B1 * | 12/2002 | Wong et al. | 62/335 |
| 6,685,491 | B2 | 2/2004 | Gergek | |
| 6,722,147 | B2 | 4/2004 | Heyl et al. | |
| 6,854,660 | B2 | 2/2005 | Yoon et al. | |
| 6,860,288 | B2 | 3/2005 | Uhler | |
| 6,880,351 | B2 | 4/2005 | Simadiris et al. | |
| 6,973,799 | B2 | 12/2005 | Kuehl et al. | |
| 2004/0008490 | A1 * | 1/2004 | Cheon | 361/699 |

FOREIGN PATENT DOCUMENTS

| | | | |
|---|---|---|---|
| CN | 1332353 | | 1/2002 |
| DE | 19933534 | A1 | 2/2000 |
| JP | 11023080 | | 1/1999 |
| JP | 2002277099 | A | 9/2002 |
| JP | 2004053231 | A | 2/2004 |
| KR | 20030086691 | A | 11/2003 |
| NL | 1022670 | C | 8/2004 |
| WO | 03/025482 | A1 | 3/2003 |
| WO | 2006/043254 | A1 | 4/2006 |
| WO | 2007/029173 | A1 | 3/2007 |

* cited by examiner

UTILITIES GRID FOR DISTRIBUTED REFRIGERATION SYSTEM

CROSS-REFERENCE TO RELATED APPLICATIONS

This application is a continuation in part of prior filed application Ser. Nos. 11/646,754 and 11/646,972 filed on Dec. 28, 2006 now abandoned. This application is related to U.S. patent application Ser. Nos. 11/769,811, 11/769,837, 11/769,864, 11/769,935, 11/769,989 and 11/770,033 filed concurrently herewith.

BACKGROUND OF THE INVENTION (1) Field of the Invention

The invention relates to refrigeration appliances for use in residential kitchens and other locations associated with a dwelling.

(2) Description of Related Art

Refrigeration appliances for use in residential kitchens and other rooms in a dwelling unit are known. Modular refrigeration devices such as refrigerator, freezer, ice maker and wine cooler modules for use in residential dwellings are known.

BRIEF SUMMARY OF THE INVENTION

The invention relates to a distributed refrigeration system for use in a kitchen and other locations associated with a residential dwelling having at least one primary refrigeration machine with a cooling circuit including at least one primary heat exchanger for providing cooling, a secondary refrigeration loop utilizing a cooling medium fluid having a plurality of access points associated with the dwelling including a secondary cooling medium circuit connecting the primary heat exchanger and the plurality of access points to convey cooling medium fluid from the heat exchanger to the plurality of access points, and to return cooling medium fluid to the primary heat exchanger, and a pump for circulating cooling medium fluid in the cooling medium circuit. Remote refrigeration devices can be connected to the secondary refrigeration loop at an access point. The remote refrigeration devices can include a connector to receive cooling medium fluid from the secondary cooling medium circuit and return cooling medium fluid to the secondary cooling medium circuit and a remote refrigeration device heat exchanger arranged to receive cooling medium fluid from and return cooling medium fluid to the connector.

The distributed refrigeration system can include a second primary refrigeration machine that can have a heat exchanger element connected in the secondary cooling medium circuit to transfer heat from the cooling medium fluid to the second primary refrigeration machine cooling circuit.

The secondary cooling medium circuit can have a single insulated conduit or can have an insulated supply conduit and an insulated return conduit. Access points can have an electrical connector to supply electrical power to a remote refrigeration device. Access points can also have a control circuit connector to connect a remote refrigeration device to a controller for the distributed refrigeration system.

The primary refrigeration machine can be a central cooling unit having a compressor, condenser, expansion device and a chilled liquid evaporator connected in a cooling circuit. The central cooling unit can alternately have an absorption system or a Stirling cycle cooling system arranged to chill liquid in a chilled liquid evaporator.

The remote refrigeration device can be a compact refrigerator, a local area cooler, a dehumidifier, or a CPU cooler. The remote refrigeration device can include a cascade cooling unit.

In another aspect the invention relates to a distributed refrigeration system for use in a kitchen and other locations inside and outside a residential dwelling having a central cooling unit selected from the group including a vapor compression system having a chilled liquid evaporator, an absorption system having a chilled liquid evaporator and a Stirling cycle cooler having a chilled liquid heat exchanger, a controller and a control circuit, a plurality of access points located inside and outside the dwelling each including a liquid coolant connector and an electrical connector, a circulation pump, and a secondary cooling medium circuit comprising, insulated conduit connecting the chilled liquid evaporator, the plurality of access point connectors and the circulation pump and liquid coolant. A remote refrigeration device can be connected to an access point located outside the dwelling and can have a remote device connector to receive liquid coolant from the access point connector and an electrical connector, a remote device heat exchanger arranged to receive liquid coolant from the remote device connector and return the liquid coolant to the remote device connector, and a sensor arranged to sense a predetermined condition of the remote refrigeration device and a selector to allow a user to set the desired predetermined condition for the remote refrigeration device connected to the controller. A remote refrigeration device can be connected to an access point located inside the dwelling and can have a remote device connector to receive liquid coolant from the access point connector and an electrical connector, a remote device heat exchanger arranged to receive liquid coolant from the remote device connector and return liquid coolant to the remote device connector, a sensor arranged to sense a predetermined condition of the remote refrigeration device and a selector to allow a user to set the desired predetermined condition for the remote refrigeration device connected to the controller. The distributed refrigeration system can include a user interface located in the dwelling connected to the controller to allow a user to select the desired predetermined condition for the respective remote devices.

BRIEF DESCRIPTION OF THE DRAWINGS

FIG. 29A is an enlarged schematic drawing illustrating connection of a module to a single line system.

DETAILED DESCRIPTION OF THE INVENTION

Figure 1:
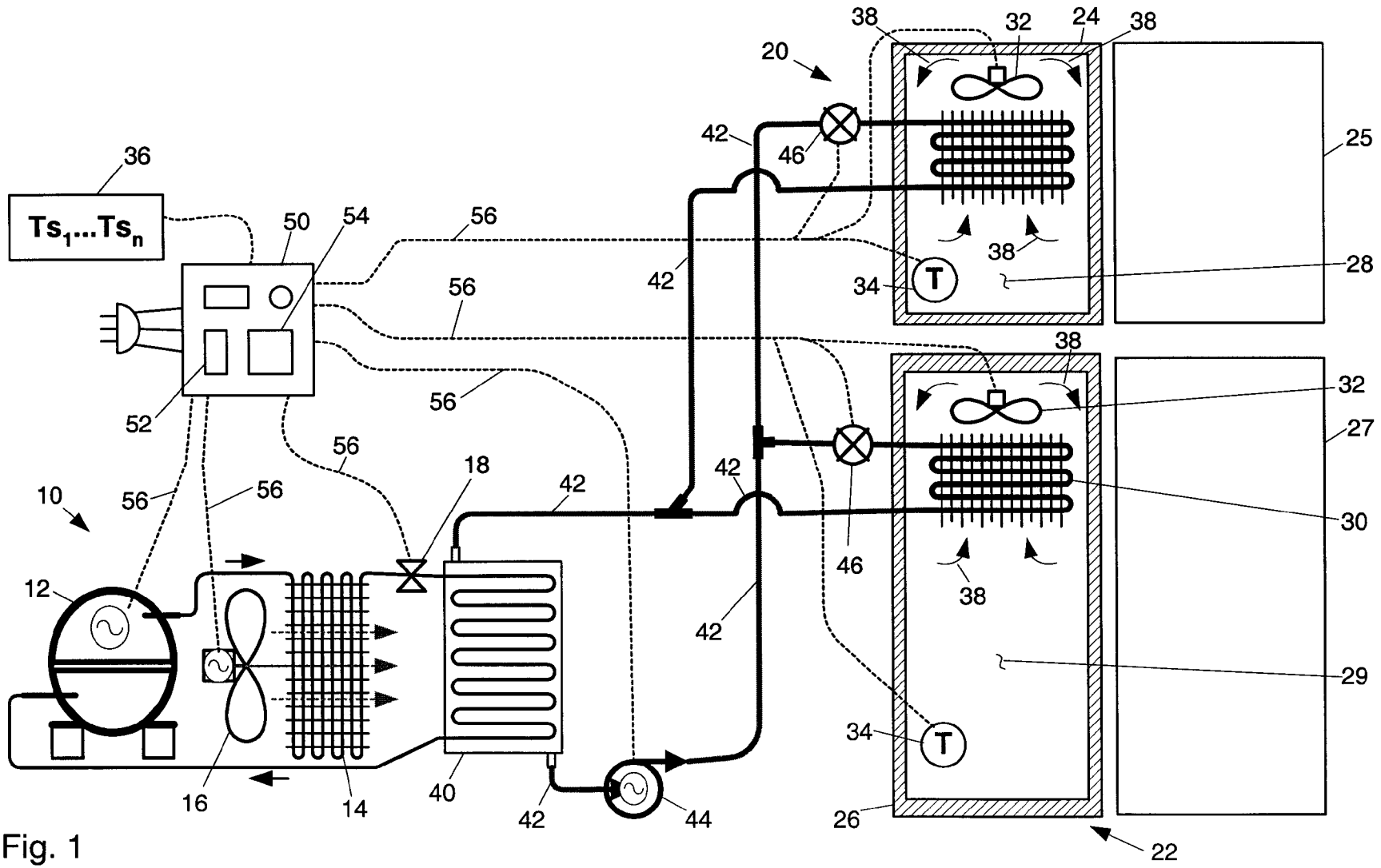
FIG. 1 is a schematic drawing illustrating a modular distributed refrigeration appliance system according to the invention.

In a modular kitchen with multiple refrigeration modules the refrigeration system to cool the modules is a challenging problem. The simplest approach would be to have individual complete refrigeration systems for each module. In early phases of modularity for residential kitchens this might be the approach taken, especially when modular refrigeration product choices are few and economies of scale are not available. However, as modularity becomes more mainstream and kitchen designs begin to incorporate modular refrigeration products with appropriate infrastructure it will become desirable to have a single central cooling system from cost, manufacturing and energy efficiency perspectives. Consumers will be primarily interested in energy efficiency, cost, flexibility and expandability offered by a modular refrigeration appliance system with less concern about the central cooling technology to support the modular system.

According to the invention, a modular refrigeration appliance system can be provided for a residential kitchen and other locations associated with a dwelling that can include a central cooling unit for some or all the refrigerating modules that a consumer may desire to include in their kitchen, either at the time of construction, or to expand or change refrigerating modules over time as needs or desires change. A modular kitchen could allow consumers to select multiple refrigeration modules fitting their lifestyles the best with ultimate flexibility in their kitchens and totally customizable kitchens with modular appliances not only for refrigeration but also for food preparation and kitchen clean-up. According to the invention a single, variable capacity central cooling unit can be provided that is capable of matching the cooling need to the aggregate heat load of the refrigerating modules. The central cooling unit can be arranged to run continuously by controlling the volume of cooling medium directed to each refrigerating module so that each module will be cooled to a user selected temperature and maintained at the desired temperature accurately. The cooling medium can be cold air, refrigerant or a liquid coolant such as an ethylene glycol and water solution. The central cooling unit can be a vapor compression system, but is not limited to that. If a central cooling unit is a vapor compression cooling system the central cooling unit can have a variable capacity compressor capable of handling the cooling load from multiple refrigerating module products. Refrigerating module products can include above freezing refrigerator modules, below freezing freezer modules, refrigerator freezer modules having above freezing and below freezing compartments in various configurations that can include, but are not limited to, built in, stackable, under counter or drawer configurations. Also, refrigerating module products could include specific purpose modules such as ice maker, wine cooler and bar refrigerator units. In addition, conventional refrigeration products having a complete refrigeration system can be combined with a modular refrigeration appliance system according to the invention. For example, one or more below freezing freezer units can be combined with a modular refrigeration system appliance arranged for a plurality of fresh food above freezing refrigerator modules. As will be described in more detail below, a hybrid approach can be an energy efficient approach to providing cooling for modular products since the central cooling unit can run under more favorable cooling cycle conditions since a very cold, i.e. below 0° F., cooling medium would not be required.

Turning to FIG. 1, in one embodiment of the invention, illustrated in schematic form, refrigerating modules 20 and 22 can be connected in a refrigeration appliance system that can include a central cooling unit 10. In the embodiment illustrated in FIG. 1 two refrigerating modules 20, 22 are illustrated. According to the invention more than one or more than two refrigerating modules can be provided in the refrigeration appliance system as desired and although two or three refrigerating modules are included in the disclosed embodiments, they should be understood to include the possibility of one or more than two or three refrigerating modules within the scope of the invention. In addition, the refrigeration appliance system can be arranged to permit expansion of the refrigeration appliance system subsequent to initial installation by adding additional refrigerating modules as a user's needs change over time requiring new or additional refrigerating modules. In practice refrigerating modules 20, 22 can be installed in a residential kitchen and/or in adjoining or nearby rooms such as a great room, bar, recreation room and/or other locations associated with a dwelling. Central cooling unit 10 can be installed in a nearby location such as a basement, utility room, garage, outside, or, if desired, in the kitchen in the proximity of some or all of the refrigeration appliance modules depending on the style of dwelling and whether a basement or crawl space is available or desired for installation of the central cooling unit 10. Refrigerating modules 20, 22 can be free standing or built in modules and can be general purpose refrigerator or freezer modules, or can be special purpose modules such as an ice maker or a wine cooler. Refrigerating modules 20, 22 can take of the form of a conventional refrigerator or freezer cabinet having a hinged door, or can take the form of a refrigerator drawer appliance such as disclosed in co-pending non-provisional application Ser. No. 11/102,321 filed Apr. 8, 2005 fully incorporated herein by reference.

Refrigerating module 20 can have an insulated cabinet 24 and an insulated door 25 that can be hinged to insulated cabinet 24 to selectively open and close an opening 28 in insulated cabinet 24. Refrigerating module 22 can have an insulating cabinet 26 and an insulated door 27 that can be hinged to insulated cabinet 26 to selectively open and close an opening 29 in insulated cabinet 26. Those skilled in the art will understand that insulated doors 25 and 27 can be provided with a suitable handle, not shown, to facilitate opening and closing insulated doors 25 and 27. Refrigerating modules 20 and 22 can each have a heat exchanger 30 positioned in the insulated cabinets 24 and 26 respectively. Similarly, refrigerating modules 20 and 22 can have a variable speed heat exchanger fan 32 positioned to circulate air (illustrated by air flow arrows 38) over the respective heat exchangers 30 and through the respective refrigerating modules 20, 22. Those skilled in the art will appreciate that a single speed fan can be used instead of a variable speed fan 32. Refrigerating modules 20, 22 can also have a temperature sensor 34 arranged to sense the temperature of the interior of refrigerating modules 20, 22. Temperature sensor 34 can be a thermistor or other well known electronic or mechanical temperature sensing mechanism or device. Temperature selectors 36 can be provided for each of the refrigerating modules 20, 22 to allow the user to select the operating temperature for the respective refrigerating modules 20, 22. While temperature selectors 36 are illustrated schematically spaced from refrigerating modules 20, 22, those skilled in the art will understand that temperature selectors 36 can be located in each of the refrigerating modules 20, 22 as is well known in the art, or could be centrally located if desired. Temperature selectors 36 can comprise a well known mechanical or electronic selector mechanism to allow a user to select an operating temperature for the respective refrigerating modules 20, 22.

The refrigeration appliance system illustrated in schematic form in FIG. 1 also includes a central cooling unit 10. Central cooling unit 10 can include a variable speed compressor 12, a condenser 14, and an expansion device 18 connected in a refrigerating circuit with a chilled liquid evaporator 40. A variable speed condenser fan 16 can be provided to circulate air over condenser 14. Chilled liquid evaporator 40 can be a shell and tube evaporator also known as a secondary loop evaporator. Expansion device 18 can be an expansion device with feedback arranged to control refrigerant flow through expansion device 18 based on the heat load in the refrigeration appliance system. Central cooling unit 10 can be connected to the refrigerating modules 20, 22 with insulated conduits 42 forming a cooling medium circuit for conveying liquid coolant from chilled liquid evaporator 40 to heat exchangers 30 and from heat exchangers 30 to chilled liquid evaporator 40. Liquid coolant, not shown, contained in chilled liquid evaporator 40, insulated conduits 42 and heat exchangers 30 can be circulated by a pump 44 that can be a variable speed pump. Further, each refrigerating module can have a valve 46 to control flow of liquid coolant into the heat exchanger 30. Valves 46 can be on-off valves to allow or prevent flow of liquid coolant through the heat exchanger 30 for a refrigerating module. Those skilled in the art will appreciate that if a single speed heat exchanger fan 32 is used in a refrigerating module 20, 22 an adjustable valve 46 can be used to control the amount of liquid coolant flowing into a heat exchanger 30, although it can be more energy efficient to use a variable speed heat exchanger fan 32, a variable speed pump 44 and an on-off valve 46 to control the temperature in the respective refrigerating modules 20, 22. Central cooling unit 10 can also have a microprocessor based controller 50 having a first portion 52 that can be arranged to control the operation of central cooling unit 10 and a second portion 54 arranged to control the volume of liquid coolant directed to the respective refrigerating modules 20, 22. A control circuit 56 can be provided to connect the temperature sensors 34, the temperature selectors 36, the variable speed compressor 12, the variable speed condenser fan 16, the expansion device 18, pump 44, valves 46 and heat exchanger fans 32 with controller 50. Thus, a refrigeration appliance system according to the invention is illustrated in FIG. 1 as a distributed refrigeration system that can have a variable capacity vapor compression condensing unit and secondary loop utilizing a chilled liquid evaporator network. One example of a liquid coolant that can be used is DYNALENE HC heat transfer fluid, a water-based organic salt that is non-toxic, non-flammable with low viscosity, although those skilled in the art will understand that other liquid coolant solutions such as an ethylene glycol and water solution can be used as desired.

According to the invention, central cooling unit 10 can be continuously operating so that chilled liquid at an adequate temperature to achieve the lowest selected temperature in the refrigeration appliance system is continuously circulated in insulated conduits 42 forming a cooling medium circuit from chilled liquid evaporator 40 to refrigerating modules 20, 22. Controller 50 can be arranged to adjust the capacity of the central cooling unit 10 in response to the aggregate cooling load of the plurality of refrigerating modules 20, 22. As noted above, while two refrigerating modules 20, 22 are illustrated in FIG. 1, according to the invention one or more than two refrigerating modules can be connected in the refrigerating appliance system. The aggregate cooling load can be determined by the first portion 52 of controller 50 as a function of temperatures sensed by temperature sensors 34, operating temperatures selected by temperature selectors 36, and feedback from expansion device 18. Controller 50 can also be arranged to control the operating temperature in each of the refrigerating modules 20, 22. Second portion 54 of controller 50 can be arranged to control valves 46 and heat exchanger fans 32 to maintain the selected operating temperatures in the respective refrigerating modules based on the settings of temperature selectors 36 and temperature sensors 34. Thus, according to the invention, a single continuously operating variable capacity central cooling unit 10 can be provided for a plurality of refrigerating modules 20, 22 that can be set to operate at different operating temperatures. The variable capacity central cooling unit 10 can be arranged for chilling a cooling medium. A cooling medium circuit, insulated conduits 42, can be provided connecting the central cooling unit 10 to supply a cooling medium from the central cooling unit 10 to the plurality of refrigerating modules 20, 22. A plurality of cooling medium flow control devices, valves 46, can be connected in the cooling medium circuit, insulated conduits 42, for controlling flow of cooling medium to each of the refrigerating modules 20, 22. A controller 50 and control circuit 56 can be provided to adjust the capacity of the variable capacity central cooling unit 10 in order to supply sufficient cooling medium to cool the plurality of refrigerating modules 20,22 to the respective selected operating temperatures, and the controller 50 and control circuit 56 can be arranged to adjust the volume of cooling medium directed to respective ones of the refrigerating modules 20, 22 by controlling the cooling medium flow control devices, valves 46, to maintain the selected operating temperature in the respective refrigerating modules 20, 22. Controller 50 can control the speed of variable speed pump 44 to vary the volume of liquid cooling in the cooling medium circuit, insulated conduits 42, and controller 50 can control the speed of variable speed heat exchanger fans 32 to further control the operating temperature in the respective refrigerating modules 20, 22.

Figure 2:
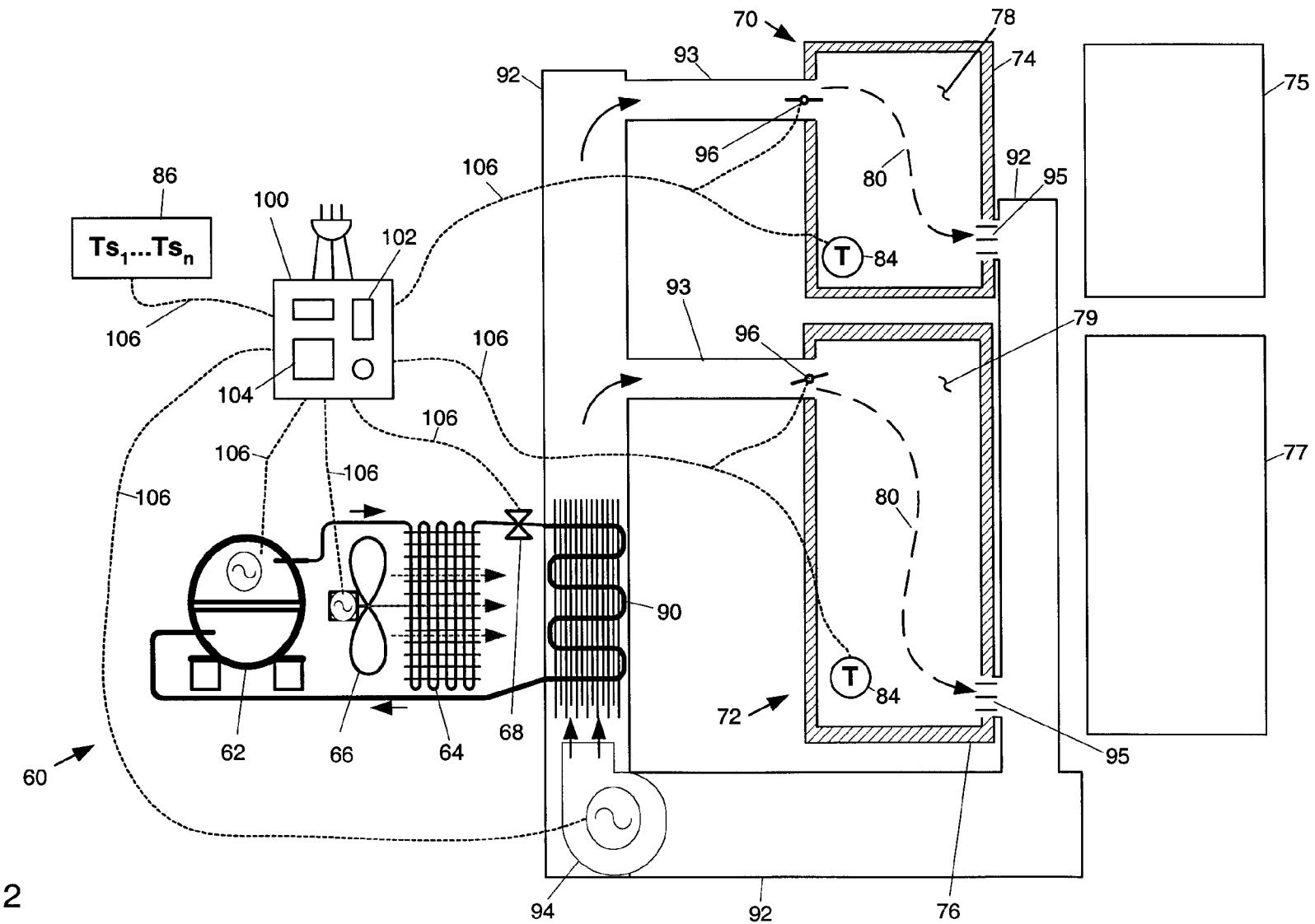
FIG. 2 is a schematic drawing illustrating another embodiment of a modular distributed refrigeration appliance system according to the invention.

Turning to FIG. 2, in another embodiment of the invention, illustrated in schematic form, refrigerating modules 70 and 72 can be connected in a refrigeration appliance system that can include a central cooling unit 60. Similar to the embodiment illustrated in FIG. 1, two refrigerating modules 70, 72 are illustrated. According to the invention one or more than two refrigerating modules can be provided in the refrigeration appliance system as desired. Refrigerating modules 70, 72 can be free standing or built in modules and can be general purpose refrigerator, or can be special purpose modules. Refrigerating module 70 can have an insulated cabinet 74 and an insulated door 75 that can be hinged to insulated cabinet 74 to selectively open and close opening 78 in insulated cabinet 74. Refrigerating module 72 can have an insulating cabinet 76 and an insulated door 77 that can be hinged to insulated cabinet 76 to selectively open and close opening 79 in insulated cabinet 76. Those skilled in the art will understand that insulated doors 75 and 77 can be provided with a suitable handle, not shown, to facilitate opening and closing insulated doors 75 and 77. Refrigerating modules 70, 72 can have a temperature sensor 84 arranged to sense the temperature of the interior of refrigerating modules 70, 72. Temperature sensor 84 can be a thermistor or other well known electronic or mechanical temperature sensing mechanism or device. Temperature selectors 86 can be provided for each of the refrigerating modules 70, 72 to allow the user to select the operating temperature for the respective refrigerating modules 70, 72. While temperature selectors 86 are illustrated schematically spaced from refrigerating modules 70, 72, a temperature selector 86 can be located in each of the refrigerating modules 70, 72 as is well known in the art, or can be centrally located if desired. Temperature selectors 86 can comprise a well known mechanical or electronic selector mechanism to allow a user to select an operating temperature for the respective refrigerating modules 70, 72.

The refrigeration appliance system illustrated in schematic form in FIG. 2 also includes a central cooling unit 60. Central cooling unit 60 can include a variable speed compressor 62, a condenser 64 and an expansion device 68 connected in a refrigerating circuit with an evaporator 90. A variable speed condenser fan 66 can be provided to circulate air over condenser 64. Evaporator 90 can be a tube and fin evaporator for cooling air that can be used as the cooling medium in the embodiment of FIG. 2. Expansion device 68 can be an expansion device with feedback arranged to control flow through the expansion device 68 based on the heat load in the refrigeration appliance system including the refrigerating modules 70, 72. Central cooling unit 60 can be connected to the refrigerating modules 70, 72 with insulated ducts 92 forming a cooling medium circuit for conveying chilled air from evaporator 90 to refrigerating modules 70, 72. Chilled air can be circulated by an evaporator fan 94 that can be a variable speed fan. Air inlets 93 can lead from the insulated ducts 92 to the respective refrigerating modules 70, 72, and air outlets 95 can lead from the respective refrigerating modules 70, 72 to the air ducts 92. Air inlets 93 and air outlets 95 form the apparatus for receiving the cooling medium, chilled air, in the refrigerating modules 70, 72. Air inlets 93 and air outlets 95 can be positioned with respect to insulated cabinets 74, 76 to provide a desired chilled air flow pattern in the respective refrigerating modules 70, 72. Air flow arrows 80 schematically illustrate the air flow in the insulated cabinets 74, 76. Further, each refrigerating module 70, 72 can have a baffle 96 to control flow of chilled air through air inlets 93 into the respective refrigerating modules 70, 72. Baffles 96 can be on-off or variable to control flow of chilled air through a refrigerating module. Baffles 96 can be adjustable between open and closed positions to permit or block flow of chilled air into the respective refrigerating modules 70, 72 and variable speed evaporator fan 94 can vary the flow of chilled air into the respective refrigerating modules 70, 72. Baffles 96 can also be variably movable between open and closed positions to permit, block and vary the flow of chilled air into the respective refrigerating modules 70, 72. Central cooling unit 60 can have a microprocessor based controller 100 having a first portion 102 that can be arranged to control the operation of central cooling unit 60 and a second portion 104 to control the volume of chilled air directed to the respective refrigerating modules 70, 72 similar to controller 50 in the embodiment of FIG. 1. A control circuit 106 can be provided to connect the temperature sensors 84, the temperature selectors 86, the variable speed compressor 62, the variable speed condenser fan 66, the expansion device 68, evaporator fan 94, and baffles 96 to controller 100. Thus, a refrigeration appliance system according to the invention is illustrated in FIG. 2 as a distributed refrigeration system having a variable capacity vapor compression condensing unit and a chilled forced air cooling delivery network.

According to the invention, central cooling unit 60 can be continuously operating so that chilled air is continuously circulated in insulated ducts 92 forming a cooling medium circuit from evaporator 90 to refrigerating modules 70, 72 and back to evaporator 90. Controller 100 can be arranged to adjust the capacity of the central cooling unit 60 in response to the aggregate cooling load of the plurality of refrigerating modules 70, 72. As noted above, while two refrigerating modules 70, 72 are illustrated in FIG. 2, according to the invention one or more than two refrigerating modules can be connected in the refrigerating appliance system. The aggregate cooling load can be determined by the first portion 102 of controller 100 as a function of temperatures sensed by temperature sensors 84, operating temperatures selected with temperature selectors 86, and feedback from expansion device 68. Controller 100 can also be arranged to control the operating temperature in each of the refrigerating modules 70, 72. Second portion 104 of controller 100 can be arranged to control baffles 96 and evaporator fan 94 to maintain the selected operating temperatures based on the settings of temperature selectors 86 and temperature sensors 84. Thus, according to the invention, a single continuously operating variable capacity central cooling unit 60 can be provided for a plurality of refrigerating modules 70, 72 that can be set to operate at different operating temperatures. The variable capacity central cooling unit 60 can be arranged for chilling a cooling medium. A cooling medium circuit, insulated ducts 92, can be provided connecting the central cooling unit 60 to supply the cooling medium from the central cooling unit 60 to the plurality of refrigerating modules 70, 72. A plurality of cooling medium flow control devices, baffles 96, can be provided for controlling flow of cooling medium, chilled air, to each of the refrigerating modules 70, 72, through air inlets 93 and air outlets 95. A controller 100 and control circuit 106 can be provided to adjust the capacity of the variable capacity central cooling unit 60 in order to supply sufficient cooling medium to cool the plurality of refrigerating modules 70, 72 to the respective selected operating temperatures, and the controller 100 and control circuit 106 can be arranged to adjust the volume of cooling medium directed to respective ones of the refrigerating modules 70, 72 by controlling the cooling medium flow control devices, evaporator fan 94 and baffles 96, to maintain the selected operating temperature in the respective refrigerating modules 70, 72. Controller 100 can control the speed of variable speed fan 94 to vary the volume of cooling medium, chilled air, in the cooling medium circuit, insulated ducts 92, to further control the operating temperature in the respective refrigerating modules 70, 72. The embodiment of FIG. 2 is preferably used for above freezing refrigerator modules to avoid the need to circulate chilled air in the cooling medium circuit to achieve temperatures approximating 0° F. for freezer modules, although freezer modules can be included in the FIG. 2 embodiment if desired.

Figure 3:
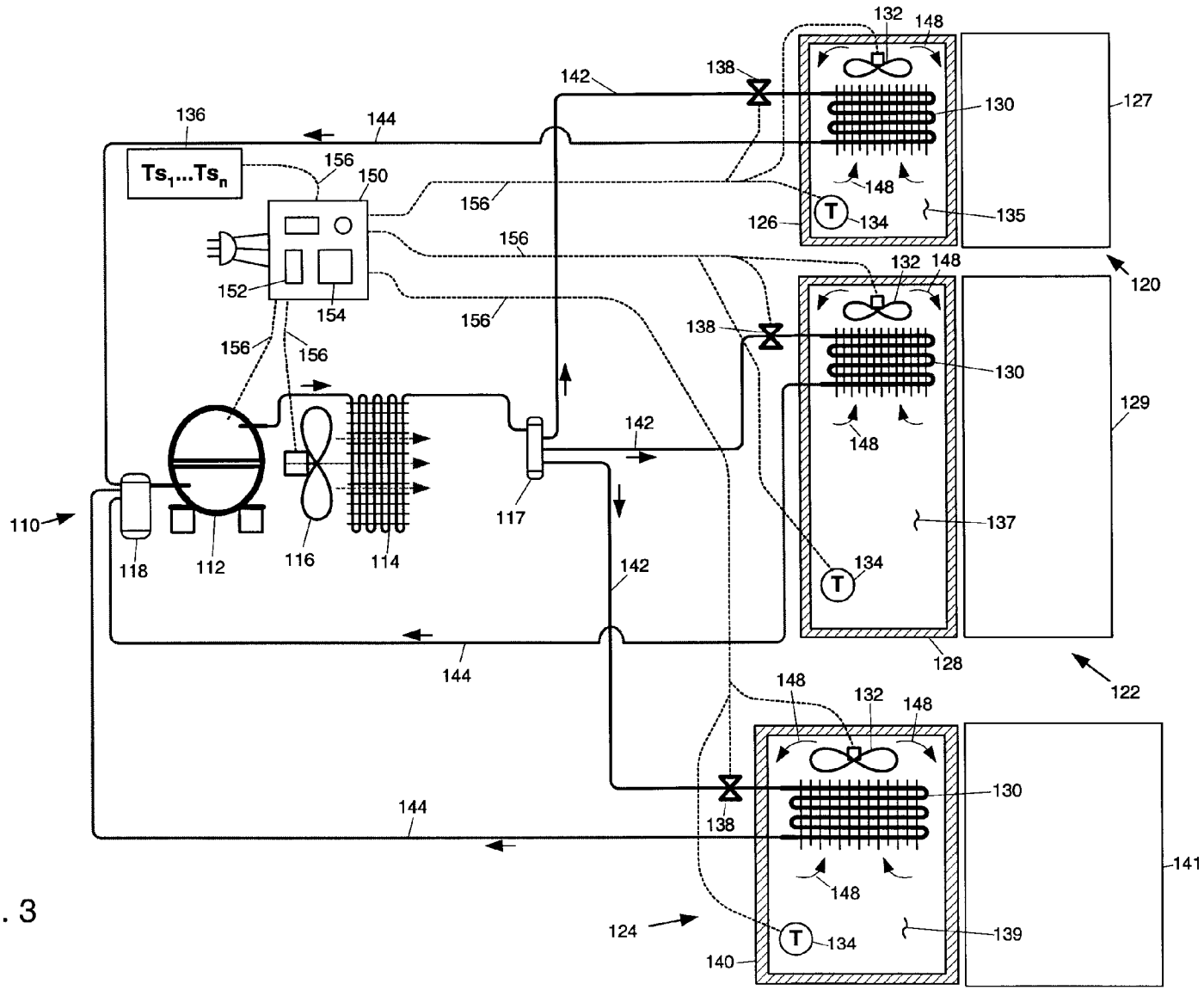
FIG. 3 is a schematic drawing illustrating another embodiment of a modular distributed refrigeration appliance system according to the invention.

Turning to FIG. 3, in another embodiment of the invention, illustrated in schematic form, refrigerating modules 120, 122 and 124 can be connected in a refrigeration appliance system that can include a central cooling unit 110. According to the invention one refrigerating module or more than three refrigerating modules can be provided in the refrigeration appliance system as desired. Refrigerating modules 120, 122 and 124 can be free standing or built in modules and can be general purpose refrigerator, freezer or can be special purpose modules. Refrigerating module 120 can have an insulated cabinet 126 and an insulated door 127 that can be hinged to insulated cabinet 126 to selectively open and close an opening 135 in insulated cabinet 126. Refrigerating module 122 can have an insulated cabinet 128 and an insulated door 129 that can be hinged to insulated cabinet 128 to selectively open and close an opening 137 in insulated cabinet 128. Refrigerating module 124 can have an insulated cabinet 140 and an insulated door 141 to selectively open and close an opening 139 in insulated cabinet 140. Those skilled in the art will understand that insulated doors 127, 129 and 141 can be provided with a suitable handle, not shown, to facilitate opening and closing insulated doors 127, 129 and 141. Refrigerating modules 120, 122, and 124 can include a refrigerating module evaporator 130 and a refrigerating module variable speed evaporator fan 132 arranged to circulate chilled air in the respective refrigerating modules. Air flow arrows 148 schematically illustrate the chilled air flow in the respective refrigerating modules. Refrigerating modules 120, 122 and 124 can have a temperature sensor 134 arranged to sense the temperature of the interior of refrigerating modules 120, 122 and 124. Temperature sensor 134 can be a thermistor or other well known electronic or mechanical temperature sensing mechanism or device. Temperature selectors 136 can be provided for each of the refrigerating modules 120, 122 and 124 to allow the user to select the operating temperature for the respective refrigerating modules 120, 122 and 124. While temperature selectors 136 are illustrated schematically spaced from refrigerating modules 120, 122 and 124 a temperature selector 136 can be located in each of the refrigerating modules 120, 122 and 124 as is well known in the art, or can be centrally located if desired. Temperature selectors 136 can comprise a well known mechanical or electronic selector mechanism to allow a user to select an operating temperature for the respective refrigerating modules 120, 122 and 124.

The refrigeration appliance system illustrated in schematic form in FIG. 3 also includes a central cooling unit 110. Central cooling unit 110 can include a variable speed compressor 112, a condenser 114 and a variable speed condenser fan 116. Central cooling unit 110 can also include a manifold 117 and an accumulator 118. Central cooling unit 110 can be connected to the refrigerating modules 120, 122 and 124 with refrigerant lines that can be insulated supply conduits 142 and insulated return conduits 144 forming a cooling medium circuit for conveying refrigerant from central cooling unit 110 through manifold 117 to refrigerating modules 120, 122, and 124 and returning refrigerant from refrigerating modules 120, 122, and 124 to accumulator 118 through insulated return conduits 144 for delivery to variable speed compressor 112. Refrigerating module evaporators 130 form the apparatus for receiving the cooling medium, refrigerant, in the refrigerating modules 120, 122 and 124. Further, each refrigerating module 120, 122 and 124 can have an expansion device 138 to control flow of refrigerant into the respective refrigerating module evaporators 130. Expansion devices 138 can be an expansion device with feedback arranged to control refrigerant flow through expansion device 138. Central cooling unit 110 can also have a microprocessor based controller 150 having a first portion 152 that can be arranged to control the operation of central cooling unit 110 and a second portion 154 to control the volume of refrigerant directed to the respective refrigerating modules 120, 122 and 124 similar to controller 50 in the embodiment of FIG. 1. A control circuit 156 can be provided to connect the temperature sensors 134, the temperature selectors 136, the variable speed compressor 112, the variable speed condenser fan 116, expansion devices 138 and evaporator fans 132 to controller 150. Thus, a refrigeration appliance system according to the invention is illustrated in FIG. 3 as a distributed refrigeration system having a variable capacity vapor compression condensing unit and an evaporator network. Depending on the refrigerating modules selected, the modules can all be above freezing, all below freezing, or a mixture of above freezing and below freezing refrigerating modules.

According to the invention, central cooling unit 110 can be continuously operating so that refrigerant is continuously circulated in refrigerant lines that can be insulated supply conduits 142 and insulated return conduits 144 forming a cooling medium circuit from condenser 114 through manifold 117 to refrigerating modules 120, 122 and 124 and back to compressor 112 through accumulator 118. Controller 150 can be arranged to adjust the capacity of the central cooling unit 110 in response to the aggregate cooling load of the plurality of refrigerating modules 120, 122 and 124. As noted above, while three refrigerating modules 120, 122 and 124 are illustrated in FIG. 3, according to the invention one or more than three refrigerating modules can be connected in the refrigerating appliance system. The aggregate cooling load can be determined by the first portion 152 of controller 150 as a function of temperatures sensed by temperature sensors 134, operating temperatures selected with temperature selectors 136 and feedback from expansion devices 138. Controller 150 can also be arranged to control the operating temperature in each of the refrigerating modules 120, 122 and 124. Second portion 154 of controller 150 can be arranged to control expansion devices 138 and refrigerating module evaporator fans 132 to maintain the selected operating temperatures based on the settings of temperature selectors 136 and temperature sensors 134. Controller 150 can be arranged to maintain approximately the same evaporator pressure in the refrigerating module evaporators 130 and control the temperature in the respective refrigerating modules by varying the flow of refrigerant into the refrigerating module evaporators 130 and controlling the speed of the respective refrigerating module evaporator fans 132. Thus, according to the invention, a single, continuously operating variable capacity central cooling unit 110 can be provided for a plurality of refrigerating modules 120, 122 and 124 that can be set to operate at different operating temperatures. The variable capacity central cooling unit 110 can be arranged for chilling a cooling medium, a refrigerant. A cooling medium circuit including refrigerant lines that can be insulated supply conduits and insulated return conduits 142, 144, can be provided connecting the central cooling unit 110 to supply the cooling medium from the central cooling unit 110 to the plurality of refrigerating modules 120, 122 and 124. A plurality of cooling medium flow control devices, expansion devices 138, can be provided for controlling flow of cooling medium, refrigerant, to each of the refrigerating modules 120, 122 and 124. A controller 150 and control circuit 156 can be provided to adjust the capacity of the variable capacity central cooling unit 110 in order to supply sufficient cooling medium to cool the plurality of refrigerating modules 120, 122 and 124 to the respective selected operating temperatures, and the controller 150 and control circuit 156 can be arranged to adjust the volume of cooling medium, refrigerant, directed to respective ones of the refrigerating modules 120, 122 and 124 by controlling the cooling medium flow control devices, expansion devices 138 and refrigerating module evaporator fans 132, to maintain the selected operating temperature in the respective refrigerating modules 120, 122 and 124. Controller 150 can control the speed of variable speed compressor 112, variable speed condenser fan 116 and expansion devices 138 to control the condensing and evaporating pressures of the cooling medium, refrigerant, in the cooling medium circuit including refrigerant lines that can be insulated supply and return conduits 142, 144, to further control the operating temperature in the respective refrigerating modules 120, 122 and 124.

Figure 4:
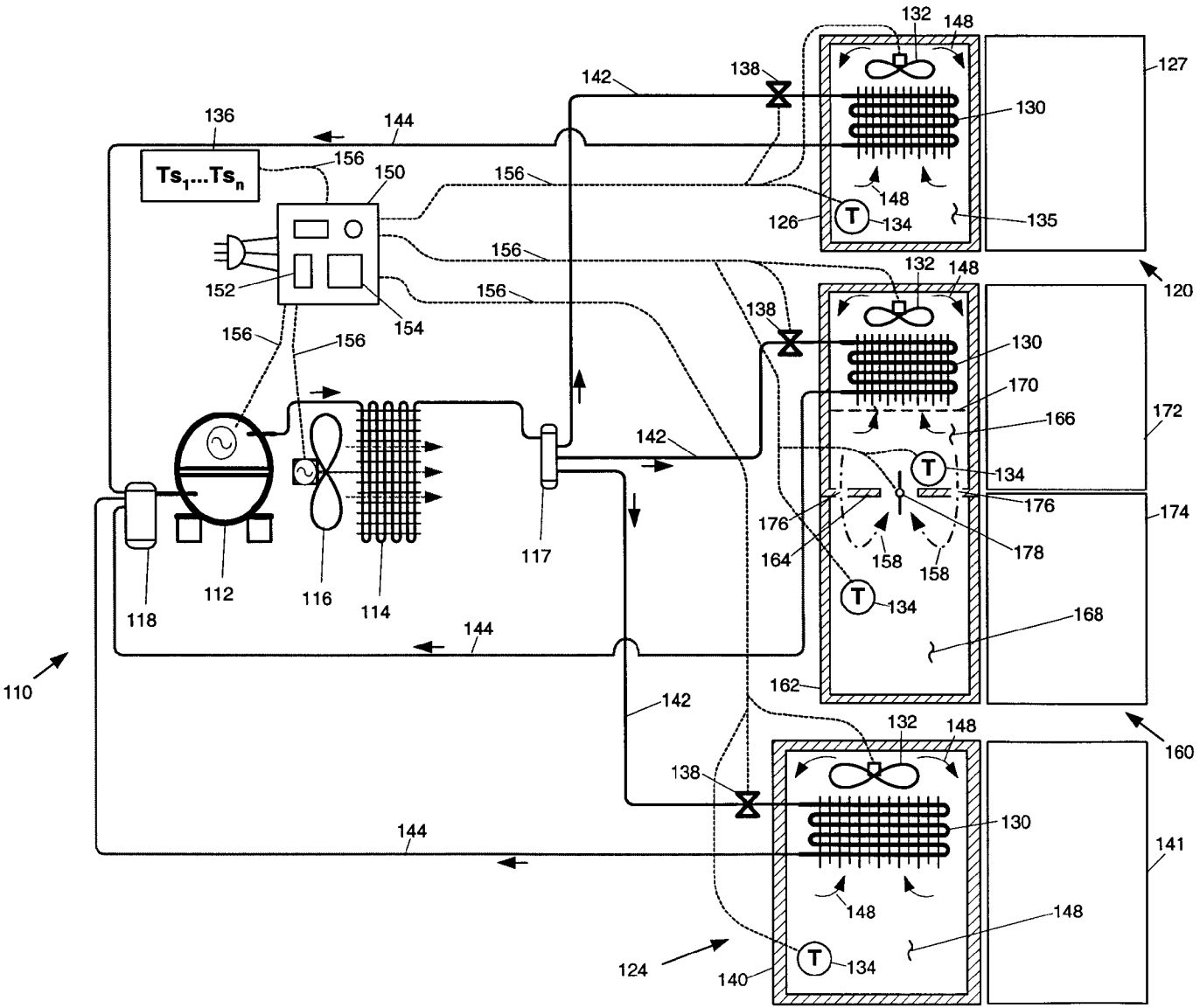
FIG. 4 is a schematic drawing illustrating another embodiment of a modular distributed refrigeration appliance system according to the invention.

Turning to FIG. 4, in another embodiment of the invention, illustrated in schematic form, refrigerating modules 120, 124 and 160 can be connected in a refrigeration appliance system that can include a central cooling unit 110. According to the invention one refrigerating module or more than three refrigerating modules can be provided in the refrigeration appliance system as desired. As described in the embodiment disclosed in FIG. 3, refrigerating modules 120 and 124 can be free standing or built in modules and can be general purpose refrigerator, freezer or can be special purpose modules. Refrigerating module 160 can be a refrigerator freezer having a refrigerator compartment 168 and a freezer compartment 166. Refrigerator compartment 168 can have an insulated refrigerator compartment door 174 hinged to insulated cabinet 162 and freezer compartment 166 can have an insulated freezer compartment door 172 hinged to insulated cabinet 162. Those skilled in the art will understand that insulated doors 127, 141, 172 and 174 can be provided with a suitable handle, not shown, to facilitate opening and closing insulated doors 127, 141, 172 and 174. Refrigerating modules 120, 124 and 160 can include a refrigerating module evaporator 130 and a variable speed refrigerating module evaporator fan 132 arranged to circulate chilled air in the respective refrigerating modules, see air flow arrows 148. Refrigerating modules 120 and 124 can have a temperature sensor 134 arranged to sense the temperature of the interior of refrigerating modules 120, 124. Refrigerator freezer module 160 can have a temperature sensor 134 for refrigerator compartment 168 and a temperature sensor 134 for freezer compartment 166. Temperature sensors 134 can be a thermistor or other well known electronic or mechanical temperature sensing mechanism or device. Temperature selectors 136 can be provided for each of the refrigerating modules 120 and 124 to allow the user to select the operating temperature for the respective refrigerating modules 120 and 124. Refrigerator freezer 160 can have two temperature selectors 136, one for the refrigerator compartment 168 and one for the freezer compartment 166. While temperature selectors 136 are illustrated schematically spaced from refrigerating modules 120, 124 and 160 a temperature selector(s) 136 can be located in each of the refrigerating modules 120, 124 and 160 as is well known in the art, or alternately can be centrally located if desired. Temperature selectors 136 can comprise a well known mechanical or electronic selector mechanism to allow a user to select an operating temperature for the respective refrigerating modules 120, 124 and 160.

The refrigeration appliance system illustrated in schematic form in FIG. 4, similar to the embodiment illustrated in FIG. 3, can include a central cooling unit 110. Central cooling unit 110 can include a variable speed compressor 112, a condenser 114 and a variable speed condenser fan 116. Central cooling unit 110 can also include a manifold 117 and an accumulator 118. Central cooling unit 110 can be connected to the refrigerating modules 120, 124 and 160 with refrigerant lines that can be insulated supply conduits 142 and insulated return conduits 144 forming a cooling medium circuit for conveying refrigerant from central cooling unit 110 through manifold 117 to refrigerating modules 120, 124 and 160 and returning refrigerant from refrigerating modules 120, 124 and 160 to accumulator 118 through insulated return conduits 144 for delivery to variable speed compressor 112. Refrigerating module evaporators 130 form the apparatus for receiving the cooling medium, refrigerant, in the refrigerating modules 120, 124 and 160. Further, each refrigerating module 120, 124 and 160 can have an expansion device 138 to control flow of refrigerant into the respective refrigerating module evaporators 130. Expansion devices 138 can be an expansion device with feedback arranged to control refrigerant flow through expansion device 138. Central cooling unit 110 can also have a microprocessor based controller 150 having a first portion 152 that can be arranged to control the operation of central cooling unit 110 and a second portion 154 to control the volume of refrigerant directed to the respective refrigerating modules 120, 124 and 160 similar to microprocessor based controller 50 in the embodiment of FIG. 1. A control circuit 156 can be provided to connect the temperature sensors 134, the temperature selectors 136, the variable speed compressor 112, the variable speed condenser fan 116, expansion devices 138 and evaporator fans 132 to controller 150. Thus, a refrigeration appliance system according to the invention is illustrated in FIG. 4 as a distributed refrigeration system having a variable capacity vapor compression condensing unit and an evaporator network. Depending on the refrigerating modules selected, the modules can all be above freezing, all below freezing, or a mixture of above freezing and below freezing refrigerating modules in addition to refrigerator freezer module 160.

Refrigerating module 160 can be a two temperature refrigerator freezer module that can be arranged to have an above freezing refrigerator compartment 168 and a below freezing freezer compartment 166 as noted above. An insulated compartment separator 164 can be provided to divide insulated cabinet 162 into a refrigerator compartment 168 and a freezer compartment 166. Freezer compartment 166 can have an evaporator compartment that can be formed by an evaporator compartment wall 170 that can be arranged to separate the refrigerating module evaporator 130 from the freezer compartment 166. Evaporator compartment wall 170 is illustrated schematically as a dashed line below refrigerating module evaporator 130 to indicate that air flows (air flow arrows 148) into freezer compartment 166 from the refrigerating module evaporator 130, and similarly, air returns to the evaporator compartment under the influence of refrigerating module evaporator fan 132. Insulated compartment separator 164 can have chilled air passages 176 positioned on compartment separator 164 that can allow chilled air (air flow arrows 158) from the freezer compartment 166 or evaporator compartment to flow into refrigerator compartment 168 as is well known in the art. Compartment separator 164 can have a refrigerator compartment damper 178 to control the flow of air from the refrigerator compartment 168 back to freezer compartment 166 and refrigerating module evaporator 130 drawn by refrigerating module evaporator fan 132. In the embodiment of the invention illustrated in FIG. 4, refrigerator compartment damper 178 is shown in the return air path from refrigerator compartment 168. Those skilled in the art will understand that chilled air passages 176 could be arranged in the return air path from refrigerator compartment 168 and refrigerant compartment damper 178 arranged in the flow of chilled air into refrigerator compartment 168 if desired. Refrigerator compartment damper 178 can be an automatic damper operated by controller 150 as illustrated in FIG. 4, or, if desired, refrigerator compartment damper 178 can be a manually adjustable damper manually adjusted by the user and temperature sensor 134 and temperature selector 136 eliminated from freezer compartment 166.

Similar to the embodiment of FIG. 3, according to the invention, central cooling unit 110 can be continuously operating so that refrigerant is continuously circulated in refrigerant lines that can be insulated supply conduits 142 and return conduits 144 forming a cooling medium circuit from condenser 114 through manifold 117 to refrigerating modules 120, 124 and 160 and back to compressor 112 through accumulator 118. Controller 150 can be arranged to adjust the capacity of the central cooling unit 110 in response to the aggregate cooling load of the plurality of refrigerating modules 120, 124 and 160. As noted above, while three refrigerating modules 120, 124 and 160 are illustrated in FIG. 4, according to the invention one or more than three refrigerating modules can be connected in the refrigerating appliance system. The aggregate cooling load can be determined by the first portion 152 of controller 150 as a function of temperatures sensed by temperature sensors 134, operating temperatures selected with temperature selectors 136, and feedback from expansion devices 138. Controller 150 can also be arranged to control the operating temperature in each of the refrigerating modules 120, 124 and 160. Second portion 154 of controller 150 can be arranged to control expansion devices 138 and refrigerating module evaporator fans 132 to maintain the selected operating temperatures based on the settings of temperature selectors 136 and temperature sensors 134. In addition, second portion 154 of controller 150 can be arranged to control refrigerator compartment damper 178 to control the amount of chilled air flowing from freezer compartment 166 and refrigerating module evaporator 132 through compartment separator 164 into refrigerator compartment 168 in conjunction with refrigerating module evaporator fan 132 to maintain the user selected temperature in refrigerator compartment 168 as well as in freezer compartment 166. Controller 150 can be arranged to maintain approximately the same evaporator pressure in the refrigerating module evaporators 130 and control the temperature in the respective refrigerating modules 120, 124 and 160 by varying the flow of refrigerant into the refrigerating module evaporators 130 and controlling the speed of the respective refrigerating module evaporator fans 132. Thus, according to the invention, a single, continuously operating variable capacity central cooling unit 110 can be provided for a plurality of refrigerating modules 120, 124 and 160 that can be set to operate at different operating temperatures, and refrigerating module 160 can be set to have a refrigerator compartment and a freezer compartment. The variable capacity central cooling unit 110 can be arranged for chilling a cooling medium, a refrigerant. A cooling medium circuit that can include refrigerant lines that can be insulated supply conduits and insulated return conduits 142, 144, can be provided connecting the central cooling unit 110 to supply the cooling medium from the central cooling unit 110 to the plurality of refrigerating modules 120, 124 and 160. A plurality of cooling medium flow control devices, expansion devices 138, can be provided for controlling flow of cooling medium, refrigerant, to each of the refrigerating modules 120, 124 and 160. A controller 150 and control circuit 156 can be provided to adjust the capacity of the variable capacity central cooling unit 110 in order to supply sufficient cooling medium to cool the plurality of refrigerating modules 120, 124 and 160 to the respective selected operating temperatures, and the controller 150 and control circuit 156 can be arranged adjust the volume of cooling medium, refrigerant, directed to respective ones of the refrigerating modules 120, 124 and 160 by controlling the cooling medium flow control devices, expansion devices 138 and refrigerating module evaporator fans 132, to maintain the selected operating temperature in the respective refrigerating modules 120, 124 and 160. Controller 150 can control the speed of variable speed compressor 112, variable speed condenser fan 116 and expansion devices 138 to control the condensing and evaporating pressures of the cooling medium, refrigerant, in the cooling medium circuit including refrigerant lines that can be insulated supply and return conduits 142, 144, to further control the operating temperature in the respective refrigerating modules 120, 124 and 160.

Figure 5:
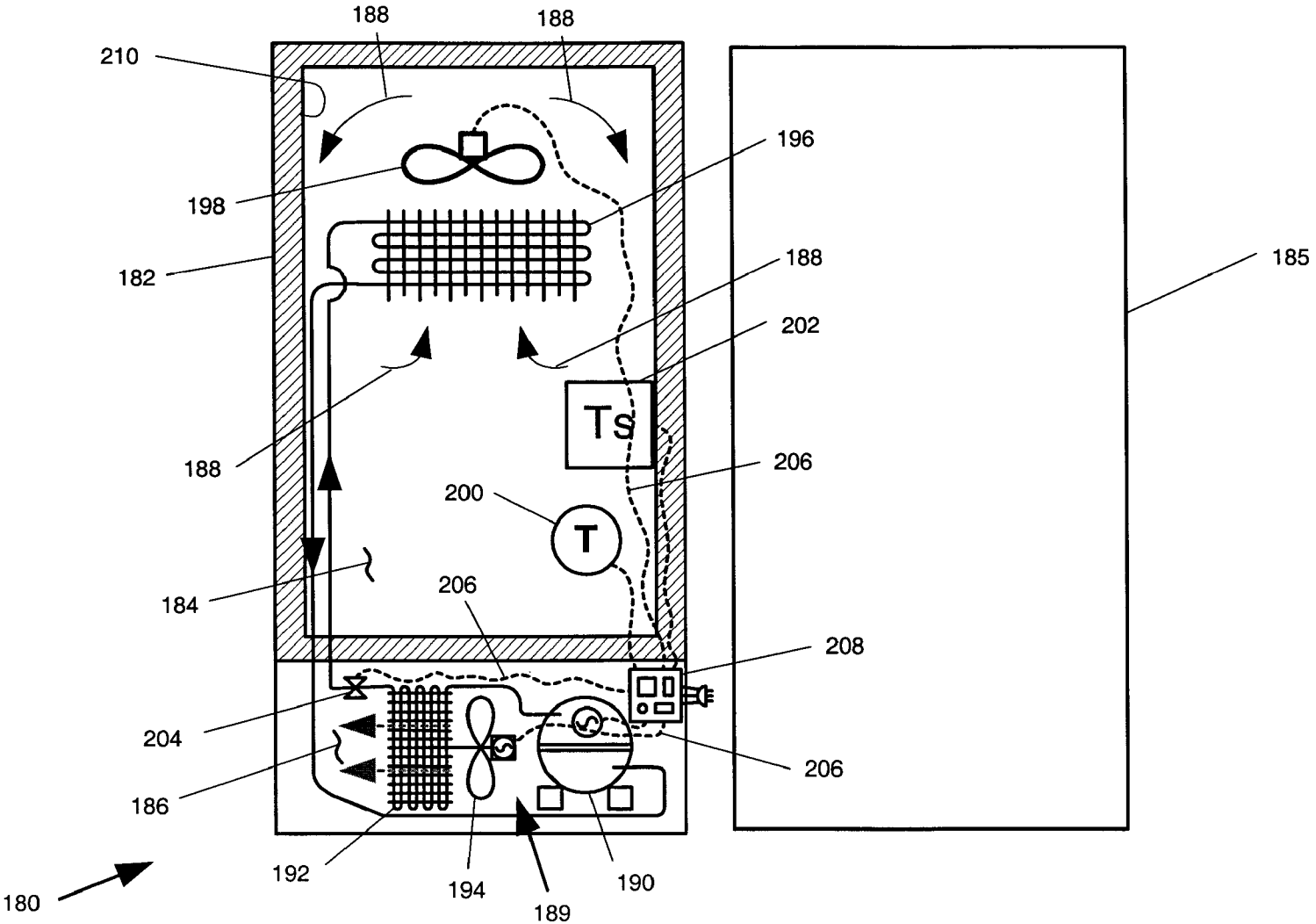
FIG. 5 is a schematic drawing illustrating a refrigeration appliance module that can be used in combination with a modular distributed refrigeration appliance system according to the invention.

Turning to FIG. 5, a freezer module 180 is illustrated that can be used in combination with a refrigeration appliance system according to the invention. Freezer module 180 can be a conventional freezer capable of operating without connection to the refrigeration appliance system according to the invention. Particularly when a freezer module arranged for 0° F. storage temperatures is desired for use in combination with the embodiments illustrated in FIG. 1 (employing liquid coolant as the cooling medium), FIG. 2 (employing chilled air as the cooling medium), or FIG. 3 (particularly when above freezing refrigerator modules will be connected in the refrigeration appliance system) it can be advantageous to incorporate a freezer module 180 as illustrated in FIG. 5. However, a freezer module 180 can be combined with any of the embodiments according to the invention. Freezer module 180 can have a insulated freezer cabinet 182 defining an opening 184 for access to the freezer compartment and can have an insulated freezer door 185 hinged to the insulated freezer cabinet 182 to selectively open and close the freezer compartment. Freezer door 185 can have a handle, not shown, to facilitate opening and closing freezer door 185 for access to freezer module 180. Freezer module 180 can include a freezer cooling unit 189 in a machinery compartment 186 outside the refrigerated portion of the freezer cabinet 182 that can include a freezer compressor 190, a freezer condenser 192 and a freezer condenser fan 194. Freezer module 180 can include a freezer evaporator 196 that can be positioned in insulated freezer cabinet 182 and can have a freezer evaporator fan 198 and a freezer expansion device 204. Freezer module 180 can have a freezer temperature sensor 200 that can be similar to the temperature sensors described above. Freezer module 180 can also have a freezer temperature selector 202 to allow user to select the operating temperature for the freezer module. Freezer module 180 can have a controller 208 and a control circuit 206 connecting the freezer temperature sensor 200, freezer temperature selector 202, freezer compressor 190, freezer condenser fan 194 and freezer evaporator fan 198 to controller 208. Controller 208 can operate freezer module 180 in a manner similar to conventional freezer products as is well known in the art. Those skilled in the art will understand that freezer compressor 190, freezer condenser fan 194 and freezer evaporator fan 198 can be provided with variable speed motors as desired for optimum operation. Freezer expansion device 204 can be an expansion device with feedback as used in the embodiments of FIGS. 1-4 or can be a capillary tube expansion device, again as well known in the art. Freezer compressor 190 can be a variable speed compressor if desired as is well known in the art. Alternately, those skilled in the art will understand that freezer condenser 192 and/or freezer evaporator 196 can be static heat exchangers and that if a static heat exchanger is used the respective freezer condenser fan 194 and/or freezer evaporator fan 198 could be eliminated. For example freezer module 180 could be a chest freezer having freezer evaporator 196 positioned in contact with the inner liner 210 defining the freezer compartment in the insulation between the inner liner 210 and cabinet 182 as is well known in the art. Similarly, freezer condenser 192 could be positioned in contact with cabinet 182 positioned in the insulation between inner liner 210 and cabinet 182 as is well known in the art.

Figure 6:
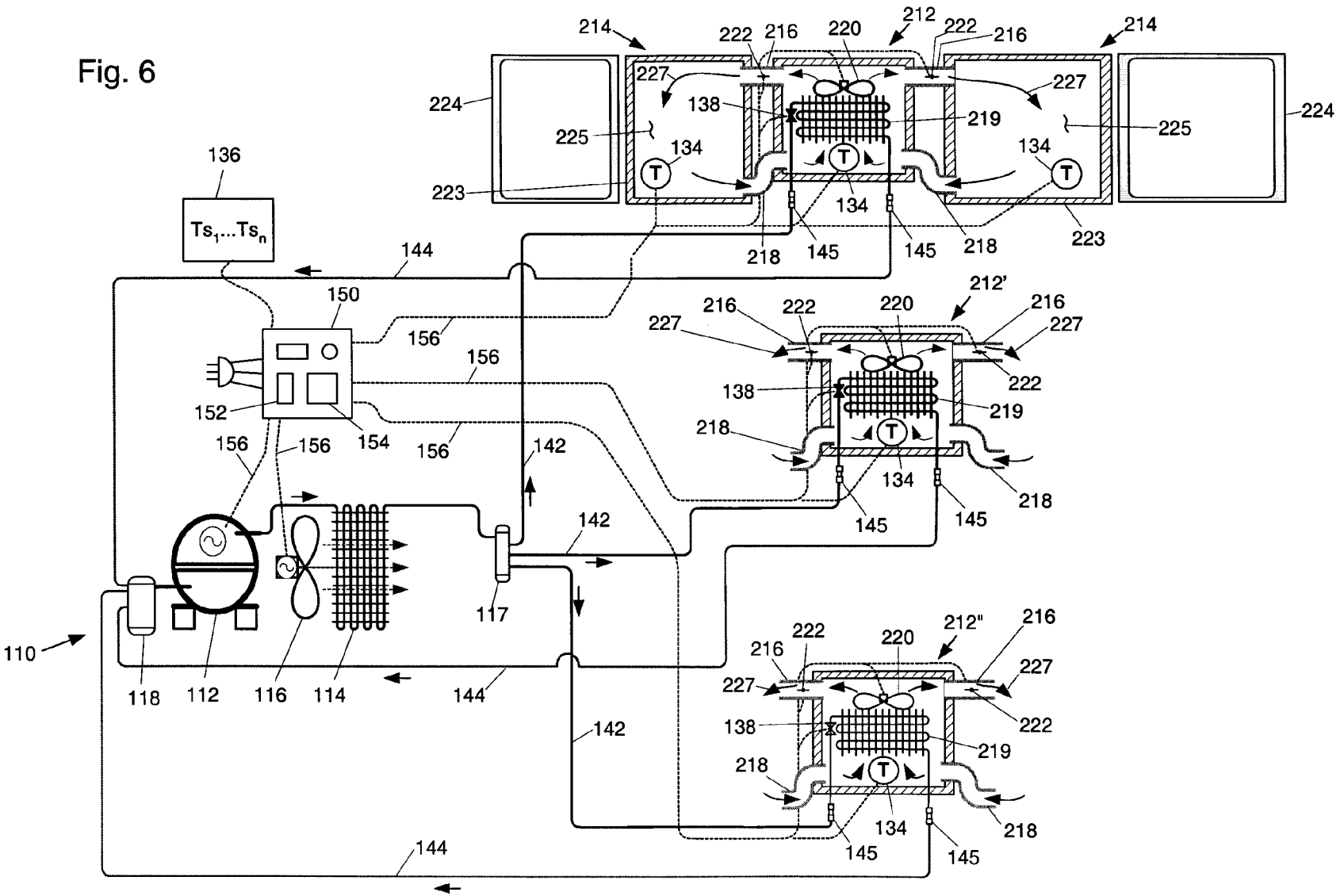
FIG. 6 is a schematic drawing illustrating another embodiment of a modular distributed refrigeration system incorporating satellite stations according to the invention.

Turning to schematic FIG. 6, in another embodiment of the invention, a plurality of satellite stations 212, 212' and 212" can be connected in a refrigeration appliance system that can include a central cooling unit. Each satellite station can have one or two refrigeration appliance modules 214 located in proximity of the satellite station to form a distributed refrigeration appliance system. Refrigeration appliance modules can be free standing or built in modules and can be general purpose refrigerator, freezer or special purpose modules. Satellite stations 212 and refrigeration appliance modules 214 can be located in a residential kitchen or other locations associated with a dwelling as desired. The central cooling unit can be similar to the central cooling unit illustrated in FIG. 3, and accordingly, will use the same reference numerals as the central cooling unit 110 illustrated in FIG. 3. Central cooling unit 110, controller 150 and the central cooling system operation are described in detail above in connection with the embodiment of FIG. 3. As noted above, central cooling unit 110 can be located in a location remote from a residential kitchen if desired.

According to the invention one satellite station or more than three satellite stations can be provided in the refrigeration appliance system as desired. Refrigeration appliance modules 214 can be located in proximity of satellite station 212 and can be connected to satellite station 212 by an insulated supply duct 216 and an insulated return duct 218 for supplying chilled air to the refrigeration appliance modules 214 from satellite station 212. While insulated supply duct 216 and insulated return duct 218 are schematically illustrated as separate ducts, those skilled in the art will understand that the insulated ducts can be coaxial or, alternately, formed insulated ducts with two discrete parallel passages if desired. Those skilled in the art will understand that if only one refrigeration appliance module 214 will be located in proximity of a satellite station 212 that only one set of insulated supply and return ducts can be provided, or alternately, the unused set of ducts can be plugged or blocked to provide for future expansion of the system. Satellite station 212 can include a satellite station evaporator 219 that can be connected to central cooling system 110 through a refrigerant line that can be an insulated supply conduit 142 through expansion device 138 and a refrigerant line that can be an insulated return conduit 144. As is well known in the art, quick connect fittings 145 can be used to connect satellite station 212 to the refrigerant lines. Expansion device 138 can be an adjustable expansion device with feedback based on the load experienced by the satellite station 212, and can be connected to controller 150 through control circuit 156. Those skilled in the art will understand that, if desired, one or more satellite stations 212 can include a plurality of expansion devices, not shown, connected in a refrigeration circuit for the satellite station 212 to operate the satellite station evaporator at a plurality of operating temperatures to, for example, allow a user to selectively operate one or more of the refrigeration appliance modules 214 connected to a satellite station 212 to be operated as an above freezing refrigerator compartment or as a below freezing freezer compartment by merely selecting a different expansion device to control the satellite station evaporator 219. For example, plural expansion devices could be connected in parallel in the refrigeration circuit including the satellite station evaporator 219. A multi-temperature evaporator system is disclosed in U.S. Pat. No. 5,377,498, assigned to the assignee of this application. U.S. Pat. No. 5,377,498 is incorporated herein by reference. Satellite station 212 can also have a variable speed satellite station evaporator fan 220 that can be connected to controller 150 through control circuit 156. Those skilled in the art will understand that satellite station evaporator fan 220 can be a single speed fan if desired. Satellite station 212 can also have a temperature sensor 134 arranged to sense the temperature in satellite station 212. Satellite stations 212' and 212" can be similar to satellite station 212. While satellite stations 212' and 212" are illustrated without refrigeration appliance modules 214 positioned in proximity to the respective satellite stations to simplify the drawings, those skilled in the art will understand that refrigeration appliance modules such as modules 214 illustrated in proximity of satellite station 212 can, and in practice additional satellite stations 212' and 212", if included in the distributed refrigeration appliance system, would likely be combined with one or more refrigeration appliance modules 214.

Refrigeration appliance module 214 can have an insulated cabinet 223 and at least one insulated door 224 that can be hinged to insulated cabinet 223 to selectively open and close an opening 225 in insulated cabinet 223. Those skilled in the art will understand that insulated doors 224 can be provided with a suitable handle, not shown, to facilitate opening and closing insulated doors 224. Refrigeration appliance module 214 can have an adjustable baffle 222 that can be positioned to control air flow through insulated supply duct 216. Adjustable baffle 222 can be variably movable between open and closed positions to permit, block and vary the flow of chilled air into refrigeration appliance module 214. Adjustable baffle 222 can be manually adjustable by a user to control the temperature in refrigeration appliance module 214, or, as illustrated, can be an automatic adjustable baffle connected to controller 150 through control circuit 156. Air flow arrows 227 schematically illustrate chilled air flow from satellite station 212 to refrigeration appliance module 214 through insulated supply duct 216 and back to satellite station 212 through insulated return duct 218. Those skilled in the art will understand that adjustable baffle 222 can be positioned in insulated return duct 218, or if desired an adjustable baffle 222 can be provided in both supply and return ducts in order to isolate a refrigeration appliance module 214. Refrigeration appliance module 214 can also have a temperature sensor 134 to sense the temperature within insulated cabinet 223. As above, temperature sensors 134 can be a thermistor or other well known electronic or mechanical temperature sensing mechanism or device and can be connected to controller 150 through control circuit 156. A temperature selector 136 can be provided for each of the refrigeration appliance modules 214 to allow the user to select the operating temperature for each of the refrigeration appliance modules 214. While temperature selectors 136 are illustrated schematically spaced from refrigeration appliance modules 214 a temperature selector 136 can be located in each of the refrigeration appliance modules 214 as is well known in the art, or can be centrally located in a combined user interface as illustrated if desired. Temperature selectors 136 can comprise a well known mechanical or electronic selector mechanism to allow a user to select an operating temperature for the respective refrigerating appliance module 214 and can be connected to controller 150 through control circuit 156. As above, the aggregate distributed refrigeration appliance system cooling load can be determined by the first portion 152 of controller 150 as a function of temperatures sensed by temperature sensors 134, operating temperatures selected with temperature selectors 136 and feedback based on load from expansion devices 138. Controller 150 can also be arranged to control the operating temperature in each of the refrigeration appliance modules 214. Second portion 154 of controller 150 can be arranged to control expansion devices 138, adjustable baffles 222 and satellite station evaporator fans 220 to maintain the selected operating temperatures based on the settings of temperature selectors 136 and temperature sensors 134. Controller 150 can be arranged to maintain approximately the same evaporator pressure in the satellite station evaporators 219 and control the temperature in the respective refrigeration appliance modules 214 by varying the flow of refrigerant into the satellite station evaporators 219, the position of automatic baffles 222 and controlling the speed of the respective refrigeration appliance module evaporator fans 220. Refrigeration appliance modules 214 connected to a satellite station 212 can be operated at different operating temperatures. For instance, one refrigeration appliance module 214 can be set to operate as an above freezing refrigerator module and another refrigeration appliance module 214 connected to the same satellite station 212 can be set to operate as a below freezing freezer module if so desired. If manual baffles are provided instead of automatic baffles those skilled in the art will understand that the user can set the baffles to obtain the desired temperature in the refrigeration appliance modules. Thus, according to the invention, a single, continuously operating variable capacity central cooling unit 110 can be provided for a plurality of refrigeration appliance modules 214 that can be set to operate at different operating temperatures that can include temperatures to allow operation of a refrigeration appliance module as an above freezing refrigerator compartment, a below freezing freezer compartment or another refrigeration appliance such as an ice maker.

Figures 7A, 7B, 7C:
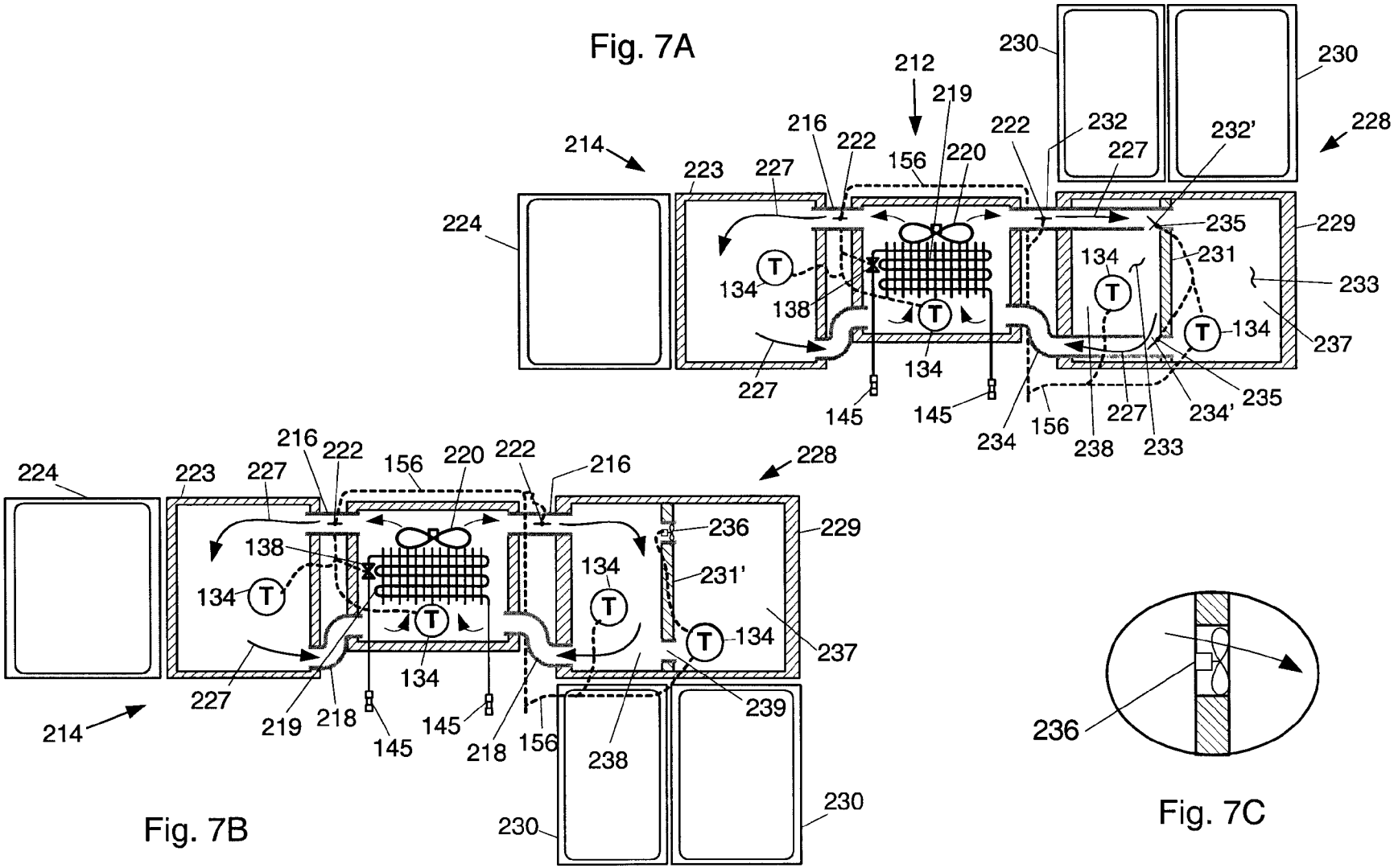
FIG. 7A is a partial schematic drawing illustrating another embodiment of refrigeration appliance modules that can be used in combination with the modular distributed refrigeration system illustrated in FIG. 6.
FIG. 7B is a partial schematic drawing illustrating another embodiment of refrigeration appliance modules that can be used in combination with the modular distributed refrigeration system illustrated in FIG. 6.
FIG. 7C is an enlarged partial schematic drawing illustrating a fan to control air flow between compartments of a refrigeration appliance module as illustrated in FIG. 7B.

Turning to schematic FIGS. 7A, 7B and 7C, in another embodiment of the invention, two compartment refrigeration appliance modules can be combined with a satellite station. A single satellite station 212 can be connected to refrigeration appliance modules is shown in each of FIGS. 7A and 7B with the central cooling unit 110 omitted to simplify the drawings. A refrigeration appliance module 228 can be used in a distributed refrigeration appliance system having one or more refrigeration appliance modules 214 located in proximity of one or more satellite stations 212 to form a distributed refrigeration appliance system. Refrigeration appliance module 228 can be a free standing or a built in module and can be general purpose refrigerator, freezer or a special purpose module. Refrigeration appliance module 228 can be located in a residential kitchen or other locations associated with a dwelling as desired. The central cooling unit, not shown, can be similar to the central cooling unit illustrated in FIG. 3, and as above, can be located remote from the residential kitchen. Central cooling unit 110, controller 150 and the central cooling system operation are described in detail above in connection with the embodiment of FIG. 3 and FIG. 6. Those skilled in the art will understand that more than one satellite station 212 can be provided and that satellite station 212 can be connected to central cooling unit 110 through well known quick connect fittings 145 to refrigerant lines that can be insulated supply conduits 142 and 144, and to controller 150 through control circuit 156 as illustrated in FIG. 6. In the embodiment illustrated in FIG. 7A a two compartment refrigeration appliance module 228 can be connected to satellite station 212 by an insulated supply duct 232 and an insulated return duct 234. A refrigeration appliance module 214 can also be connected to satellite station 212 as in the embodiment illustrated in FIG. 6. Refrigeration appliance module 214 is described in detail above and accordingly will not be described in detail again in connection with FIGS. 7A-7C. Refrigerating module 214 will use the same reference numerals as refrigerating module 214 in FIG. 6. Refrigeration appliance module 228 can have an insulated cabinet 229 that can have two insulated doors 230 hinged to insulated cabinet 229 to selectively open and close openings 233. Insulated doors 230 can be provided with a handle, not shown, to facilitate opening and closing insulated doors 230. Insulated cabinet 229 can have an insulated compartment separator 231 to divide insulated cabinet 229 into two compartments 237 and 238 that can be closed by the insulated doors 230. Insulated supply duct 232 can be arranged to extend substantially through compartment 238 to supply chilled air to compartment 237. Insulated supply duct 232 can have an opening 232' in compartment 238 to supply chilled air to compartment 238. Opening 232' can be located adjacent compartment separator 231 and can be provided with an adjustable baffle 235 that can be arranged to control chilled air flow into compartments 237 and 238. Similarly, insulated return duct 234 can extend substantially through compartment 238 to provide for chilled air return from compartment 237 without flowing through compartment 238. Insulated return duct 234 can have an opening 234' that can be located adjacent compartment separator 231 and can be provided with an adjustable baffle 235 that can be arranged to control chilled air flow out of compartments 237 and 238. Similar to refrigerated appliance module 214, insulated supply duct 232 can be provided with an adjustable baffle 222 to control the quantity of chilled air supplied to refrigeration appliance module 228 from satellite station 212 by satellite station evaporator fan 220. Adjustable baffles 222 and 235 can be manually adjustable by the user to select the operating temperatures of compartments 237 and 238, or can be automatically adjustable baffles controlled by controller 150 through control circuit 156 as generally described above. Refrigerating module 214 can operate in the same manner as refrigeration appliance modules 214 as described in connection with FIG. 6. Thus, a user can operate refrigeration appliance module 214 at one operating temperature and can operate the two compartments 237, 238 of refrigeration appliance module 228 at different temperatures and a different temperatures from refrigeration appliance module 214 as desired. As described above, compartment 237 and 238 can be operated at different operating temperatures that can above or below freezing as desired as can the refrigeration appliance module 214. Those skilled in the art will understand that alternate insulated duct and damper arrangements can be provided to provide chilled air flow into compartments 237 and 238 as desired.

In the embodiment illustrated in FIGS. 7B and 7C a two compartment refrigeration appliance module 228 can be connected to satellite station 212 by an insulated supply duct 216 and an insulated return duct 218. A refrigeration appliance module 214 can be connected to satellite station 212 as in the embodiment illustrated in FIG. 6. Refrigeration appliance module 228 can have an insulated cabinet 229 that can have two insulated doors 230 hinged to insulated cabinet 229 to selectively open and close openings 233. Insulated doors 230 can be provided with a handle, not shown, to facilitate opening and closing insulated doors 230. Insulated cabinet 229 can have an insulated compartment separator 231' to divide insulated cabinet 229 into two compartments 237 and 238 that can be closed by the insulated doors 230. Insulated compartment separator 231' can have a circulation fan 236 provided in an opening in compartment separator 231' and can have a second opening 239. Circulation fan 236 can be seen in FIG. 7C. In the embodiment of FIGS. 7B and 7C circulation fan 236 can control flow of chilled air from compartment 238 to compartment 237. As described above, adjustable baffle 222 can control the flow of chilled air from satellite station 212 to refrigeration appliance module 228. Thus, for two compartment refrigeration appliance modules two embodiments have been illustrated for controlling the temperature in the two compartments 237, 238. One approach, as shown in FIG. 7A, employs adjustable baffles to control the flow of chilled air to the respective compartments. Another approach, as shown in FIGS. 7B and 7C, employs a circulation fan 236 in compartment separator 231' to control flow of chilled air from compartment 238 into compartment 237. Those skilled in the art will recognize that in the FIGS. 7B and 7C embodiment compartment 237 can only operate at a higher temperature than compartment 238, whereas in the FIG. 7A embodiment it can be possible to operate compartment 237 at a lower temperature than compartment 238.

Figures 8A, 8B:
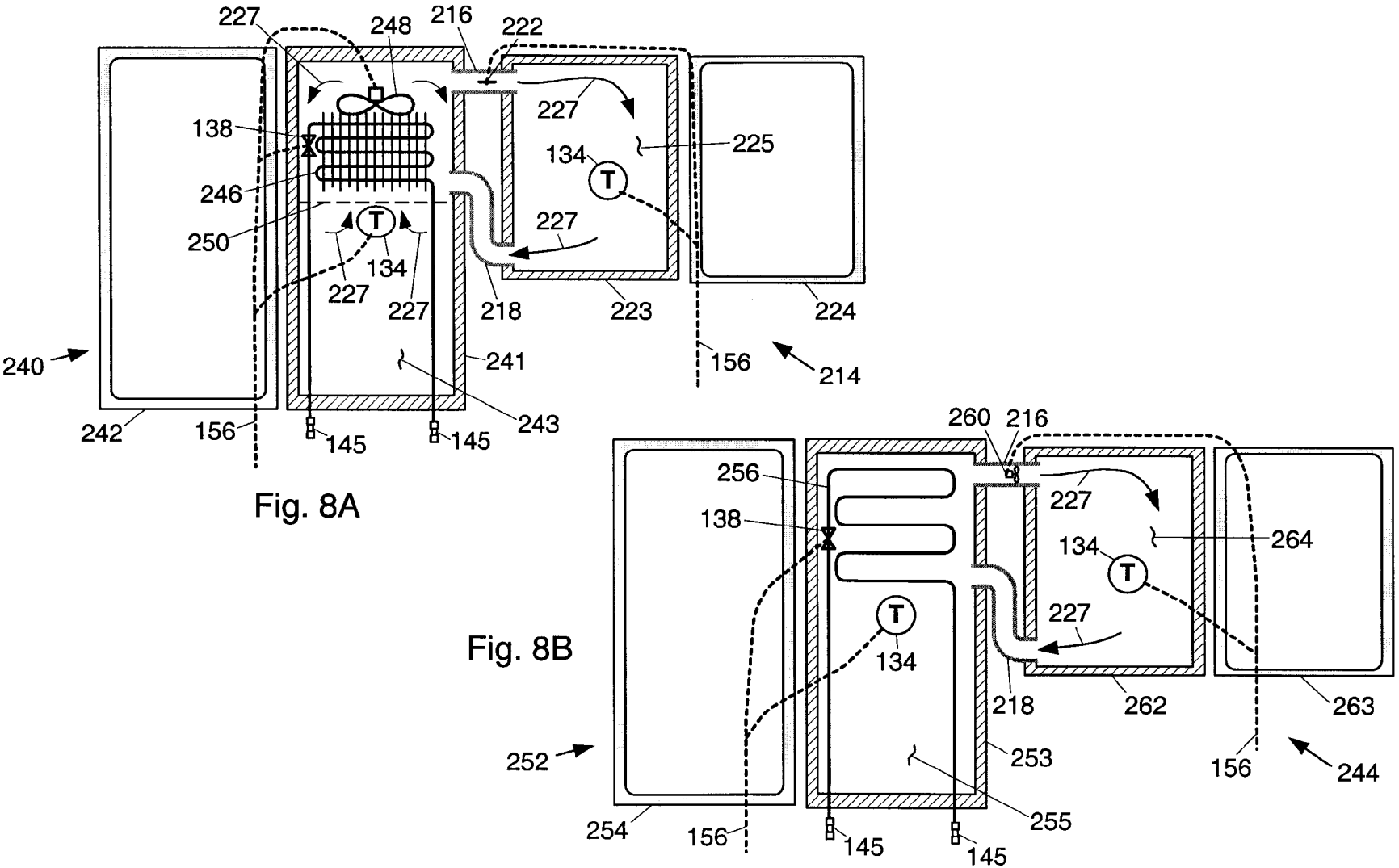
FIG. 8A is a partial schematic drawing illustrating another embodiment of refrigeration appliance modules that can be used in combination with the modular distributed refrigeration system illustrated in FIG. 6.
FIG. 8B is a partial schematic drawing illustrating another embodiment of refrigeration appliance modules that can be used in combination with the modular distributed refrigeration system illustrated in FIG. 6.

Turning to schematic FIG. 8A, in another embodiment of the invention, a satellite station can be combined with a refrigeration appliance module. In FIG. 8A a combined satellite station/refrigeration appliance module 240 and refrigeration appliance module 214 are illustrated without a central cooling unit 110 or additional satellite stations 212 and refrigeration appliance modules 214 to simplify the drawings. A combined satellite station/refrigeration appliance module 240 can be used in a distributed refrigeration appliance system having one or more refrigeration appliance modules 214 or 228 located in proximity of one or more satellite stations 212 to form a distributed refrigeration appliance system. Combined satellite station/refrigeration appliance module 240 and refrigeration appliance module 214 can be free standing or built in modules and can be general purpose refrigerator, freezer or special purpose modules. Combined satellite station/refrigeration appliance module 240 can be located in a residential kitchen or other locations associated with a dwelling as desired. Combined satellite station/refrigeration appliance module can have an insulated cabinet 241, an insulated door 242 that can be hinged to insulated cabinet 241 for selective access to the interior of the insulated cabinet through opening 243. Insulated door 242 can have a handle, not shown, to facilitate access to the combined satellite station/refrigeration appliance module 240. The central cooling unit, not shown, can be similar to the central cooling unit illustrated in FIG. 3. Central cooling unit 110, controller 150 and the central cooling system operation are described in detail above in connection with the embodiment of FIG. 3. Those skilled in the art will understand that more than one satellite station 212 can be provided and that one or more combined satellite station/refrigeration appliance modules 240 can be connected to central cooling unit 110 through quick connect fittings 145 to refrigerant lines that can be insulated supply conduits 142 and 144, and to controller 150 through control circuit 156 as illustrated in FIG. 6.

Combined satellite station/refrigeration appliance module 240 can have a satellite station evaporator 246, a variable speed evaporator fan 248 and an expansion device 138. Satellite station evaporator 246 and expansion device 138 can be connected to refrigerant lines that can be insulated supply conduit 142 and insulated return conduit 144 through quick connect fittings 145. Satellite evaporator 246 can be positioned in an evaporator compartment schematically indicated by dashed line 250. Refrigeration appliance module 214 can be located in proximity to combined satellite station/refrigeration appliance module 240 and can be connected to combined satellite station/refrigeration appliance module 240 by an insulated supply duct 216 and an insulated return duct 218. Refrigeration appliance module 214 is described above in detail and accordingly will not be described again in detail in connection with FIG. 8A. Refrigeration appliance module 214 can operate in the same manner as refrigeration appliance modules 214 as described in connection with FIG. 6.

Turning to schematic FIG. 8B, in another embodiment of the invention, a combined satellite station/refrigeration appliance module 252 can be combined with a refrigeration appliance module 244 similar to the combination described above with respect to FIG. 8A. Similar to the embodiment of FIG. 8A, a combined satellite station/refrigeration appliance module 252 can be used in a distributed refrigeration system having a central cooling unit 110, controller 150 and control circuit 156 as illustrated in FIG. 3 having plural satellite stations 212 and refrigeration appliance modules 214, 228. The central cooling unit 110, additional satellite stations 212 and refrigeration appliance modules have not been included in FIG. 8B to simplify the drawings. Combined satellite station/refrigeration appliance module 252 and refrigeration appliance module 244 can be free standing or built in modules and can be general purpose refrigerator, freezer or special purpose modules. Combined satellite station/refrigeration appliance module 252 can be located in a residential kitchen or other locations associated with a dwelling as desired. Combined satellite station/refrigeration appliance module 252 can have an insulated cabinet 253, an insulated door 254 that can be hinged to insulated cabinet 253 for selective access to the interior of the insulated cabinet through opening 255. Insulated door 254 can have a handle, not shown, to facilitate access to the combined satellite station/refrigeration appliance module 252. The central cooling unit, not shown, can be similar to the central cooling unit illustrated in FIG. 3. Operation of central cooling unit 110 and controller 150 are described in detail above in connection with the embodiment of FIG. 3. Those skilled in the art will understand that more than one satellite station 212 can be provided and that one or more combined satellite station/refrigeration appliance modules 252 can be connected to central cooling unit 110 through quick connect fittings 145 to refrigerant lines that can be insulated supply conduits 142 and 144, and to controller 150 through control circuit 156 as illustrated in FIG. 6.

Combined satellite station/refrigeration appliance module 252 can have a direct cooling satellite station evaporator 256 and an expansion device 138. Satellite station evaporator 256 and expansion device 138 can be connected through quick connect fittings 145 to refrigerant lines that can be insulated supply conduit 142 and insulated return conduit 144 and to controller 150 through control circuit 156. Satellite evaporator 256 can be positioned in an evaporator compartment if desired. Refrigeration appliance module 244 can be located in proximity to combined satellite station/refrigeration appliance module 252 and can be connected to combined satellite station/refrigeration appliance module 252 by an insulated supply duct 216 and an insulated return duct 218. Refrigeration appliance module 244 can have an insulated cabinet 262 that can have an insulated door 263 hinged to insulated cabinet 262 to selectively provide access to insulated cabinet 262 through opening 264. Refrigeration appliance module 244 can have a circulation fan 260 that can circulate and control the volume of chilled air flowing into refrigeration appliance module 244 from combined satellite station/refrigeration appliance module 252. Combined satellite station/refrigeration appliance module 252 and refrigeration appliance module 244 can have a temperature sensor 134 as described above, and can have a temperature selector 136, not shown, that can be combined with the respective cabinets or can be part of a central user interface as described above and can be connected to controller 150 to control the temperatures in the refrigerated compartments. Refrigeration appliance module 244 can otherwise operate in the same manner as refrigeration appliance modules 214 as described in connection with FIG. 6.

Figure 9:
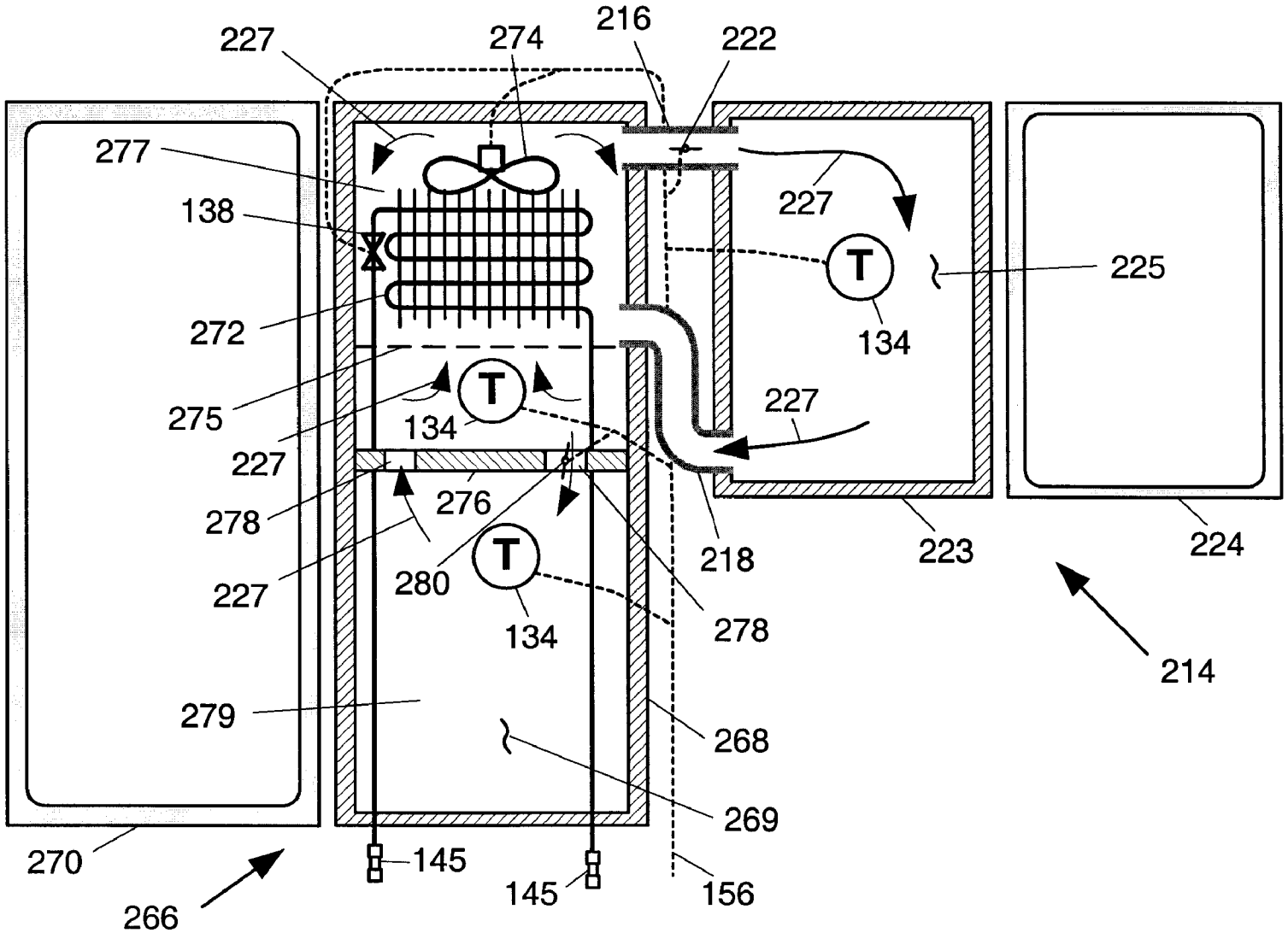
FIG. 9 is a partial schematic drawing illustrating another embodiment of refrigeration appliance modules that can be used in combination with the modular distributed refrigeration system illustrated in FIG. 6.

Turning to schematic FIG. 9, another embodiment of the invention, a satellite station can be combined with a two compartment refrigeration appliance module. In FIG. 9 a two compartment combined satellite station/refrigeration appliance module 266 and a refrigeration appliance module 214 are illustrated without a central cooling unit 110 or controller 150 and control circuit 156 to simplify the drawings. A combined satellite station/refrigeration appliance module 266 can be used in a distributed refrigeration appliance system having one or more refrigeration appliance modules 214, 228 or 244 located in proximity of one or more satellite stations 212, 240 or 252 to form a distributed refrigeration appliance system. Combined satellite station/refrigeration appliance module 266 and refrigeration appliance module 214 can be free standing or built in modules and can be general purpose refrigerator, freezer or special purpose modules. Combined satellite station/refrigeration appliance module 266 can be located in a residential kitchen or other locations associated with a dwelling as desired. Combined satellite station/refrigeration appliance module can have an insulated cabinet 268, an insulated door 270 that can be hinged to insulated cabinet 268 for selective access to the interior of the insulated cabinet through opening 269. Insulated door 270 can have a handle, not shown, to facilitate access to the combined satellite station/refrigeration appliance module 266. The central cooling unit, not shown, can be similar to the central cooling unit illustrated in FIG. 3. Operation of central cooling unit 110 and controller 150 are described in detail above in connection with the embodiment of FIG. 3. Those skilled in the art will understand that more than one satellite station 212, 240, 252 can be provided and that one or more combined satellite station/refrigeration appliance modules 266 can be connected to central cooling unit 110 through quick connect fittings 145 to refrigerant lines that can be insulated supply conduits 142 and 144, and to controller 150 control circuit 156 as illustrated in FIG. 6.

Combined satellite station/refrigeration appliance module 266 can have a satellite station evaporator 272, a variable speed evaporator fan 274 and an expansion device 138. Satellite station evaporator 272 and expansion device 138 can be connected to refrigerant lines that can be insulated supply conduit 142 and insulated return conduit 144. Satellite evaporator 272 can be positioned in an evaporator compartment schematically indicated by dashed line 275. Combined satellite station/refrigeration appliance module 266 can have a compartment separator 276 that can be arranged to separate insulated cabinet 268 into two compartments 277 and 279. Compartment 277 can include the evaporator compartment 275, and if a below freezing freezer compartment is desired, compartment 277 can be a freezer compartment since the evaporator compartment 275 is positioned in compartment 277. Passages 278 can allow air flow, indicated by air flow arrows 227, from compartment 277 and/or evaporator compartment 275 into compartment 279 and to return to evaporator compartment 275 when evaporator fan 274 is operated. Evaporator fan 274 can be a variable speed fan, or if desired, can be a single speed fan. An adjustable baffle 280 can be provided in combination with one of the passages 278 to control the air flow into compartment 279. Adjustable baffle 280 can be connected to control circuit 156 and can be operated by controller 150 (see FIG. 3), or can be manually adjustable by the user to control the temperature in compartment 279 in combination with expansion device 138 and satellite evaporator fan 274.

Refrigeration appliance module 214 can be located in proximity to combined satellite station/refrigeration appliance module 266 and can be connected to combined satellite station/refrigeration appliance module 266 by an insulated supply duct 216 and an insulated return duct 218. Refrigeration appliance module is described above in detail and accordingly will not be described in detail again in connection with FIG. 9. Combined satellite station/refrigeration appliance module 266 and refrigeration appliance module 214 can have a temperature sensor 134 as described above, and can have a temperature selector 136, not shown, that can be combined with the respective cabinets or can be part of a central user interface as described above. Refrigeration appliance module 214 can operate in the same manner as refrigeration appliance modules 214 as described in connection with FIG. 6.

Figure 10:
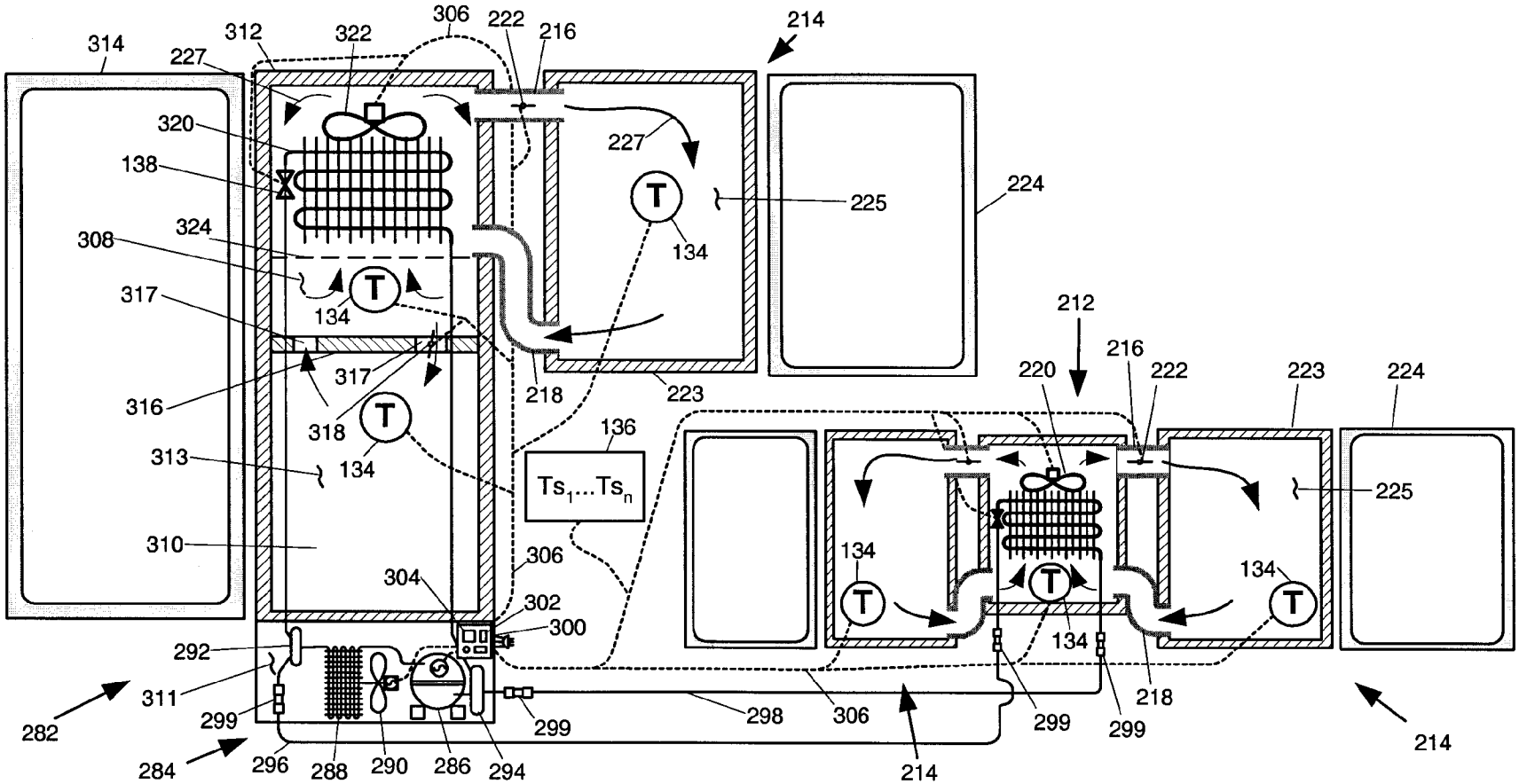
FIG. 10 is a schematic drawing illustrating another embodiment of a modular distributed refrigeration system incorporating satellite stations according to the invention.

Turning to schematic FIG. 10, in another embodiment of the invention, a satellite station can be combined with a refrigeration appliance module and a central cooling unit. In FIG. 10 a combined satellite station/refrigeration appliance module/central cooling unit 282, a satellite station 212 and three refrigeration appliance modules 214 are illustrated. A combined satellite station/refrigeration appliance module/central cooling station 282 can have more than one satellite station 212 and refrigeration appliance modules 214 or 228 located in proximity of the satellite stations 212 to form a distributed refrigeration appliance system. Combined satellite station/refrigeration appliance module/central cooling unit 282 and refrigeration appliance modules 214 can be free standing or built in modules and can be general purpose refrigerator, freezer or special purpose modules. Combined satellite station/refrigeration appliance module/central cooling unit 282 can be located in a residential kitchen or other locations associated with a dwelling as desired. Combined satellite station/refrigeration appliance module/central cooling unit 282 can have an insulated cabinet 312, an insulated door 314 that can be hinged to insulated cabinet 312 for selective access to the interior of the insulated cabinet through opening 313. While insulated door 314 is illustrated as a single door, those skilled in the art will understand that two doors can be provided, one for each of the compartments 308 and 310. Insulated door 314 can have a handle, not shown, to facilitate access to the combined satellite station/refrigeration appliance module 282. Insulated cabinet 312 can have a compartment separator 316 that can divide insulated cabinet 312 into two compartments 308 and 310.

Combined satellite station/refrigeration appliance module/central cooling unit 282 can have a satellite station evaporator 320, a variable speed evaporator fan 322 and an expansion device 138. Satellite station evaporator 322 and expansion device 138 can be connected to manifold 292 and accumulator 294 to form a refrigerant circuit. Satellite evaporator 320 can be positioned in an evaporator compartment schematically indicated by dashed line 324. Refrigeration appliance module 214 is described above in detail. Combined satellite station/refrigeration appliance module/central cooling unit 282 and refrigeration appliance module 214 can have a temperature sensors 134 as described above, and can have a temperature selector 136 that can be combined with the respective cabinets or can be part of a central user interface as described above. Refrigeration appliance module 214 can operate in the same manner as refrigeration appliance modules 214 as described in connection with FIG. 6. Compartment separator 316 can have passages 317 that can provide for air flow between compartment 308 and 310. One of the passages 317 can have an adjustable baffle 318 that can control the quantity of chilled air flowing from compartment 308 and/or evaporator compartment 324 into compartment 310.

The central cooling unit 284 can be similar to the central cooling unit illustrated in FIG. 3 but can be combined with the satellite evaporator and appliance storage module in a single cabinet or positioned adjacent the combined satellite station and refrigeration appliance module cabinet as desired. Central cooling unit 284 can include a variable speed compressor 286, a condenser 288 and a variable speed condenser fan 290. Central cooling unit 284 can also include a manifold 292 and an accumulator 294. Central cooling unit 284 can be connected to satellite station 212 through quick connect fittings 299 to refrigerant lines that can be an insulated supply conduit 296 and an insulated return conduit 298 forming a cooling medium circuit for conveying refrigerant from central cooling unit 284 through manifold 292 and insulated supply conduit 296 to satellite station 212 and returning refrigerant from satellite station 212 to accumulator 294 through insulated return conduits 298. Central cooling unit 284 can also include a microprocessor based controller 300 that can include a first portion 302 that can be arranged to control operation of the central cooling unit 284 and a second portion 304 than can be arranged to control the volume of refrigerant directed to the respective refrigerating modules similar to controller 50 in the embodiment of FIG. 1. A control circuit 306 can be provided to connect the temperature sensors 134, the temperature selectors 136, variable speed compressor 286, variable speed condenser fan 290, expansion devices 138 and evaporator fans 220 and 322. Central cooling unit 284 can operate similar to the central cooling units described in detail above in connection with FIG. 3 and FIG. 6. As described in detail above, controller 300 can be arranged to operate compartments 308 and 310 and refrigeration appliance modules 214 at selected temperatures as a user might select by setting appropriate temperature selectors 136.

Satellite station 212 and refrigeration appliance modules 214 can be similar to the satellite station 212 and refrigeration appliance modules illustrated and described in detail in connection with FIG. 6. Those skilled in the art will understand that more than one satellite station 212 can be provided and that one or more combined satellite station/refrigeration appliance modules 240 can be connected to central cooling unit 284 through quick connect fittings 299 to refrigerant lines that can be insulated supply conduits 142 and 144 and to controller 300 through control circuit 306 similar to the distributed refrigeration system illustrated in FIG. 6.

Figure 11:
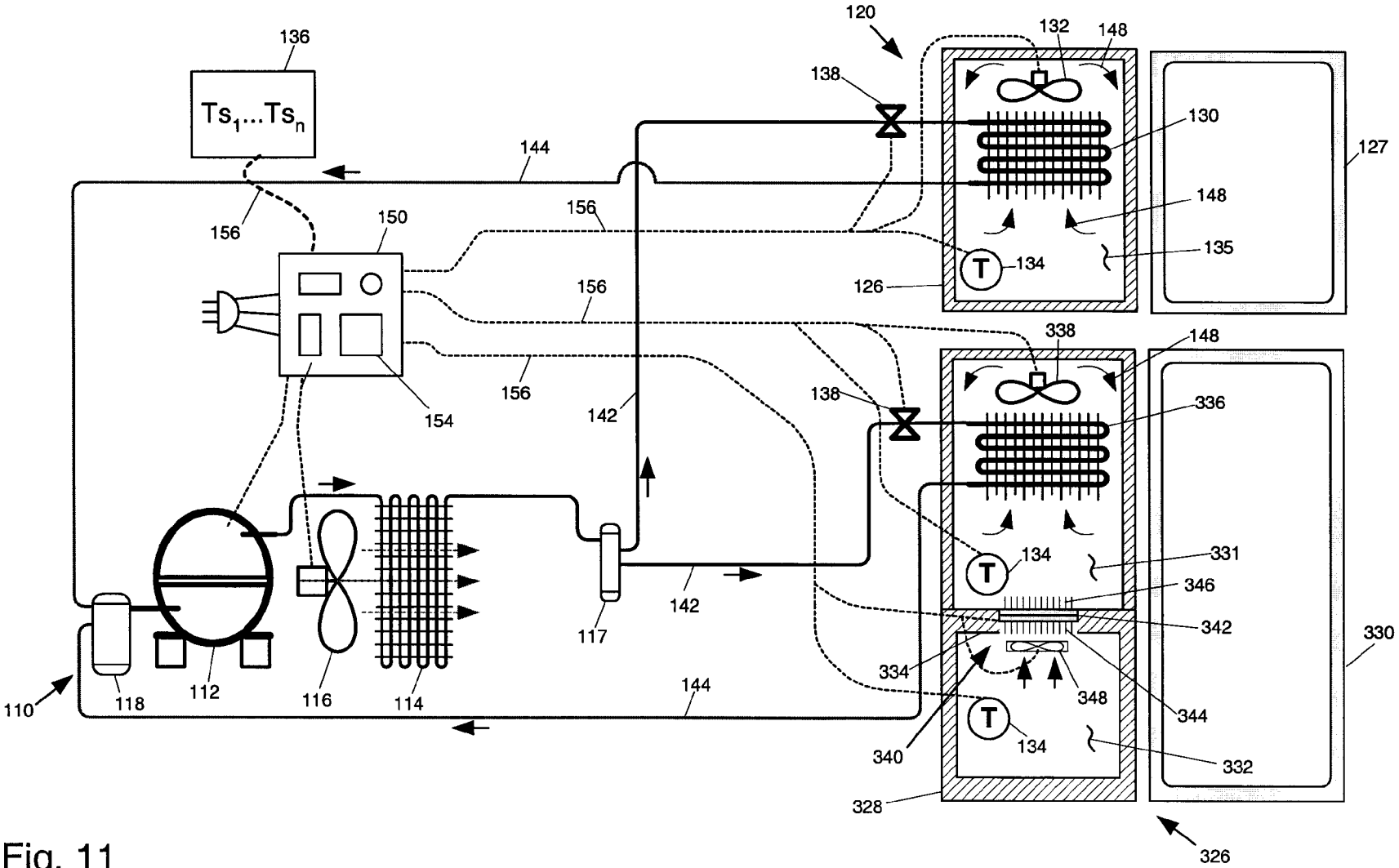
FIG. 11 is a schematic drawing illustrating another embodiment of a modular distributed refrigeration appliance system incorporating a cascade cooling system for a module according to the invention.

Turning to schematic FIG. 11, in another embodiment of the invention, a plurality of refrigerating modules 120 and 326 can be connected in a distributed refrigeration appliance system that can include a central cooling unit 110. Refrigerating modules 120 and 326 can be free standing or built-in modules and can be general purpose refrigerator, freezer or special purpose modules. Refrigerating modules 120 and 326 can be located in a residential kitchen or other locations associated with a dwelling as desired. The central cooling unit can be similar to central cooling unit 110 illustrated in FIG. 3, and accordingly, will use the same reference numerals as central cooling unit 110 illustrated in FIG. 3. Similarly, refrigerating module 120 can be similar to refrigerating module 120 illustrated in FIG. 3, and accordingly, will use the same reference numerals as refrigerating module 120 in FIG. 3. As noted above, central cooling unit 110 can be located in a location remote from a residential kitchen, or in or in proximity of the residential kitchen as desired as those skilled in the art will understand.

According to the invention, other refrigerating modules and/or satellite stations and refrigeration appliance modules as described above can be combined with central cooling unit 110 in addition to refrigerating modules 120 and 326 illustrated in FIG. 11. Refrigerating module 120 is described in detail above and accordingly will not be described in detail again in connection with FIG. 11. Similarly, central cooling unit 110 is described in detail above and accordingly will not be described in detail again in connection with FIG. 11. Refrigerating module 326 can have an insulated cabinet 328 and at least one insulated door 330 that can be hinged to insulated cabinet 328 to selectively open and close compartments 331 and 332 formed in insulated cabinet 328 by insulated compartment separator 334. Insulated door 330 can be provided with a suitable handle, not shown, to facilitate opening and closing insulated door 330. Those skilled in the art that two insulated doors can be provided to independently close compartments 331 and 332 if desired. Refrigerating module 326 can include a refrigerating module evaporator 336 and a refrigerating module evaporator fan 338. Refrigerating module evaporator fan 338 can be a single speed fan, or if desired, can be a variable speed fan. An expansion device 138 can control flow of refrigerant to refrigerating module 326. Expansion device 138 can be an expansion device with feedback arranged to control refrigerant flow though expansion device 138. Refrigerating module 326 can have a temperature sensor 134 and a temperature selector 136, as described above, for each compartment 331 and 332. Temperature sensors 134, temperature selectors 136 and expansion device 138 can be connected to controller 150 though control circuit 156 as described above in detail. Also as described above in detail temperature selectors 136 can be located in refrigerating modules 120 and 326 or can be part of a central user interface as is well known and described above. Refrigerating module evaporator 336 can be connected to refrigerant lines that can be insulated supply and return conduits 142 and 144 leading to central cooling unit 110.

Refrigerating module 326 can further employ a cascade cooling system to cool compartment 332. For example, compartment 332 can be operated as a below freezing freezer compartment and compartment 331 can be operated as an above freezing refrigerator compartment. In the event that refrigerating module 120 is also desired to operate as an above freezing refrigerator compartment, central cooling unit 110 can be operated to provide refrigerant cooled sufficiently to chill refrigerating module evaporators 130 and 336 to a temperature to produce above freezing temperatures in refrigeration module 120 and compartment 331 of refrigerating module 326. Operating central cooling unit 110 to produce only above freezing temperatures allows compressor 112 to operate at higher refrigerant evaporating pressures, lower refrigerant condensing pressures and can accordingly require less energy to operate central cooling unit 110. Thus, when a distributed refrigeration appliance system will have primarily above freezing refrigerator modules it can be energy and cost efficient to use cascade cooling to achieve the desired below freezing temperatures in compartments desired to operate at below freezing freezer temperatures.

The cascade cooling system can be a thermoelectric cooling system 340 as illustrated in refrigerating module 326. Alternate cascade cooling systems, described below, can be used in combination with refrigerating module 326 in lieu of thermoelectric cooling system 340. Thermoelectric cooling system 340 can be connected to controller 150 through control circuit 156. Thermoelectric cooling system 340 can be a well known thermoelectric device that can include a thermoelectric module 342 combined with heatsink enclosures 344 and 346 on opposite surfaces of the thermoelectric module 342. One heatsink enclosure 346 can be positioned in heat exchange communication with compartment 331 and the other heatsink enclosure 344 can be positioned in heat exchange communication with compartment 332. Thermoelectric cooler 340 can also have a circulating fan 348 for circulating air in compartment 332 over heatsink enclosure 344. While a circulating fan 348 is illustrated in compartment 332 those skilled in the art will understand that a circulating fan can be used in connection with both or neither of the heatsink enclosures 344 and 346 if desired. When a voltage is applied to thermoelectric module 342 one surface becomes cold absorbing heat from the heatsink enclosure in contact with the cold surface and the opposite surface becomes hot releasing heat to the heatsink enclosure in contact with the hot surface. Thus, when the proper polarity voltage is applied to thermoelectric module 342, heatsink enclosure 344 can become cold and circulating fan 348 can circulate air chilled by heatsink enclosure 344 through compartment 332. Meanwhile, heat released by heatsink enclosure 346 heats compartment 331 which heat can be absorbed by refrigerating module evaporator 336 and transferred to central cooling system 110. A properly sized thermoelectric cooler can easily reduce the temperature in compartment 332 by 20° C. relative to compartment 331, and can therefore cool compartment 332 to below freezing freezer temperatures compared to above freezing refrigerator temperatures in compartment 331. Thus, compartment 332 can be cooled based on the temperature selected for compartment 332 by the temperature selector 136 for compartment 332. If desired, thermoelectric module 342 can be energized with opposite polarity voltage to cause thermoelectric module to provide heat to compartment 332 withdrawing heat from compartment 331. Thus, operating thermoelectric module 342 can allow a user to use compartment 332 to warm the contents of compartment 332 such as to defrost frozen articles if desired. Controller 150 can be arranged to operate thermoelectric module 342 to heat compartment 332 when the temperature selector 136 for compartment 332 is set to a warming and/or defrosting setting. When thermoelectric module 342 is set to heat compartment 332 heat withdrawn form compartment 331 will cool compartment 331 and reduce the cooling load of compartment 331.

Figure 12:
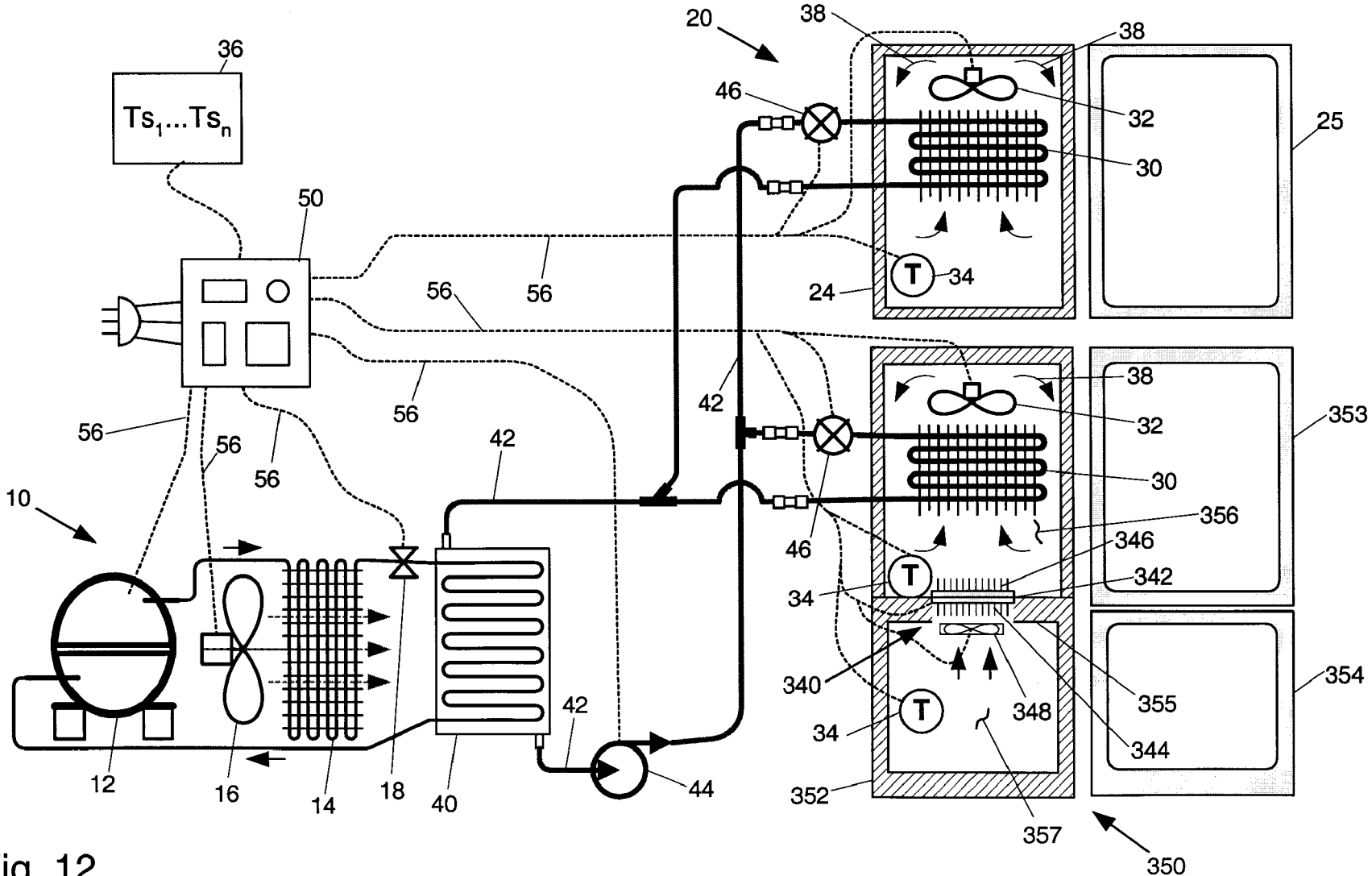
FIG. 12 is a schematic drawing illustrating another embodiment of a modular distributed refrigeration appliance system incorporating a cascade cooling system for a module according to the invention.

Turning to schematic FIG. 12, in another embodiment of the invention, a plurality of refrigerating modules 20 and 350 can be connected in a distributed refrigeration appliance system that can include a central cooling unit 10. Refrigerating modules 20 and 350 can be free standing or built-in modules and can be general purpose refrigerator, freezer or special purpose modules. Refrigerating modules 20 and 350 can be located in a residential kitchen or other locations associated with a dwelling as desired. The central cooling unit can be similar to central cooling unit 10 illustrated in FIG. 1, and accordingly, will use the same reference numerals as central cooling unit 10 illustrated in FIG. 1. Similarly, refrigerating module 20 can be similar to refrigerating module 20 illustrated in FIG. 1, and accordingly, will use the same reference numerals as refrigerating module 20 in FIG. 1. As noted above, central cooling unit 10 can be located in a location remote from a residential kitchen, or in or in proximity of the residential kitchen as desired as those skilled in the art will understand.

According to the invention, other refrigerating modules and/or satellite stations and refrigeration appliance modules as described above can be combined with central cooling unit 10 in addition to refrigerating modules 20 and 350 illustrated in FIG. 12. Refrigerating module 20 is described in detail above and accordingly will not be described in detail again in connection with FIG. 12. Similarly, central cooling unit 10 is described in detail above and accordingly will not be described in detail again in connection with FIG. 12. Refrigerating module 350 can include a cascade cooling system. Refrigerating module 350 can have an insulated cabinet 352 and insulated doors 353 and 354 that can be hinged to insulated cabinet 352 to selectively open and close compartments 356 and 357 formed in insulated cabinet 352 by insulated compartment separator 355. Insulated doors 353 and 354 can be provided with a suitable handle, not shown, to facilitate opening and closing insulated doors 353 and 354. Those skilled in the art that a single insulated door can be provided to close compartments 356 and 357 if desired. Refrigerating module 350 can include a heat exchanger 30 and a heat exchanger fan 32 similar to refrigerating module 20. Heat exchanger fan 32 can be a single speed fan, or if desired, can be a variable speed fan. A valve 46 can control flow of liquid coolant to refrigerating module 350. Valve 46 can be an on-off valve arranged to control flow of liquid coolant into though valve 46. Refrigerating module 350 can have temperature sensors 34 and temperature selectors 36 as described above for each compartment 356 and 357. Temperature sensors 34, temperature selectors 36 and valves 46 can be connected to controller 50 though control circuit 56 as described above in detail. Also as described above in detail temperature selectors 36 can be located in refrigerating modules 20 or 350 or can be part of a central user interface as is well known and described above. Refrigerating module heat exchanger 30 can be connected to insulated conduits 42 leading to central cooling unit 10 for supplying chilled liquid coolant to heat exchanger 30.

Refrigerating module 350 can further employ a cascade cooling system to cool compartment 357. For example, compartment 357 can be operated as a below freezing freezer compartment and compartment 356 can be operated as an above freezing refrigerator compartment. As described above, central cooling unit 10 can include a secondary loop evaporator 40 arranged to supply chilled liquid coolant to refrigerating modules. While a secondary loop refrigerating system can produce below freezing storage temperatures, such refrigerating systems operate more efficiently when arranged to provide above freezing storage temperatures. Accordingly, when a distributed refrigeration appliance system includes a secondary loop utilizing chilled liquid coolant it can be energy and cost efficient to use cascade cooling to achieve the desired below freezing temperatures in below freezing freezer compartments.

The cascade cooling system for refrigerating module 350 can be a thermoelectric cooling system 340 similar to the thermoelectric cooling system 340 illustrated in refrigerating module 326 in the embodiment of FIG. 11. Alternate cascade cooling systems described below can be used in combination with refrigerating module 350 in lieu of thermoelectric cooling system 340. Accordingly, thermoelectric cooling system 340 illustrated in FIG. 12 will employ the same reference numerals as in FIG. 11 and the operation of thermoelectric cooling system will not again be explained in detail in connection with FIG. 12. Chilled liquid coolant circulating through heat exchanger 30 in compartment 356 can carry heat released by heatsink enclosure 346 to central cooling unit 10. Thus, compartment 357 can be cooled independently of the temperature in compartment 356 based on the temperature selected for compartment 357 by the temperature selector 36 for compartment 356. Further, as described above, thermoelectric cooling system 340 can provide lower storage temperatures in compartment 357 than can be effectively achieved in compartment 356 relying on cooling provided by chilled liquid coolant.

Figure 13:
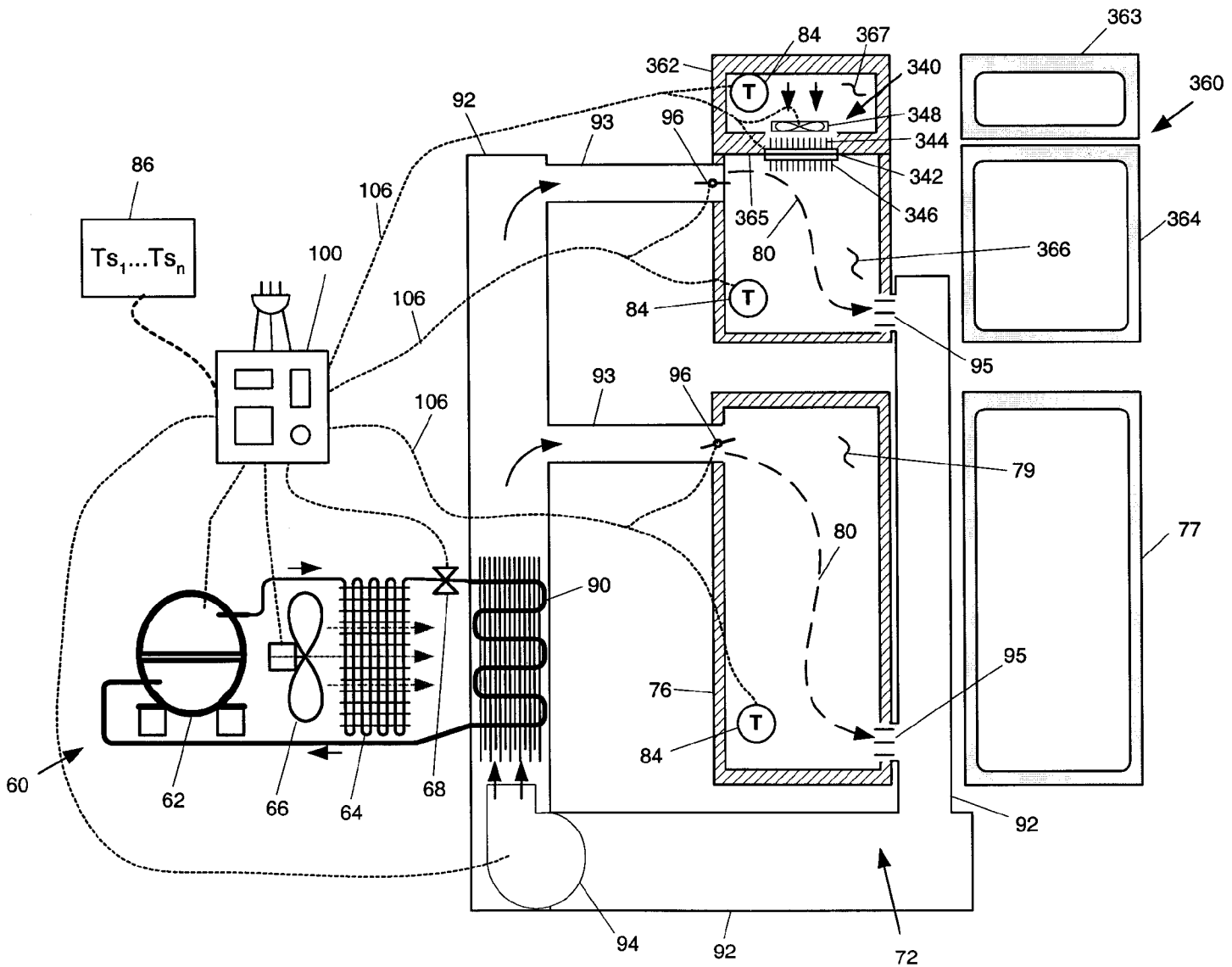
FIG. 13 is a schematic drawing illustrating another embodiment of a modular distributed refrigeration appliance system incorporating a cascade cooling system for a module according to the invention.

Turning to schematic FIG. 13, in another embodiment of the invention, a plurality of refrigerating modules 72 and 360 can be connected in a distributed refrigeration appliance system that can include a central cooling unit 60. Refrigerating modules 72 and 360 can be free standing or built-in modules and can be general purpose refrigerator, freezer or special purpose modules. Refrigerating modules 72 and 360 can be located in a residential kitchen or other locations associated with a dwelling as desired. The central cooling unit can be similar to central cooling unit 60 illustrated in FIG. 2, and accordingly, will use the same reference numerals as central cooling unit 60 illustrated in FIG. 2. Similarly, refrigerating module 72 can be similar to refrigerating module 72 illustrated in FIG. 2, and accordingly, will use the same reference numerals as refrigerating module 72 in FIG. 2. As noted above, central cooling unit 60 can be located in a location remote from a residential kitchen, or in or in proximity of the residential kitchen as desired as those skilled in the art will understand.

According to the invention, other refrigerating modules and/or satellite stations and refrigeration appliance modules as described above can be combined with central cooling unit 60 in addition to refrigerating modules 72 and 360 illustrated in FIG. 13. Refrigerating module 72 is described in detail above and accordingly will not be described in detail again in connection with FIG. 13. Similarly, central cooling unit 60 is described in detail above and accordingly will not be described in detail again in connection with FIG. 13. Refrigerating module 360 can include a cascade cooling system. Refrigerating module 360 can have an insulated cabinet 362 and insulated doors 363 and 364 that can be hinged to insulated cabinet 362 to selectively open and close compartments 366 and 367 formed in insulated cabinet 362 by insulated compartment separator 365. Insulated doors 363 and 364 can be provided with a suitable handle, not shown, to facilitate opening and closing insulated doors 363 and 364. Those skilled in the art that a single insulated door can be provided to close compartments 366 and 367 if desired. Refrigerating module 360 can include an air inlet 93 leading from insulated ducts 92 and an air outlet 95 similarly leading to insulated ducts 92 that are in communication with evaporator 90. Air inlets 93 and air outlets 95 form the apparatus for receiving the cooling medium, chilled air, in refrigerating modules 72 and 360 as described above in detail. A baffle 96 can control flow of chilled air into compartment 366 of refrigerating module 360. Baffle 96 can adjustable between open and closed to variably control flow of chilled air into compartment 366. Refrigerating module 360 can have temperature sensors 84 and temperature selectors 86 as described above for each compartment 366 and 367. Temperature sensors 84, temperature selectors 86 and baffle 96 can be connected to controller 100 though control circuit 106 as described above in detail. Also as described above in detail temperature selectors 86 can be located in refrigerating modules 72 or 360 or can be part of a central user interface as is well known and described above.

The cascade cooling system for refrigerating module 360 can be a thermoelectric cooling system 340 similar to the thermoelectric cooling system 340 illustrated in refrigerating module 326 in the embodiment of FIG. 11. Accordingly, the thermoelectric cooling system 340 illustrated in FIG. 13 will employ the same reference numerals as in FIG. 11 and the operation of thermoelectric cooling system 340 will not again be explained in detail in connection with FIG. 13. Chilled air flowing through compartment 366 can carry heat released by heatsink enclosure 346 to central cooling unit 60. Thus, compartment 367 can be cooled independently of the temperature in compartment 366 based on the temperature selected for compartment 367 by the temperature selector 86 for compartment 366. Further, as described above, thermoelectric cooling system 340 can provide lower storage temperatures in compartment 367 than can be efficiently achieved in compartment 366 relying on cooling provided by chilled air. While refrigerating module 360 illustrated in FIG. 13 does not include air passages through compartment separator 365 to allow chilled air to flow into compartment 367, those skilled in the art will understand that air passages and suitable baffles, all not shown, can be provided in compartment separator 365 to provide the possibility of selectively cooling compartment 367 utilizing chilled air or cooling via thermoelectric cooling system 340.

Figure 14:
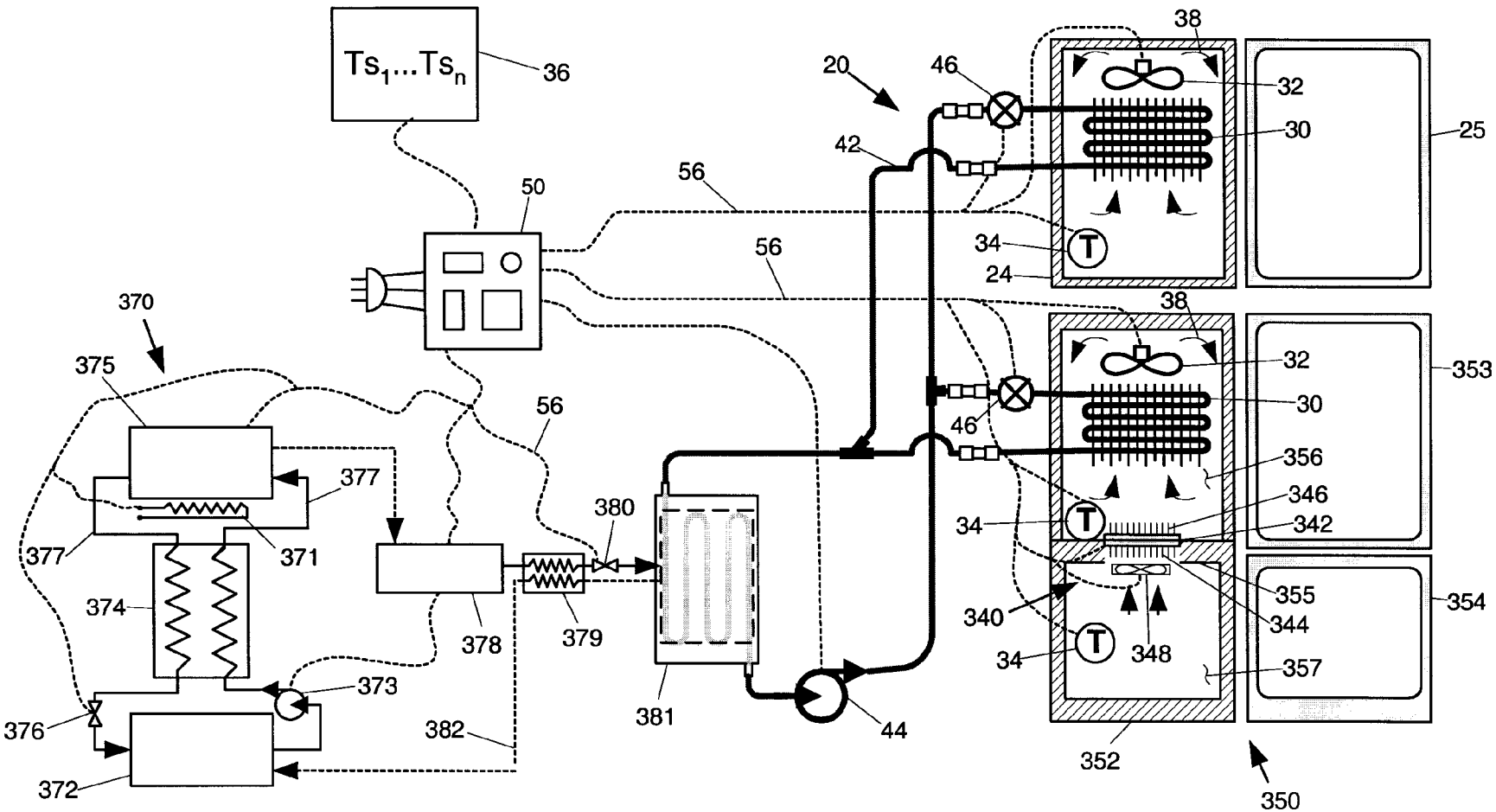
FIG. 14 is a schematic drawing illustrating another embodiment of a modular distributed refrigeration appliance system incorporating a cascade cooling system for a module according to the invention.

Turning to schematic FIG. 14, in another embodiment of the invention, a plurality of refrigerating modules 20 and 350 can be connected in a distributed refrigeration appliance system that can include a central cooling unit 370. Refrigerating modules 20 and 350 can be free standing or built-in modules and can be general purpose refrigerator, freezer or special purpose modules. Refrigerating modules 20 and 350 can be located in a residential kitchen or other locations associated with a dwelling as desired. Refrigerating modules 20 and 350 can be similar to refrigerating modules 20 and 350 illustrated in FIG. 12, and accordingly, will use the same reference numerals as refrigerating modules 20 and 350 in FIG. 12.

The refrigeration appliance system illustrated in schematic form in FIG. 14 also includes a central cooling unit 370 that can be an absorption refrigeration system as are well known in the art. The central cooling unit 370 illustrated in FIG. 14 can be a single effect absorption system that provides the same result as a vapor compression system such as central cooling units illustrated in FIGS. 1-3 with the compressor is replaced with a solution circuit that absorbs vapor at a low pressure and desorbs it at a higher pressure. Central cooling unit 370 can have a solution circuit that can include absorber 372, pump 373, solution heat exchanger 374, desorber 375 and liquid metering valve 376 connected by suitable solution circuit conduits 377. Central cooling unit 370 can also include an ammonia refrigerant circuit with condenser 378, precooler 379, expansion valve 380 and a chilled liquid evaporator 381 connected in series to the solution circuit absorber 372 and desorber 375 by suitable ammonia circuit conduits 382. Desorber 375 can have a heat source, shown as heating element 371, employed to provide heat to the desorber 375 to evaporate and separate the ammonia refrigerant from the water ammonia solution as the water is drained back to the absorber 372 through metering valve 376. Ammonia separated from the water ammonia solution in desorber 375 flows into condenser 378 and through expansion valve 380 into chilled liquid evaporator 381. While a heating element 371 is shown, those skilled in the art will understand that other heat sources that can include a gas burner or a solar heater can be used instead of heating element 371 to supply heat to desorber 375 to vaporize the ammonia from the ammonia water solution. Likewise, while central cooling unit 370 is illustrated as a single effect absorption system, those skilled in the art will understand that other absorption systems can be used as central cooling unit if desired.

In operation, central cooling unit 370 chills liquid coolant in chilled liquid evaporator 381. As noted above, chilled liquid evaporator 381 can be a shell and tube evaporator. Similar to central cooling unit 10 illustrated in FIG. 1 and FIG. 12 variable speed pump 44 can circulate the chilled liquid coolant to refrigerating modules 20 and 350 as described above in detail. Central cooling unit 370 can also have a controller 50, control circuit 56 and temperature selectors 36 similar to central cooling unit 10 described above in detail. Since the operation of the refrigeration appliance system, other than the central cooling unit 370, is similar to the operation of the refrigeration appliance system described in connection with FIG. 12, the description of the operation of the system will not be repeated in connection with FIG. 14. As described in connection with FIG. 12, a cascade cooling system can facilitate providing compartments operating at below freezing temperatures in a distributed refrigeration appliance system having an absorption refrigeration system central cooling unit having a chilled liquid evaporator chilling liquid coolant in a secondary loop supplying refrigerating modules.

Figure 15:
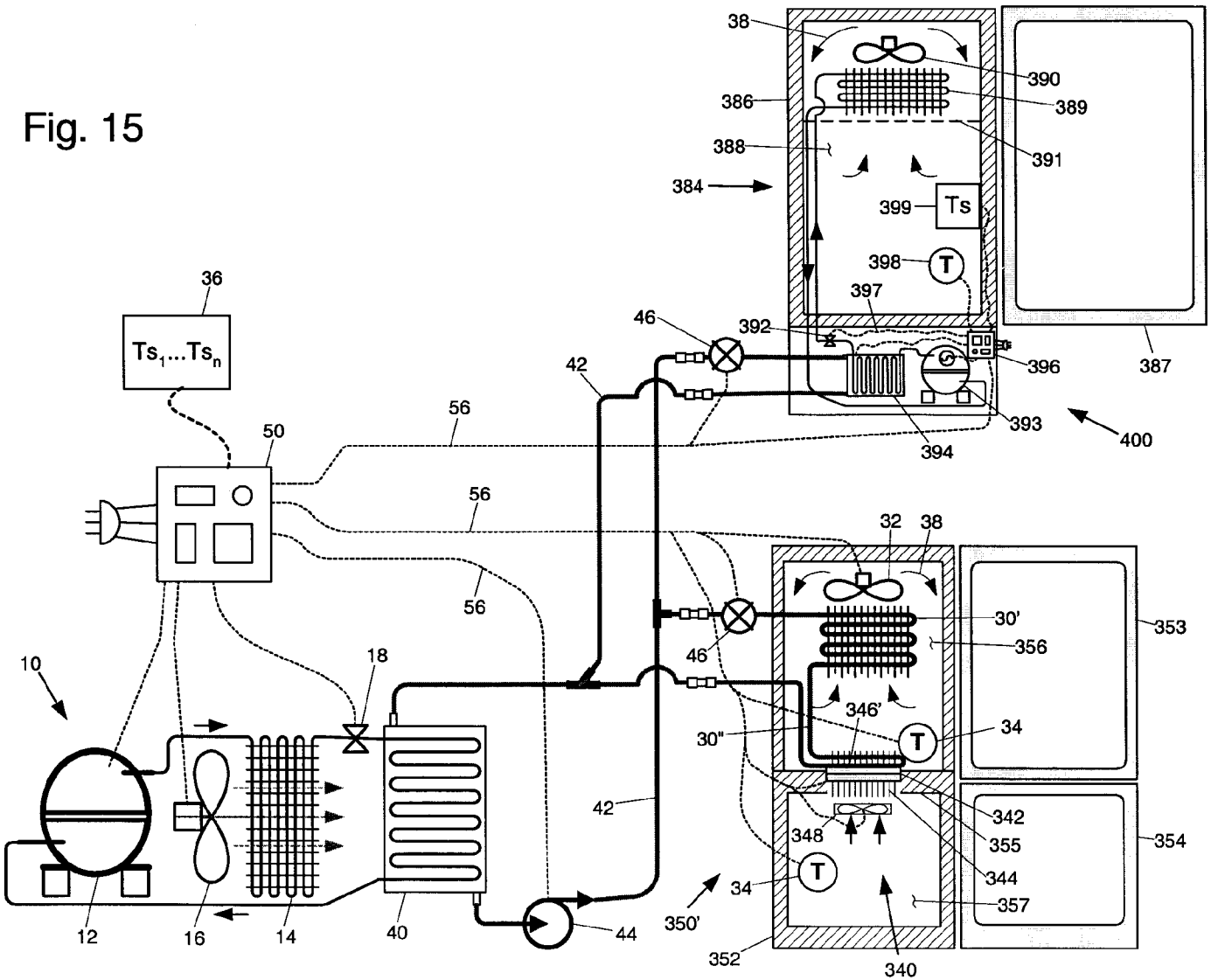
FIG. 15 is a schematic drawing illustrating a modular distributed refrigeration appliance system incorporating another embodiment of a cascade cooling system for a module according to the invention.

Turning to schematic FIG. 15, in another embodiment of the invention, a refrigerating module 350' and a freestanding refrigeration appliance 384 can be connected in a distributed refrigeration appliance system that can include a central cooling unit 10. Refrigerating module 350' and refrigeration appliance 384 can be a free standing or built-in and can be general purpose refrigerator, freezer or special purpose modules. Refrigerating module 350' and refrigeration appliance 384 can be located in a residential kitchen or other locations associated with a dwelling as desired. The central cooling unit can be similar to central cooling unit 10 illustrated in FIG. 1, and accordingly, will use the same reference numerals as central cooling unit 10 illustrated in FIG. 1. Similarly, refrigerating module 350' can be similar to refrigerating module 350 illustrated in FIG. 12, and accordingly, will use the same reference numerals as refrigerating module 350 in FIG. 12 except for a modified heat exchanger and cascade cooling system that will be described below. As noted above, central cooling unit 10 can be located in a location remote from a residential kitchen, or in or in proximity of the residential kitchen as desired as those skilled in the art will understand.

Figure 17A:
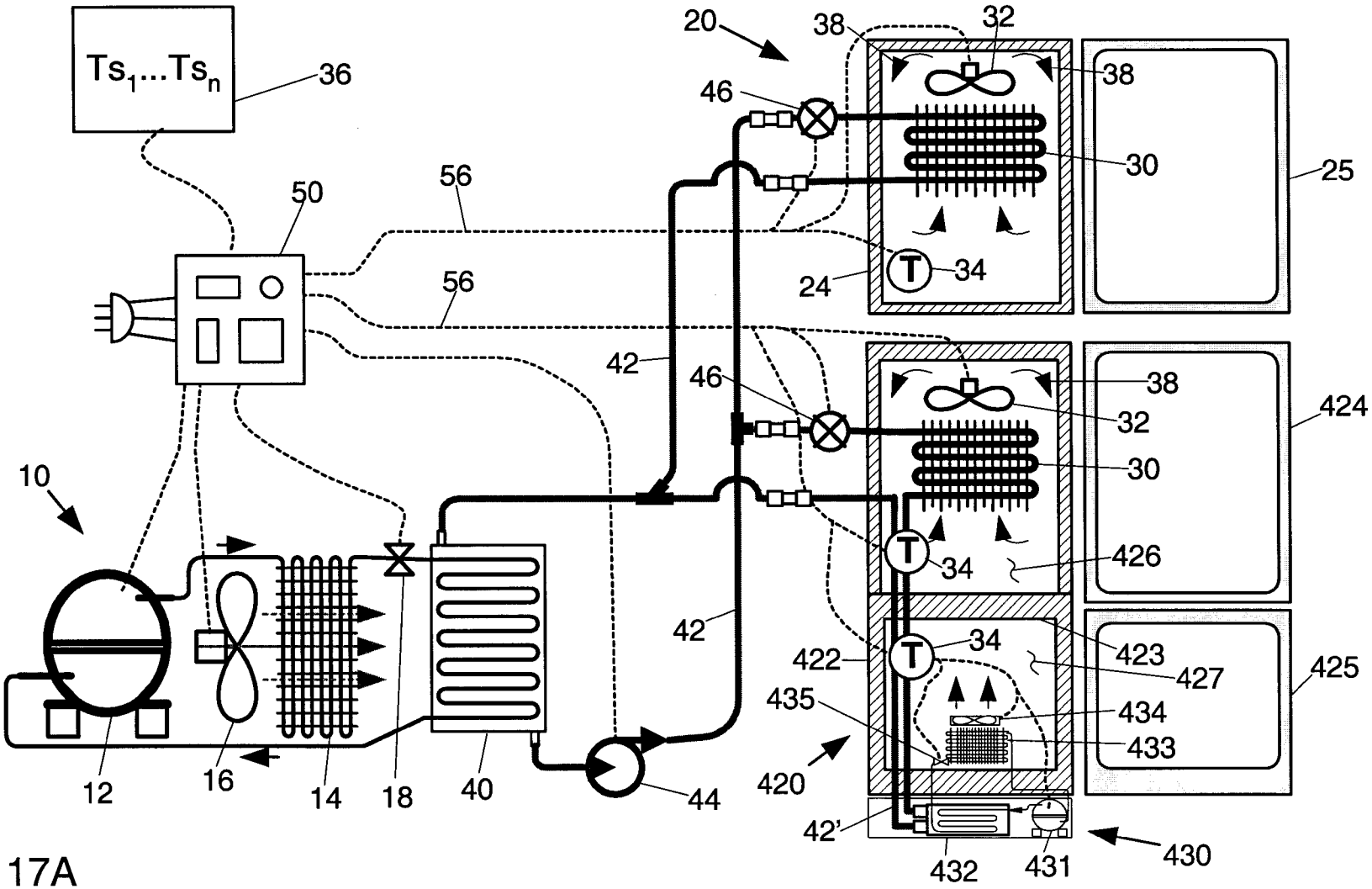
FIG. 17A is a schematic drawing illustrating a modular distributed refrigeration appliance system similar to the embodiment illustrated in FIG. 12 incorporating another embodiment of a cascade cooling according to the invention.
Figure 17B:
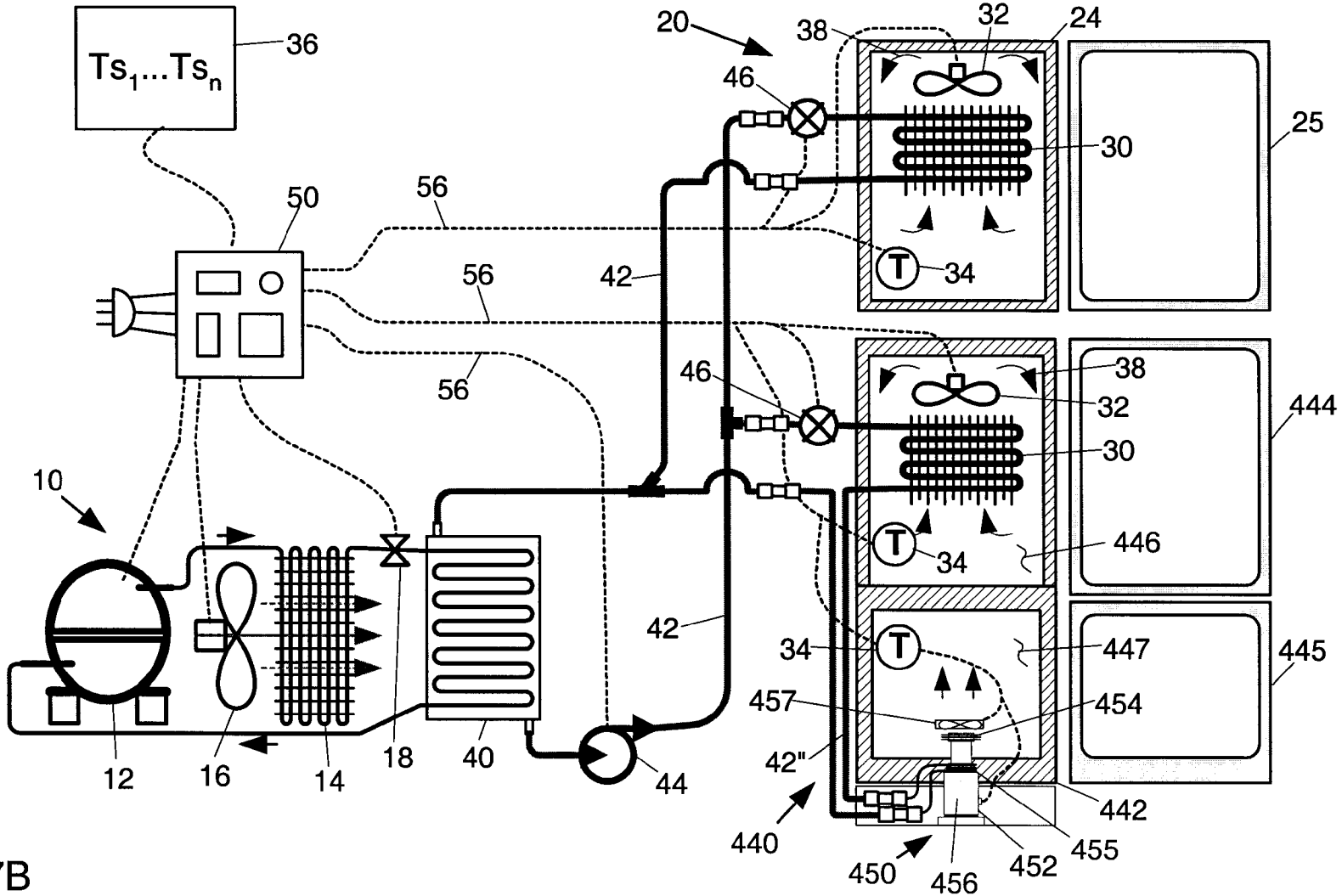
FIG. 17B is a schematic drawing illustrating a modular distributed refrigeration appliance system similar to the embodiment illustrated in FIG. 12 incorporating another embodiment of a cascade cooling according to the invention.

According to the invention, other refrigerating modules and/or satellite stations and refrigeration appliance modules as described above can be combined with central cooling unit 10 in addition to refrigerating module 350' and refrigeration appliance 384 illustrated in FIG. 15. Central cooling unit 10 is described in detail above and accordingly will not be described in detail again in connection with FIG. 15. Refrigerating appliance 384 can include a cascade cooling system. Refrigerating appliance 384 can have an insulated cabinet 386 and an insulated door 387 can be hinged to insulated cabinet 386 to selectively close and open opening 388 in insulated cabinet 386. Insulated door 387 can be provided with a suitable handle, not shown, to facilitate opening and closing insulated door 387. Refrigerating appliance 384 can include an evaporator 389 and an evaporator fan 390. Evaporator fan 390 can be a single speed fan, or if desired, can be a variable speed fan. An expansion device 392 can control flow of refrigerant to evaporator 389. Expansion device 392 can be an expansion device with feedback similar to expansion devices 138 in the embodiment of FIG. 3. Refrigeration appliance 384 can have a temperature sensor 398 and a temperature selector 399. Temperature sensor 398, temperature selector 399 and expansion device 392 can be connected to controller 396 though control circuit 397. Controller 396 can be similar to controller 50 described above in detail, and can have a first portion and a second portion similar to controller 50. Refrigeration appliance 384 can have a cascade cooling unit 400 arranged to supply refrigerant to evaporator 389. Cascade cooling unit 400 can include a compressor 393 and a liquid cooled condenser 394. Liquid cooled condenser 394 can be connected to central cooling unit 10 through valve 46 and insulated conduits 42. Cascade cooling unit 400 can be connected to the central cooling unit 10 that can provide a low temperature heat sink for cascade cooling unit 400 enabling it to run at a much higher capacity than if it rejected heat to the ambient air. Controller 396 can control operation of refrigeration appliance 384 as is well known in the art and can include a connection to controller 50 for the central cooling unit 10. Refrigeration appliance 384 can efficiently provide cooling temperatures much colder than can be practically achieved utilizing chilled liquid coolant supplied by central cooling unit 10 since the vapor compression cascade cooling unit 400 can efficiently provide below 0° C. temperatures. While a vapor compression cascade cooling unit 400 is illustrated in the embodiment of FIG. 15, those skilled in the art will understand that a thermoelectric cooling unit or Stirling cycle cooling unit as illustrated in FIGS. 17A and 17B below can be employed as desired.

As noted above, refrigerating module 350' can be similar to refrigerating module 350 in the embodiment of FIG. 12 with the exception of the heat exchanger and linkage of thermoelectric cooling system 340 to the central cooling system 10. Heat exchanger 30' in refrigerating module 350' can include a leg 30" that can extend to and contact heatsink enclosure 346' to absorb heat rejected by heatsink enclosure 346' rather than having heatsink enclosure 346' reject heat into compartment 356 as can be the case in the embodiment of FIG. 12. Other than the modifications in heat exchanger 30' and heatsink enclosure 346', refrigerating module 350' is similar in operation to the operation of refrigerating module 350 as described above in detail in connection with FIG. 12 and will not be repeated in connection with FIG. 15.

Figure 16:
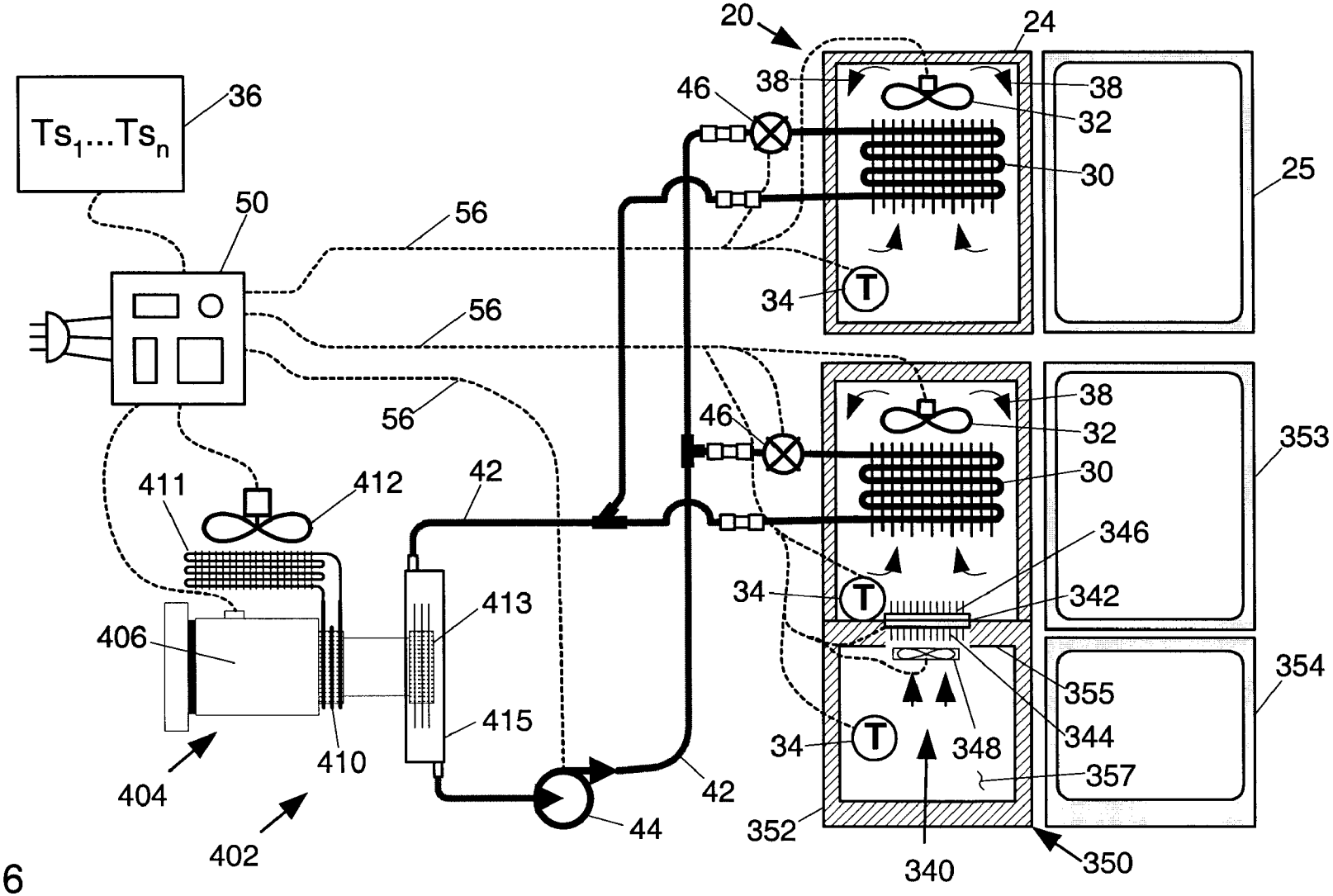
FIG. 16 is a schematic drawing illustrating another embodiment of a modular distributed refrigeration appliance system incorporating a cascade cooling system for a module according to the invention.

Turning to schematic FIG. 16, in another embodiment of the invention, a plurality of refrigerating modules 20 and 350 can be connected in a distributed refrigeration appliance system that can include a central cooling unit 402. Refrigerating modules 20 and 350 can be free standing or built-in modules and can be general purpose refrigerator, freezer or special purpose modules. Refrigerating modules 20 and 350 can be located in a residential kitchen or other locations associated with a dwelling as desired. Refrigerating modules 20 and 350 can be similar to refrigerating modules 20 and 350 illustrated in FIG. 12, and accordingly, will use the same reference numerals as refrigerating modules 20 and 350 in FIG. 12. Central cooling unit 402 can be located in a location remote from a residential kitchen, or in or in proximity of the residential kitchen as desired as those skilled in the art will understand.

According to the invention, other refrigerating modules and/or satellite stations and refrigeration appliance modules as described above can be combined with central cooling unit 402 in addition to refrigerating modules 20 and 350 illustrated in FIG. 16. Refrigerating modules 20 and 350 are described in detail above and accordingly will not be described in detail again in connection with FIG. 16. Central cooling unit 402 can be a Stirling cycle refrigerating unit that can include a Stirling cycle cooler 404 that can have a hot end 410 and a cold end 413 as is well known in the art. Stirling cycle cooler 404 can have a linear engine 406 and can have a hot end heat exchanger 411 and fan 412 to reject heat from the hot end 410. Cold end 413 can be associated with a chilled liquid cooler 415 that can be arranged to transfer heat from chilled liquid in the chilled liquid circuit to the cold end 413. As in the secondary loop systems described above, central cooling unit 402 can have a pump 44 to circulate chilled liquid in insulated conduits 42. Stirling cycle cooler 404, fan 412 and pump 44 can be connected to controller 50 through control circuit 56. To provide cooling, Stirling cycle cooler 404, fan 412 and pump 44 can be activated by controller 50 causing Stirling cycle cooler 404 to cause cold end 413 to become cold absorbing heat in chilled liquid cooler 415 from the chilled liquid circulated by pump 44 and reject the heat at hot end 410 to heat exchanger 411, all as well known in the art. Thus, as illustrated in FIGS. 12, 13, 14 and 16, a variety of central cooling units can used in combination with one or more refrigerating modules including a cascade cooling arrangement. Central cooling units can be a vapor compression refrigeration system, a vapor compression refrigeration system with a chilled liquid secondary loop, an absorption system or Stirling cycle cooler with a chilled liquid secondary loop and can be a vapor compression refrigeration system, an absorption system or Stirling cycle cooler arranged to chill air for circulation to refrigerating modules having a cascade cooling arrangement.

Turning to schematic FIG. 17A, in another embodiment of the invention, a plurality of refrigerating modules 20 and 420 can be connected in a distributed refrigeration appliance system that can include a central cooling unit 10. Refrigerating modules 20 and 420 can be free standing or built-in modules and can be general purpose refrigerator, freezer or special purpose modules. Refrigerating modules 20 and 420 can be located in a residential kitchen or other locations associated with a dwelling as desired. The central cooling unit can be similar to central cooling unit 10 illustrated in FIG. 1, and accordingly, will use the same reference numerals as central cooling unit 10 illustrated in FIG. 1. Similarly, refrigerating module 20 can be similar to refrigerating module 20 illustrated in FIG. 12, and accordingly, will use the same reference numerals as refrigerating module 20 in FIG. 12. As noted above, central cooling unit 10 can be located in a location remote from a residential kitchen, or in or in proximity of the residential kitchen as desired as those skilled in the art will understand.

According to the invention, other refrigerating modules and/or satellite stations and refrigeration appliance modules as described above can be combined with central cooling unit 10 in addition to refrigerating modules 20 and 420 illustrated in FIG. 17A. Refrigerating module 20 is described in detail above and accordingly will not be described in detail again in connection with FIG. 17A. Similarly, central cooling unit 10 is described in detail above and accordingly will not be described in detail again in connection with FIG. 17A. Refrigerating module 420 can include a cascade cooling system. Refrigerating module 420 can have an insulated cabinet 422 and insulated doors 424 and 425 that can be hinged to insulated cabinet 422 to selectively open and close compartments 426 and 427 formed in insulated cabinet 422 by insulated compartment separator 423. Insulated doors 424 and 425 can be provided with a suitable handle, not shown, to facilitate opening and closing insulated doors 424 and 425. Those skilled in the art that a single insulated door can be provided to close compartments 426 and 427 if desired. Refrigerating module 420 can include a heat exchanger 30 and a heat exchanger fan 32 similar to refrigerating module 20. Heat exchanger fan 32 can be a single speed fan, or if desired, can be a variable speed fan. A valve 46 can control flow of liquid coolant to refrigerating module 420. Valve 46 can be an on-off valve arranged to control flow of liquid coolant into though valve 46. Refrigerating module 420 can have temperature sensors 34 and temperature selectors 36, described above, for each compartment 426 and 427. Temperature sensors 34, temperature selectors 36 and valves 46 can be connected to controller 50 though control circuit 56 as described above in detail. Also as described above in detail temperature selectors 36 can be located in refrigerating modules 20 or 420 or can be part of a central user interface as is well known and described above. Refrigerating module heat exchanger 30 can be connected to insulated conduits 42 leading to central cooling unit 10 for supplying chilled liquid coolant to heat exchanger 30.

The cascade cooling system for refrigerating module 420 can be a vapor compression cascade cooling unit 430 that can be located in the base of insulated cabinet 422. Cascade cooling unit 430 can include a compressor 431, liquid cooled condenser 432, evaporator 433, evaporator fan 434 and expansion device 435 connected in a refrigerant circuit as is well known in the art. A loop 42' can convey chilled liquid coolant exiting evaporator 30 to liquid cooled condenser 432 to provide a low temperature heatsink for cascade cooling system 430 allowing cascade cooling system 430 to run at a much higher capacity than a similar system having an ambient air cooled condenser. Thus, compartment 427 can be cooled independently of the temperature in compartment 426 based on the temperature selected for compartment 427 by the temperature selector 36 for compartment 427. Further, as described above, vapor compression cascade cooling system 430 can efficiently provide much lower storage temperatures in compartment 427 than can be achieved in compartment 426 relying on cooling provided by chilled liquid coolant.

Turning to schematic FIG. 17B, in another embodiment of the invention, a plurality of refrigerating modules 20 and 440 can be connected in a distributed refrigeration appliance system that can include a central cooling unit 10. Refrigerating modules 20 and 440 can be free standing or built-in modules and can be general purpose refrigerator, freezer or special purpose modules. Refrigerating modules 20 and 440 can be located in a residential kitchen or other locations associated with a dwelling as desired. The central cooling unit can be similar to central cooling unit 10 illustrated in FIG. 1, and accordingly, will use the same reference numerals as central cooling unit 10 illustrated in FIG. 1. Similarly, refrigerating module 20 can be similar to refrigerating module 20 illustrated in FIG. 12, and accordingly, will use the same reference numerals as refrigerating module 20 in FIG. 12. As noted above, central cooling unit 10 can be located in a location remote from a residential kitchen, or in or in proximity of the residential kitchen as desired as those skilled in the art will understand.

According to the invention, other refrigerating modules and/or satellite stations and refrigeration appliance modules as described above can be combined with central cooling unit 10 in addition to refrigerating modules 20 and 440 illustrated in FIG. 17B. Refrigerating module 20 is described in detail above and accordingly will not be described in detail again in connection with FIG. 17B. Similarly, central cooling unit 10 is described in detail above and accordingly will not be described in detail again in connection with FIG. 17B. Refrigerating module 440 can include a cascade cooling system. Refrigerating module 440 can have an insulated cabinet 442 and insulated doors 444 and 445 that can be hinged to insulated cabinet 442 to selectively open and close compartments 446 and 447 formed in insulated cabinet 442 by insulated compartment separator 443. Insulated doors 444 and 445 can be provided with a suitable handle, not shown, to facilitate opening and closing insulated doors 444 and 445. Those skilled in the art that a single insulated door can be provided to close compartments 446 and 447 if desired. Refrigerating module 440 can include a heat exchanger 30 and a heat exchanger fan 32 similar to refrigerating module 20 that can be arranged to cool compartment 446. Heat exchanger fan 32 can be a single speed fan, or if desired, can be a variable speed fan. A valve 46 can control flow of liquid coolant to refrigerating module 440. Valve 46 can be an on-off valve arranged to control flow of liquid coolant into though valve 46. Refrigerating module 440 can have temperature sensors 34 and temperature selectors 36 as described above for each compartment 446 and 447. Temperature sensors 34, temperature selectors 36 and valves 46 can be connected to controller 50 though control circuit 56 as described above in detail. Also as described above in detail temperature selectors 36 can be located in refrigerating modules 20 or 440 or can be part of a central user interface as is well known and described above. Refrigerating module heat exchanger 30 can be connected to insulated conduits 42 leading to central cooling unit 10 for supplying chilled liquid coolant to heat exchanger 30.

Refrigerating module 440 can have a cascade cooling unit 450 that can be located in the base of insulated cabinet 442. Cascade cooling unit 450 can be a Stirling cycle cooler 452. Stirling cycle coolers are well known in the art and typically include a hot end 455, a cold end 454 and a linear motor 456. Cascade cooling unit 450 can also include a circulating fan 457 arranged to circulate air in compartment 447 over cold end 454 to cool compartment 457. Circulating fan 457 and Stirling cycle cooler 452 can be connected to controller 50 through control circuit 56. A loop 42" can convey chilled liquid coolant exiting evaporator 30 to hot end 455 to remove heat from the Stirling cycle cooler allowing cascade cooling system 450 to efficiently cool compartment 447. Thus, compartment 447 can be cooled independently of the temperature in compartment 446 based on the temperature selected for compartment 447 by the temperature selector 36 for compartment 447. Further, as described above, Stirling cycle cascade cooling system 450 can efficiently provide much lower storage temperatures in compartment 447 than can be achieved in compartment 446 relying of cooling provided by chilled liquid coolant.

The alternate cascade cooling units described above in connection with FIGS. 17A and 17B can be used in any of the thermoelectric cascade cooling embodiments disclosed in FIGS. 11, 12, 13, 14 and 16 in lieu of the thermoelectric cooling unit disclosed if desired.

Figure 18:
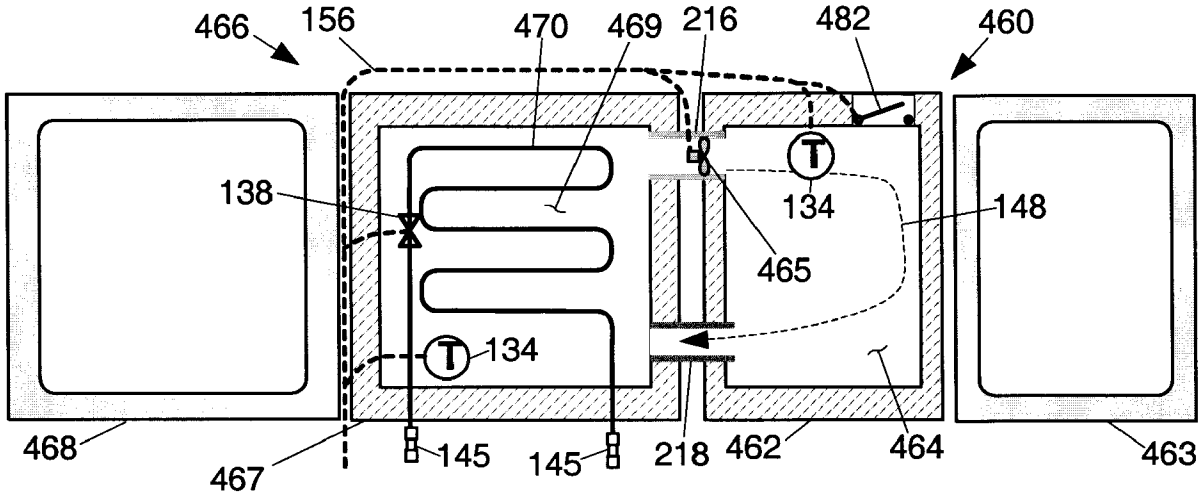
FIG. 18 is a partial schematic drawing illustrating refrigeration/storage modules that can be used in a modular distributed refrigeration system such as illustrated in FIGS. 3 and 6.
Figure 19:
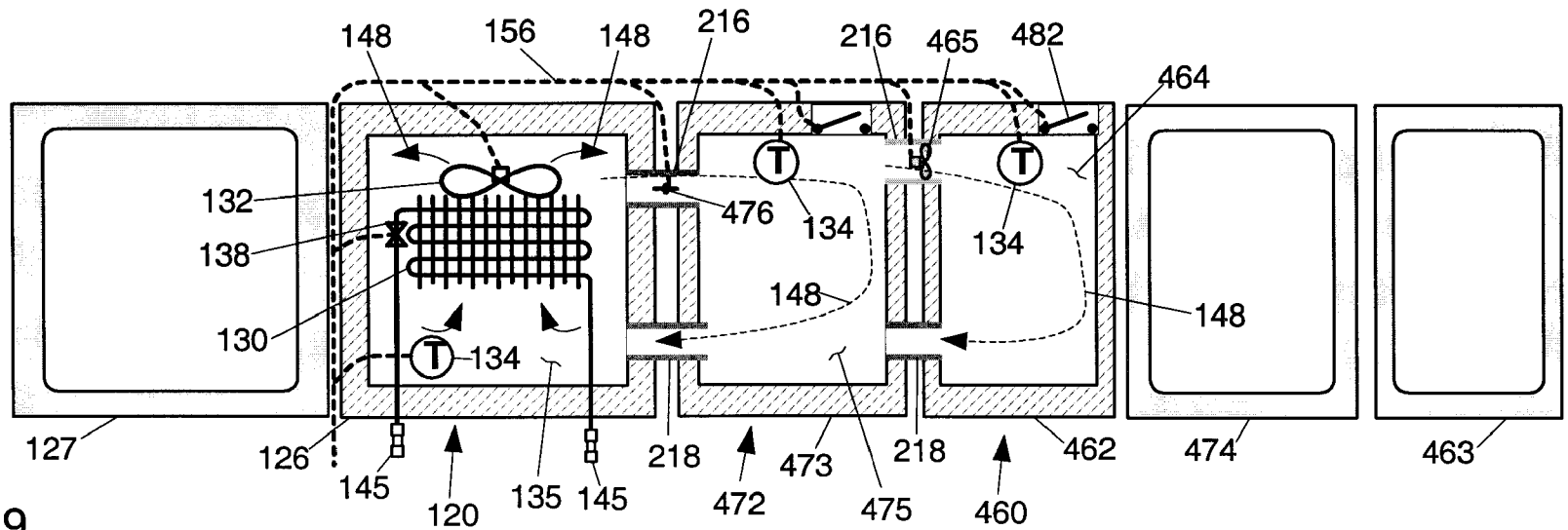
FIG. 19 is a partial schematic drawing illustrating another embodiment of refrigeration/storage modules that can be used in a modular distributed refrigeration system such as illustrated in FIGS. 3 and 6.

Turning to schematic FIGS. 18 and 19, in another embodiment of the invention, refrigerating modules 120 and 466 can be combined with refrigeration/storage modules 460 and 472 in a distributed refrigeration appliance system that can include a central cooling unit 110 as illustrated in FIGS. 3 and 6. Refrigerating modules 120 and 466 can be free standing or built-in modules and can be general purpose refrigerator, freezer or special purpose modules and can be located in a residential kitchen or other locations associated with a dwelling as desired. Refrigerating module 120 can be similar to refrigerating module 120 illustrated in FIG. 3, and accordingly, will use the same reference numerals as refrigerating module 120 in FIG. 3. Alternately, refrigerating module could also be similar to combined satellite station 240 illustrated in FIG. 8A. The central cooling unit 110, additional satellite stations 212 and other refrigeration appliance modules have not been included in FIGS. 18 and 19 to simplify the drawings. Insulated supply conduits 142 and insulated return conduits 144 (see FIGS. 3 and 6) can be connected to quick connect fittings 145 to provide a refrigerant circuit to evaporators 130 and 470 in refrigerating modules 120 and 466 from a central cooling unit 110 (see FIGS. 3 and 6). As noted above, central cooling unit 110 can be located in a location remote from a residential kitchen, or in or in proximity of the residential kitchen as desired as those skilled in the art will understand.

Refrigerating module 466 can have an insulated cabinet 467 and an insulated door 468 that can be hinged to insulated cabinet 467 for selective access to compartment 469 defined by insulated cabinet 467. Insulated door 468 can have a handle, not shown, to facilitate access to the refrigerating appliance module 466. The central cooling unit, not shown, can be similar to central cooling unit 110 illustrated in FIGS. 3 and 6. Operation of central cooling unit 110 and controller 150 are described in detail above in connection with the embodiment of FIGS. 3 and 6 and accordingly will not be described in detail again in connection with FIGS. 18 and 19. Those skilled in the art will understand that more than one refrigerating module can be provided and that one or more combined satellite station/refrigeration appliance modules can be connected to central cooling unit 110 through quick connect fittings 145 to refrigerant lines that can be insulated supply conduits 142 and 144, and to controller 150 through control circuit 156 as illustrated in FIG. 6.

Refrigerating module 466 can have a direct cooling satellite station evaporator 470 and an expansion device 138. Evaporator 470 and expansion device 138 can be connected through quick connect fittings 145 to refrigerant lines that can be insulated supply conduit 142 and insulated return conduit 144 and to controller 150 through control circuit 156 (see FIGS. 3 and 6). Evaporator 470 can be positioned in compartment 469 that those skilled in the art can include an evaporator compartment if desired. Refrigeration/storage module 460 can be located in proximity to refrigerating module 466 and can be connected to refrigerating module 466 by an insulated supply duct 216 and an insulated return duct 218. Refrigeration/storage module 460 can have an insulated cabinet 462 that can have an insulated door 463 hinged to insulated cabinet 462 to selectively provide access to compartment 464. Refrigeration/storage module 460 can have a circulation fan 465 that can be positioned in insulated supply duct 216 and that can circulate and control the volume of chilled air flowing into refrigeration/storage module 460 from refrigerating module 466. Refrigerating module 466 and refrigeration/storage module 460 can have temperature sensors 134 as described above, and can have temperature selectors 136, not shown, that can be combined with the respective cabinets or can be part of a central user interface as described above. Temperature sensors 134 and temperature selectors 136 can be connected to controller 150 (FIGS. 3 and 6) through control circuit 156. Refrigeration/storage module 460 can selectively be operated as a refrigerated storage space when circulating fan 465 is operated by controller 150 (FIGS. 3 and 6). Alternately, circulating fan 465 can be de-activated and refrigeration/storage module 460 can be allowed to remain at the ambient temperature of the location in the dwelling in which it is positioned. Circulating fan 465 can be a variable speed fan, or a single speed fan that can be cycled on and off to control the temperature in the refrigeration/storage module 460.

Refrigerating module 120 is described in detail above and accordingly will not be described in detail again in connection with FIGS. 18 and 19. Refrigeration/storage module 472 can be located in proximity to refrigerating module 120 and can be connected to refrigerating module 120 by an insulated supply duct 216 and an insulated return duct 218 similar to combined satellite station 240 illustrated in FIG. 8A. Refrigeration/storage module 472 can have an insulated cabinet 473 that can have an insulated door 474 hinged to insulated cabinet 473 to selectively provide access to compartment 475 defined by insulated cabinet 473. Insulated door 474 can have a handle, not shown, to facilitate access to the refrigerating appliance module 472. Refrigeration/storage module 472 can have a damper 476 that can control the volume of chilled air flowing into refrigeration/storage module 472 from refrigerating appliance module 120. Refrigerating module 120 and refrigeration/storage module 472 can have a temperature sensor 134 as described above, and can have a temperature selector 136, not shown, that can be combined with the respective cabinets or can be part of a central user interface as described above. Temperature sensors 134 and temperature selectors 136 can be connected to controller 150 (FIGS. 3 and 6) through control circuit 156. Refrigeration/storage module 472 can selectively be operated as a refrigerated storage space when damper 476 is positioned to allow air flow form refrigerating module 120 to flow into compartment 475 under the influence of evaporator fan 132. Those skilled in the art will understand that damper 476 can be manually adjustable by a user, or can be automatically adjustable under the control of controller 150 (see FIGS. 3 and 6). Damper 476 is illustrated as connected via control circuit 156 to controller 150. Those skilled in the art will understand than a manually adjusted damper 476 can be used and, if so, would not need to be connected to controller 150. Alternately, damper 476 can be positioned to block flow of chilled air from refrigerating module 120 refrigeration/storage module 472 can be allowed to remain at the ambient temperature of the location in the dwelling in which it is positioned. Also, a second damper 476, not shown, can be positioned in insulated return duct 218 if desired to improve isolation of refrigeration/storage module 472 when it is desired to operate refrigeration/storage module 472 as an unconditioned storage space.

As illustrated in FIG. 19, a second refrigeration/storage module 460 can be connected to refrigeration/storage module 472 to provide two modules connected to one refrigerating module 120 that can alternately be used for refrigerated or ambient storage space. It can be advantageous to employ a refrigeration/storage module 460 having a circulating fan 465 remote from a refrigerating module 120 when it is desired to provide two refrigeration/storage modules to facilitate air flow, indicated by air flow arrows 148, in both refrigeration/storage modules 475 and 460. Similarly, two refrigeration/storage modules 460 could be provided for a refrigerating module 120 or 466 since circulating fans 465 could provide adequate chilled air circulation in at least two refrigeration/storage modules. Thus, in the embodiment of the invention illustrated in FIGS. 18 and 19 a distributed refrigeration appliance system can have one or more refrigeration/storage modules to allow temporary additional refrigerated storage space that, when not needed, can be converted to ambient temperature storage space. Those skilled in the art will understand that a second damper, not shown, can be provided for insulated return duct 218 to prevent chilled air from flowing into the refrigeration/storage module 460 or 472 when the user has de-activated the circulating fan 465 and/or closed damper 476 to operate one or more refrigeration/storage modules as an ambient temperature storage space. Those skilled in the art will also understand that refrigeration/storage module 472 can be modified to be used in combination with a refrigerating module such as refrigerating module 120 without having a second refrigeration/storage module 460 combined with it as illustrated in FIG. 19. In the event refrigeration/storage module is to be used without a second refrigeration/storage module the insulated supply and return ducts 216 and 218 leading to refrigeration/storage module 460 from refrigeration/storage module 472 can be eliminated.

Figure 20:
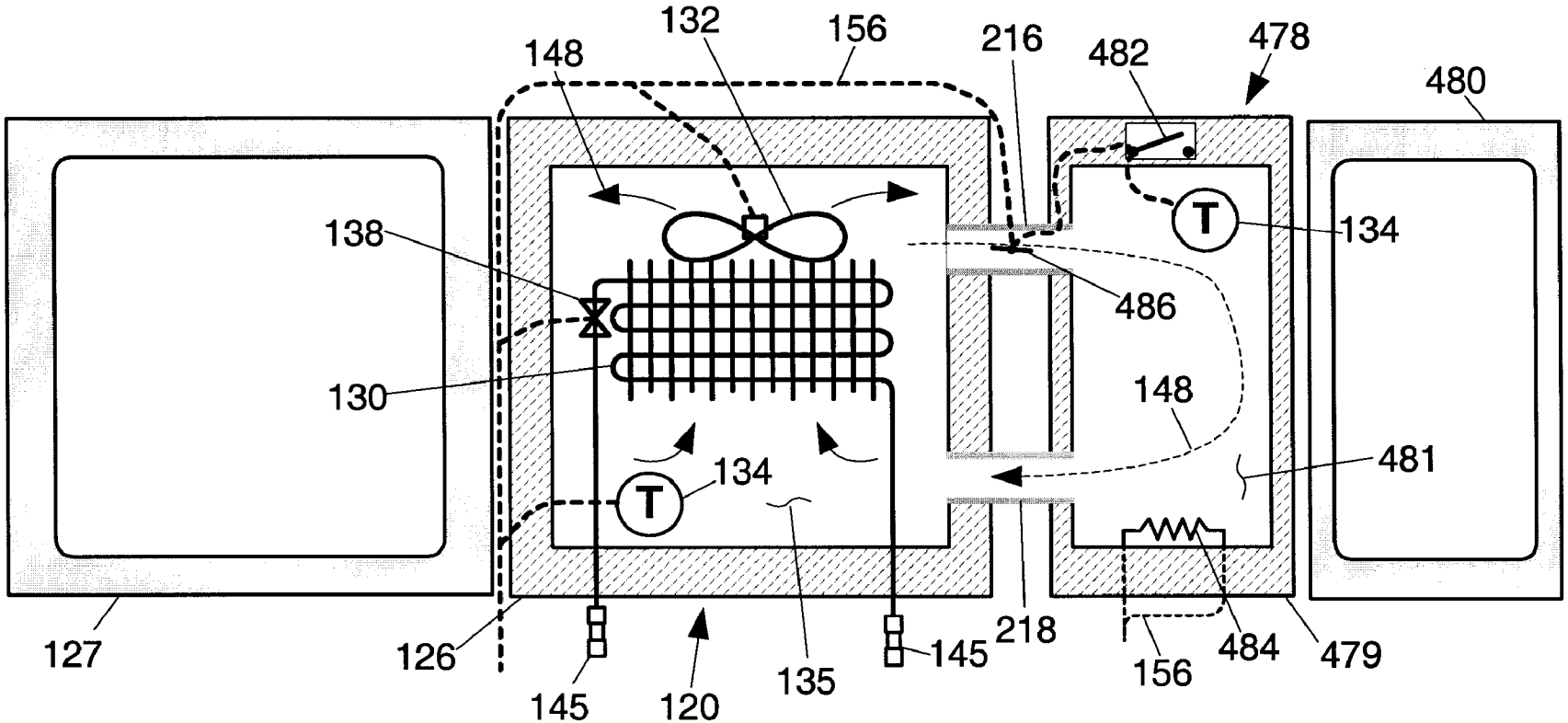
FIG. 20 is a partial schematic drawing illustrating another embodiment of refrigeration/storage modules that can be used in a modular distributed refrigeration system such as illustrated in FIGS. 3 and 6.

Turning to schematic FIG. 20, in another embodiment of the invention, refrigerating module 120 can be used with refrigeration/storage module 478 in a distributed refrigeration appliance system that can include a central cooling unit 110 as illustrated in FIGS. 3 and 6. Refrigerating module 120 can be a free standing or built-in module and can be general purpose refrigerator, freezer or special purpose module and can be located in a residential kitchen or other locations associated with a dwelling as desired. Refrigerating module 120 can be similar to refrigerating module 120 illustrated in FIG. 3, and accordingly, will use the same reference numerals as refrigerating module 120 in FIG. 3. Alternately, refrigerating module could also be similar to combined satellite station 240 illustrated in FIG. 8A. The central cooling unit 110, additional satellite stations 212 and refrigeration appliance modules have not been included in FIG. 20 to simplify the drawings. Insulated supply conduits 142 and insulated return conduits 144 (see FIGS. 3 and 6) can be connected to quick connect fittings 145 to provide a refrigerant circuit to evaporator 130 in refrigerating module 120 from a central cooling unit 110 (see FIGS. 3 and 6). As noted above, central cooling unit 110 can be located in a location remote from a residential kitchen, or in or in proximity of the residential kitchen as desired as those skilled in the art will understand.

Refrigeration/storage module 478 can have an insulated cabinet 479 that can have an insulated door 480 hinged to insulated cabinet 479 to selectively provide access to compartment 481 defined by insulated cabinet 479. Insulated door 480 can have a handle, not shown, to facilitate opening and closing insulated door 480 to access compartment 481. Refrigeration/storage module 478 can be connected to refrigerating module 120 by an insulated supply duct 216 and an insulated return duct 218 and can have a damper 486 associated with insulated supply duct 216 that can control the volume of chilled air flowing, see dashed air flow arrow 148, into refrigeration/storage module 478 from refrigerating module 120. Refrigeration/storage module 478 can also have a selector 482 that can be a switch connected to control circuit 156. In some embodiments of the invention the refrigeration/storage module can comprise an insulated insert into a cabinet as will be described in greater detail below. In such circumstances it can be advantageous to provide a selector switch 482 to indicate the presence or absence of an insulated insert to form insulated cabinet 479 to avoid operating refrigeration/storage module 478 at below ambient temperatures without an insulating insert in place. Those skilled in the art will understand that selector switch can be arranged to be manually set by a user or can be automatically closed to indicate the presence of an insulated insert upon positioning the insulated insert in the cabinet. A selector switch 482 can also be provided in module 460 as illustrated in FIGS. 18 and 19. Refrigerating module 120 and refrigeration/storage module 478 can have temperature sensors 134 as described above, and can have temperature selectors 136, not shown, that can be combined with the respective cabinets or can be part of a central user interface as described above. Temperature sensors 134 and temperature selectors 136 can be connected to controller 150 (FIGS. 3 and 6) through control circuit 156. Refrigeration/storage module 478 can selectively be operated as a refrigerated storage space when damper 486 is positioned to allow chilled air to flow from refrigerating module 120. Damper 486 can be manually adjustable by a user to control the operating temperature in compartment 481. Alternately, damper 486 can be arranged to be operated by controller 150 (FIGS. 3 and 6) depending on the setting of a temperature selector 136, not shown, controlling refrigeration/storage module 478 and the temperature sensed by temperature sensor 134. Alternately, damper 486 can be positioned to block flow of chilled air from refrigerating module 120 and refrigeration/storage module 478 can be allowed to remain at the ambient temperature of the location in the dwelling in which it is positioned. Those skilled in the art will understand that insulated return duct 218 can also be provided with a damper, not shown, to help assure that chilled air does not flow from refrigerating module 120 when the user desires to allow refrigeration/storage module to remain at ambient temperature for additional storage space. Refrigeration/storage module 478 can also have a heating element 484 that can be arranged to heat the contents of refrigeration/storage module above ambient temperature. Heating element 484 can be connected through control circuit 156 to controller 150 for selective operation of heating element 484. Use of heating element 484 can allow a user to select a temperature sequence cycle for the contents of refrigeration/storage module 478 that can include heating the contents to a temperature above ambient temperature as will be described in detail below. Thus, in the embodiment of the invention illustrated in FIG. 20 a distributed refrigeration appliance system can have one or more refrigeration/storage modules to allow temporary additional refrigerated storage space that, when not needed, can be converted to ambient temperature storage space, or can be operated to provide one or more predetermined temperature sequence cycles to treat the contents of compartment 481. While the embodiments illustrated in FIGS. 18-20 have been described in combination with central cooling unit 110, those skilled in the art will understand that a secondary loop central cooling units 10, 60, 370 and 402 described above in detail could be employed with corresponding refrigeration appliance modules combined with refrigeration/storage modules as described in the embodiments disclosed in FIGS. 18-20.

Figure 21:
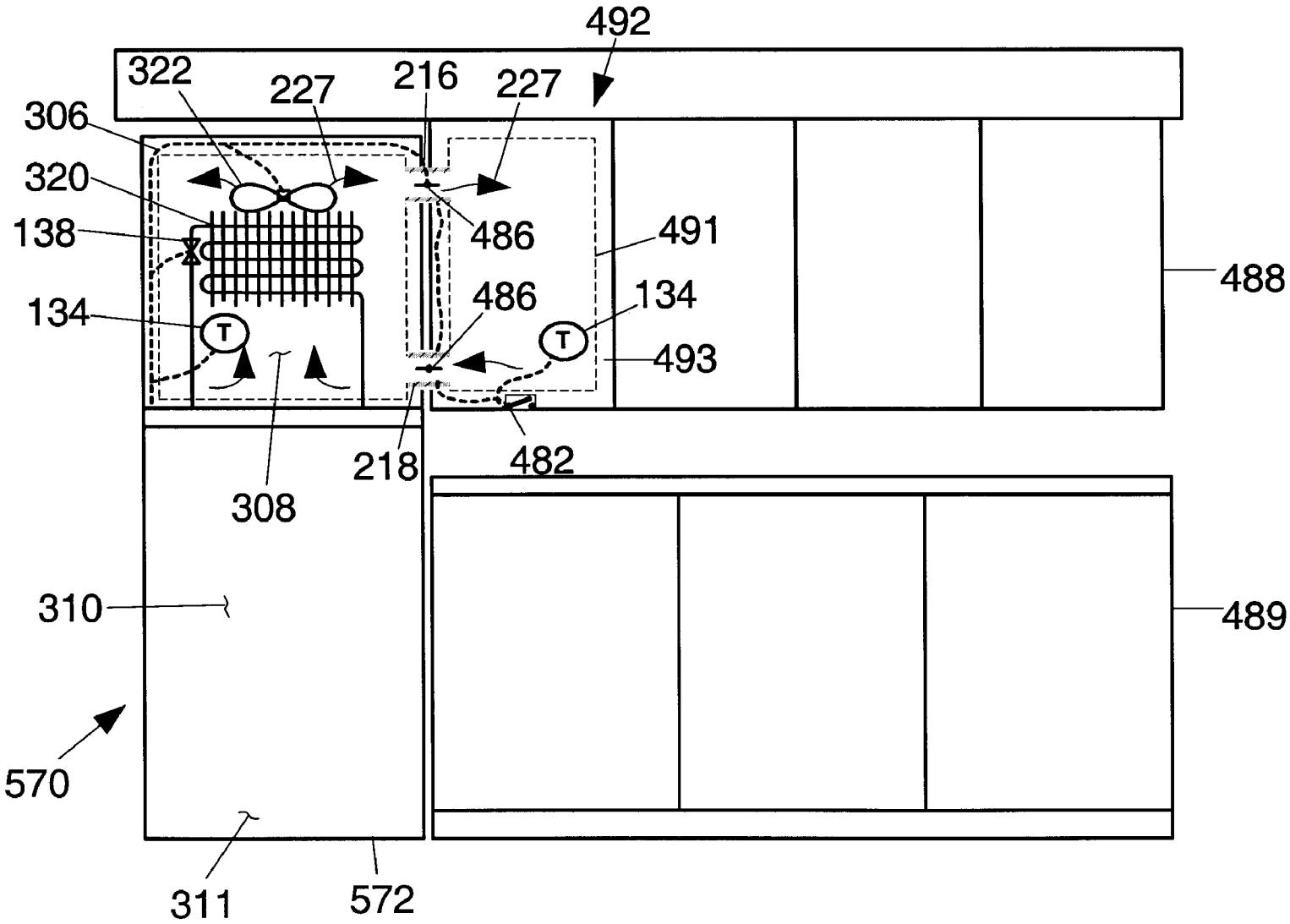
FIG. 21 is a schematic drawing illustrating another embodiment of a modular refrigeration system according to the invention.
Figure 22:
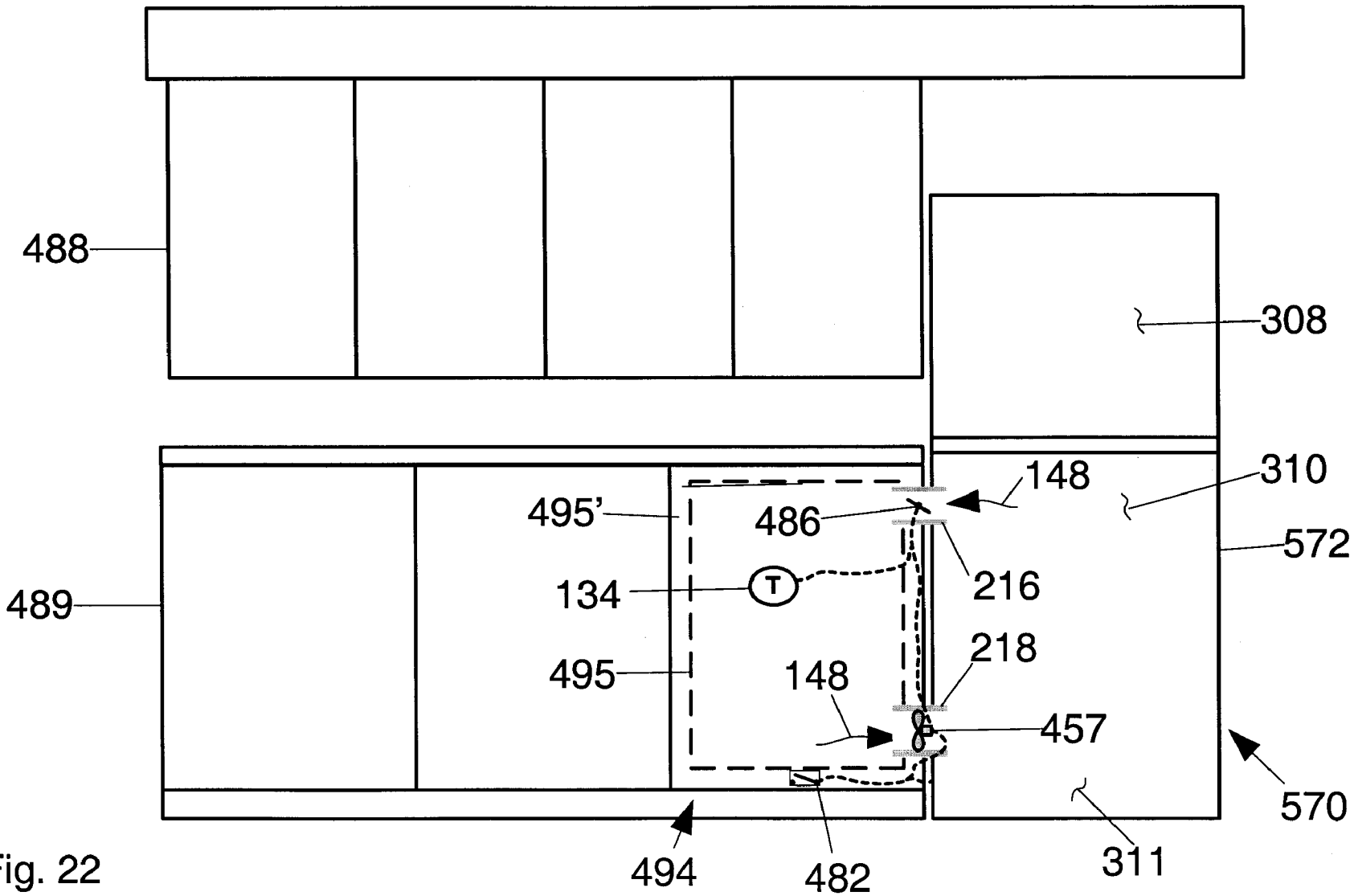
FIG. 22 is a schematic drawing illustrating another embodiment of a modular refrigeration system according to the invention.

Turning to schematic FIGS. 21-23, in another embodiment of the invention, a refrigeration apparatus 570 can be combined with a refrigeration/storage modules that can be arranged to selectively provide additional refrigerated storage or unconditioned storage space. Refrigeration apparatus 570 can be a freestanding refrigerating apparatus and can be positioned in a kitchen or other location in a dwelling in relation to upper cabinets 488 and lower cabinets 489. Refrigeration apparatus 570 can be similar to a combined satellite station/refrigeration appliance module/central cooling unit 282 as illustrated and described in FIG. 10, or can be similar to a conventional freestanding or a built in modular or stacked refrigerator freezer. As illustrated in FIGS. 21-23, refrigeration apparatus 570 will utilize the same numerals as combined satellite station/refrigeration appliance module/central cooling unit 282 illustrated in FIG. 10. Operation of combined satellite station/refrigeration appliance module/central cooling unit 282, partially shown in FIGS. 21-23, is described in detail above and will not be repeated in connection with FIGS. 21-23.

Refrigeration/storage module 492 illustrated in FIG. 21 can include an insulated cabinet 491 having an insulated door 493. Insulated door 493 can have a handle, not shown, to facilitate access into refrigeration/storage module 492. Refrigeration/storage module 492 can have a temperature sensor 134 and a temperature selector 136, not shown, as described above and can be positioned adjacent upper cabinets 488. Temperature sensors 134 and temperature selectors 136 can be connected to controller 300 (FIG. 10) through control circuit 306. Refrigeration/storage module 492 can include a selector 482, as described above, connected to controller 300 (see FIG. 10), and can have dampers 486 that can be positioned in insulated supply duct 216 and insulated return duct 218 that can connect combined satellite station 282 with refrigeration/storage module 492. As described above, dampers 486 can be adjusted to allow chilled air to flow into refrigeration/storage module 492 or to block chilled air flow to allow refrigeration/storage module to remain at ambient temperature as unconditioned storage space. Dampers 486 can be manually adjustable by a user to allow chilled air flow at a sufficient volume to maintain a desired temperature in the refrigeration/storage module 492, or can be automatic dampers that can be connected to a controller 300 (FIG. 10) to control the temperature in refrigeration/storage module 492 based on input from a temperature sensor 134 and a temperature selector 136 (FIG. 10).

Refrigeration/storage module 494 illustrated in FIG. 22 can include an insulated cabinet 495 having an insulated door 495'. Insulated door 495' can have a handle, not shown to facilitate access into refrigeration/storage module 494. Refrigeration/storage module 494 can have a temperature sensor 134 and a temperature selector 136, not shown, as described above and can be positioned adjacent lower cabinets 489. Temperature sensors 134 and temperature selectors 136 can be connected to controller 300 (FIG. 10) through control circuit 306. Refrigeration/storage module 494 can include a selector 482, as described above, connected to controller 300 (see FIG. 10) and can have a damper 486 positioned in insulated supply duct 216 and a circulating fan 457 positioned in insulated return duct 218. As noted above, refrigeration apparatus 570 can have a top mounted freezer compartment and a bottom mounted above freezing refrigerator compartment opposite refrigeration/storage module 494. Damper 486 can arranged to be manually adjustable by the user, or can be an automatic damper as described above to control the amount of chilled air flowing into refrigeration/storage module 494, and therefore the operating temperature. In the embodiment illustrated in FIG. 22, a circulating fan 457 can be provided in insulated return duct 218 to assure circulation of chilled air, see air flow arrows 148, into refrigeration/storage module 494 from freestanding refrigeration appliance 570 and back into freestanding refrigeration appliance 570.

Figure 23A:
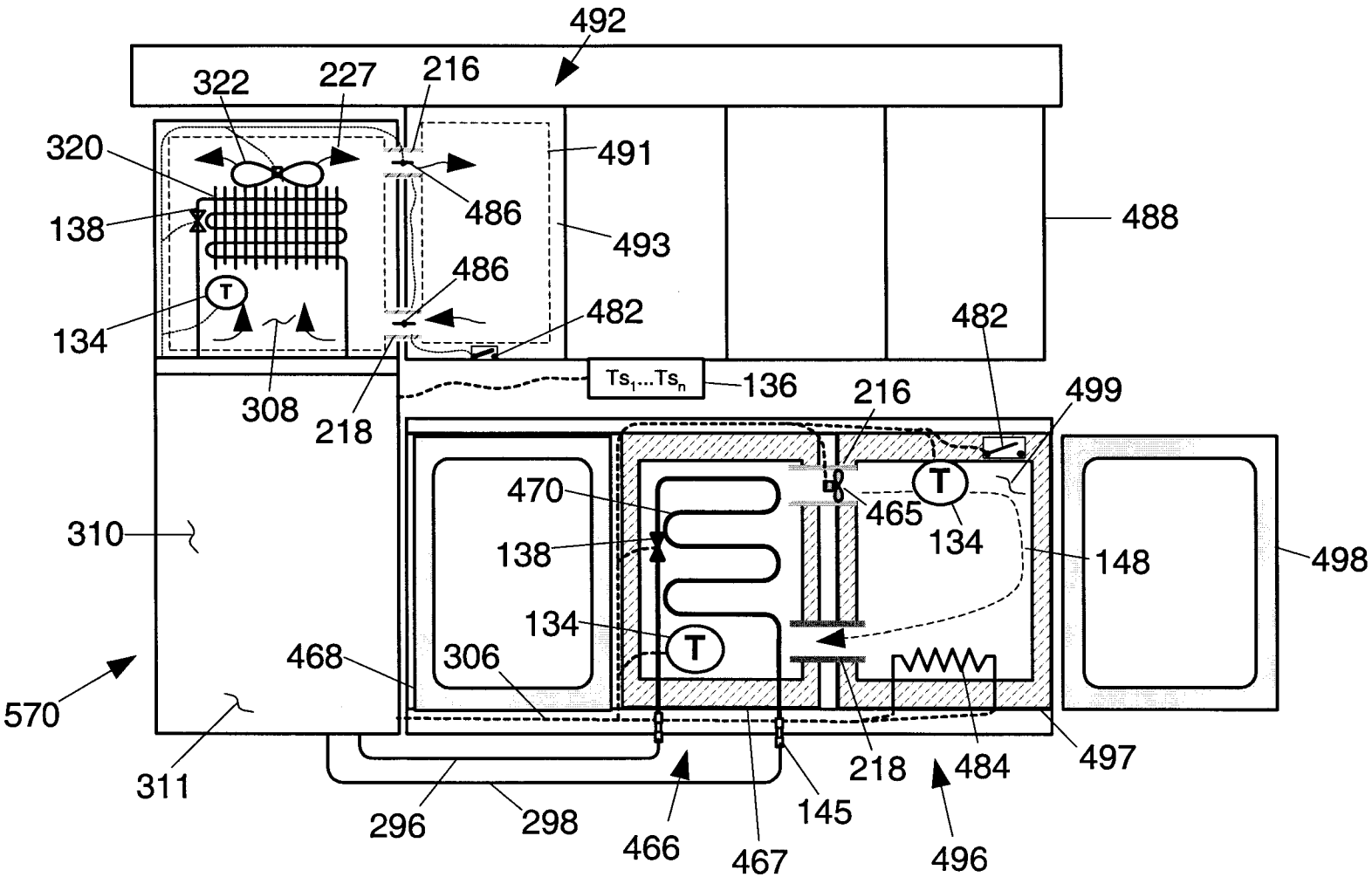
FIG. 23A is a schematic drawing illustrating another embodiment of refrigeration/storage modules that can be used in a distributed refrigeration system according to the invention.

In the embodiment illustrated in FIG. 23A, freestanding refrigeration appliance 570 can be similar to combined satellite station/refrigeration appliance module/central cooling unit 282 illustrated in FIG. 10, and can have a refrigerating module 466 arranged to connect to central cooling unit 284, not shown, (see FIG. 10). Refrigerating module 466 is described above in detail in connection with FIG. 18 and accordingly will not be described again in detail again in connection with FIG. 23A. Refrigerating module 466 can be positioned in place of a lower cabinet 489 as illustrated in FIGS. 21-22. Refrigeration/storage module 496 can be positioned adjacent refrigerating module 466 and can be connected to refrigerating module 466 by insulated supply duct 216 and insulated return duct 218 and can have a circulating fan 465 associated with insulated supply duct 216 to circulate chilled air from refrigerating module 466 into compartment 499 when circulating fan 465 is operated. Circulating fan 465 can be connected to controller 300 (see FIG. 10) through control circuit 306. Refrigeration/storage module 496 can have a temperature sensor 134 and a temperature selector 136 as described above. Thus, a user can select refrigerated operation of refrigeration/storage module 496 by setting the appropriate selector 136 for refrigeration/storage module 496 for refrigerating operation. Controller 300 (FIG. 10) can cause circulating fan 465 to operate causing chilled air to circulate from refrigerating module 466 into refrigeration/storage module 496 (see dashed air flow arrows 148). Refrigeration/storage module 496 can also have a heating element 484 that can be similar to heating element 484 illustrated in refrigeration/storage module 478 (see FIG. 20). Operation of heating element 484 in refrigeration/storage module 496 can be similar to the operation of refrigeration/storage module 478 described above and will not be repeated. As noted above, operation of heating element 484 to selectively provide a predetermined temperature profile for the contents of refrigeration/storage module 496 will be described in detail below.

Figure 23B:
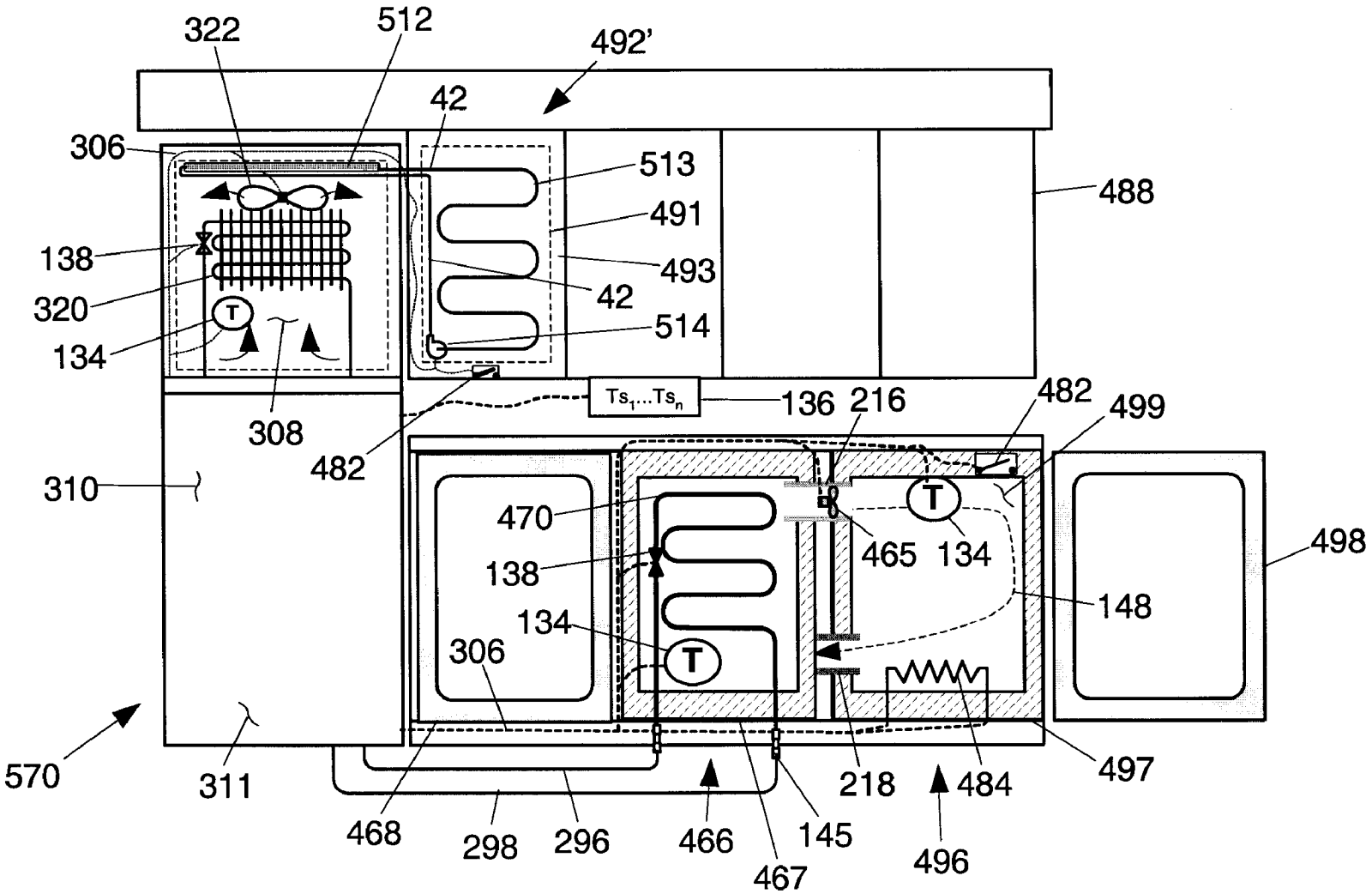
FIG. 23B is a schematic drawing illustrating another embodiment of refrigeration/storage modules that can be used in a distributed refrigeration system according to the invention.

In the embodiment illustrated in FIG. 23B, freestanding refrigeration appliance 570 can be similar to combined satellite station/refrigeration appliance module/central cooling unit 282 illustrated in FIG. 10, and can have a refrigerating module 466 arranged to connect to central cooling unit 284, not shown, (see FIG. 10). Refrigerating module 466 is described above in detail in connection with FIG. 18 and accordingly will not be described again in detail in connection with FIG. 23B. Refrigerating module 466 can be positioned in place of a lower cabinet 489 as illustrated in FIGS. 21-22. Refrigeration/storage module 496 is described above in detail in connection with FIG. 23A and accordingly will not be described again in detail. Refrigeration/storage module 492' illustrated in FIG. 23B can employ a secondary cooling medium circuit to selectively cool the interior of insulated cabinet 491 in lieu of insulated ducts 216 and 218 connecting insulated cabinet 491 with compartment 308 as described above in connection with FIG. 23A. The secondary cooling medium circuit can include a heat exchanger 512 that can be positioned in compartment 308 in proximity of evaporator 320 to reject heat from insulated compartment 491 to compartment 308 and evaporator 320. Heat exchanger 512 can be connected with insulated conduits 42 to heat exchanger 513 that can be positioned in insulated cabinet 491 and a pump 514. Pump 514 is illustrated as being positioned in insulated compartment 491, however, pump 514 can be positioned in other locations as desired, including in central cooling unit space 311 as desired. As described above the liquid coolant for the secondary cooling medium circuit, not shown, can be DYNALENE HC heat transfer fluid, a water-based organic salt that is non-toxic, non-flammable with low viscosity, or other liquid coolant solutions such as ethylene glycol and water solution. In operation, when a user elects to operate refrigeration/storage module 492' as refrigerated space, selector switch 482 can be closed and pump 514 can operate under control of controller 300 and a temperature sensor 134, not shown, to circulate liquid coolant through heat exchanger 513 to chill insulated cabinet 491. In order to operate refrigeration/storage module 492' as an unconditioned storage space selector switch 482 can be opened and pump 514 de-energized to allow the temperature in insulated cabinet 491 to rise to the ambient temperature. Insulated cabinet 491 can be a container forming a space for holding a liquid or slurry material such as water or ice cream or other liquid, semi-liquid or slurry materials that a user might choose to cool or chill for use, or as a step in preparation. Insulated cabinet 491 could take the form of an insulated tank or container, or could be an insulated space arranged to receive a removable liquid and/or slurry container, not shown. Heat exchanger 513 can be positioned to chill a removable liquid/slurry container, not shown. Those skilled in the art will understand that modules other than refrigeration/storage module 492' can comprise, or be arranged to receive a tank or container for storing and/or refrigerating a liquid or slurry material if desired. Similarly, refrigeration/storage module 492' can be used in combination with satellite stations as illustrated in the embodiments of FIGS. 6-11 as desired.

Those skilled in the art will understand that freestanding refrigeration appliance 570 can be configured as a bottom freezer apparatus having an evaporator in the lower part of the appliance and that accordingly, the refrigeration/storage modules 492, 492' and 494 could be switched to correspond to the above freezing and below freezing compartments in freestanding refrigerating appliance 570. Further, while heating elements have been illustrated in refrigeration/storage modules 478 and 496, those skilled in the art will understand that heating elements could be provided in any of the refrigeration/storage modules illustrated in FIGS. 18, 19, 21 or 22. Thus, in the embodiment of the invention illustrated in FIGS. 21-23B a distributed refrigeration appliance system can have one or more refrigeration/storage modules combined with a freestanding refrigeration appliance to allow temporary additional refrigerated storage space that, when not needed, can be converted to ambient temperature storage space, or if provided with a heating element can be used to heat the contents to above ambient temperatures.

Figure 24:
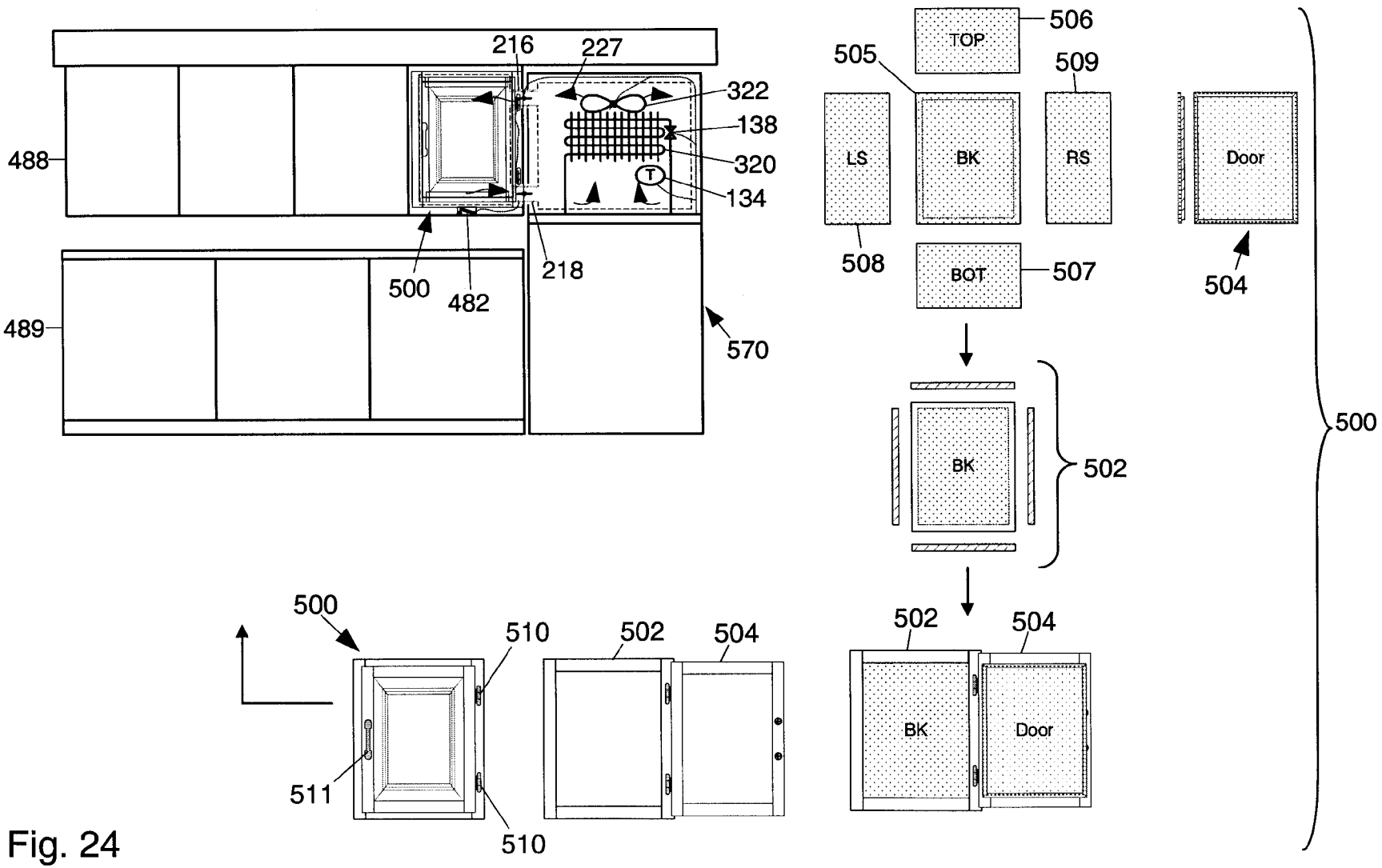
FIG. 24 is a schematic drawing illustrating another embodiment of a refrigeration/storage module that can be used in a distributed refrigeration system according to the invention.

Insulated cabinets described above can be formed of wood, metal or molded plastic and provided with insulating material such as polyurethane foam or expanded Styrofoam as is well known in the art. Also as is well known in the art such insulated cabinets can be formed in a manufacturing location and shipped to a job site in final form, or can be fabricated at the job site cutting and assembling cabinets from insulated panels and preformed insulated doors. According to the invention, an insulated cabinet and insulated door for a refrigeration/storage module can be formed by providing an insulated insert and insulated door kit to convert an uninsulated cabinet into a refrigeration/storage module. Turning to FIG. 24 that includes an exploded view of insulated insert 500, preparation of an insulated insert 500 can be seen. Insulated insert 500 can include an insulated box 502 and an insulated door 504 that can be attached to insulated box by hinges 510. Insulated door can include a handle 511 to facilitate opening and closing insulated door 504. Insulated box 502 can include an insulated back wall 505, insulated top wall 506, insulated bottom wall 507, insulated left side wall 508 and insulated right side wall 509 that can be assembled into insulated box 502 as is well known in the cabinet industry. Insulated insert 500 can be inserted into an upper cabinet 488 or into a lower cabinet 489 into to convert a conventional cabinet into a refrigeration/storage module. Those skilled in the art will understand that instead of fabricating insulated insert 500 as an insert, an insulated cabinet can be fabricated that can replace an upper cabinet 488 or lower cabinet 489 if desired. If an insulated cabinet is to be constructed instead of an insulated insert, panels having an acceptable "outer" surface can be used to match other cabinets used in the dwelling as desired. According to this aspect of the invention distributed refrigeration modules can be provided to satisfy requirements for the refrigeration system by the intended user without requiring the user to settle for module sizes generally available in the mass market for refrigeration appliances. The construction described above for insulated insert 500 can be used for any of the refrigeration/storage modules 460, 472, 478, 492, 492', 494 and 496 described above if desired.

Turning to schematic FIGS. 25 and 26, in another embodiment of the invention, a refrigeration apparatus 570 can be combined with a refrigeration/storage module that can be arranged to selectively provide additional refrigerated storage or unconditioned storage space above or below refrigeration apparatus 570. Refrigeration 570 apparatus can be a built in or freestanding apparatus and can be positioned in a kitchen or other location in a dwelling in relation to upper cabinets 488 and lower cabinets 489. As described above in connection with FIGS. 21-23B, refrigeration apparatus 570 can be similar to a combined satellite station/refrigeration appliance module/central cooling unit 282 as illustrated in FIG. 10, or can be similar to a conventional refrigerator freezer. Refrigeration apparatus 570 will not be described again in detail in connection with FIGS. 25 and 26.

Figure 25:
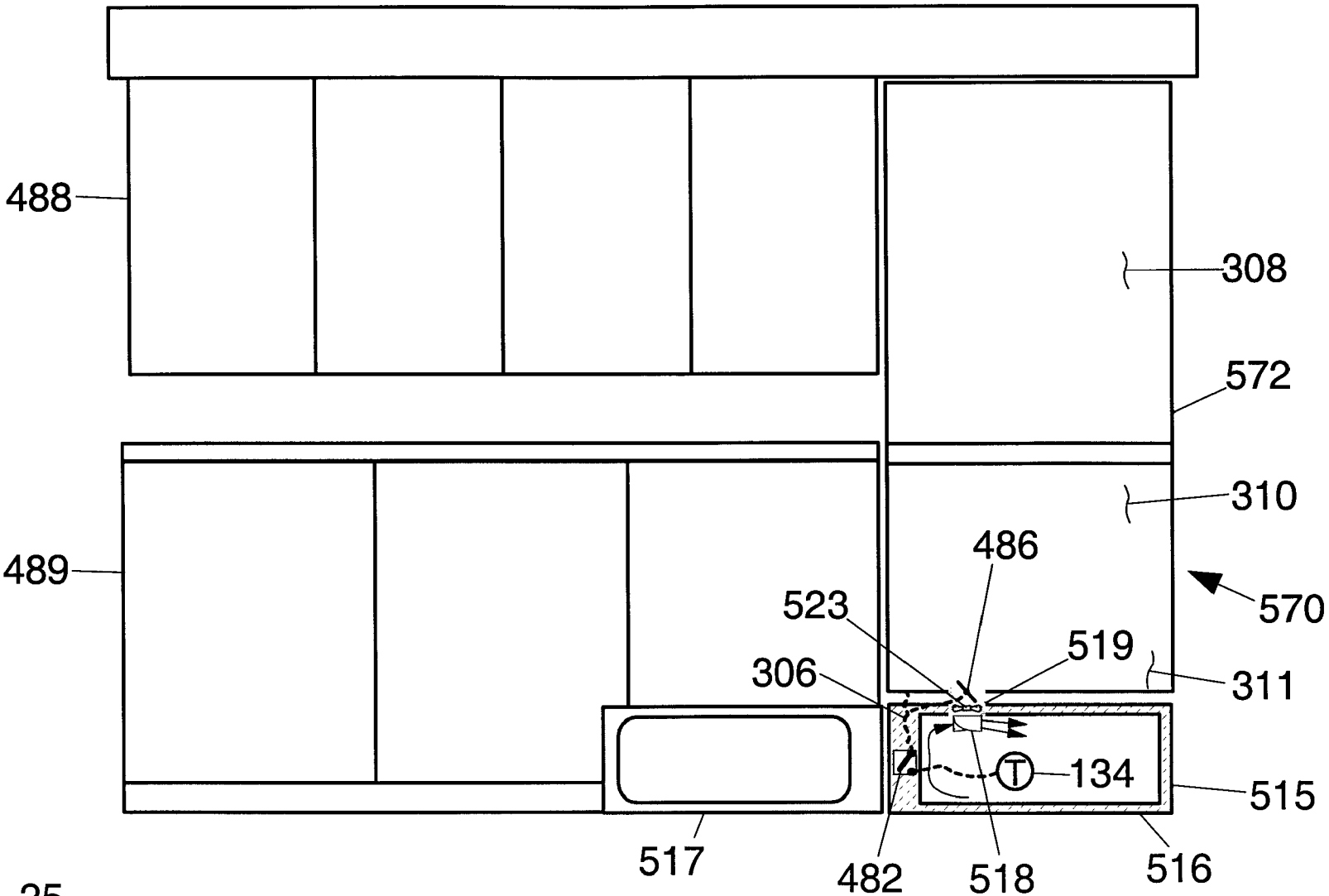
FIG. 25 is a schematic drawing illustrating another embodiment of a modular refrigeration system according to the invention.

In FIG. 25 refrigeration apparatus 570 can be installed on or above a refrigeration/storage module 515 to raise refrigeration apparatus 570 to facilitate user access to the lower compartment of refrigeration apparatus 570 without undue bending. Refrigeration/storage module 515 can include an insulated cabinet 516, insulated door 517, and if desired a selector 482 as described above. Refrigeration/storage module 515 can have a temperature sensor 134, a temperature selector 136, not shown, and a diffuser 518 that can cooperate with insulated duct 519 connecting refrigeration/storage module 515 with the lower compartment 310 of refrigeration apparatus 570. Insulated duct 519 can be a concentric duct or can be a two passage parallel duct to provide a supply and return passage to refrigeration/storage module 515. Temperature sensor 134 and temperature selector 136, not shown, can be connected to controller 300 (FIG. 10) through control circuit 306. Insulated door 517 can have a handle, not shown, to facilitate access to refrigeration/storage module 515. Insulated duct 519 can have a damper 486 to selectively allow chilled air from refrigeration apparatus 570 to flow into refrigeration/storage module 515. Circulating fan 523 can assure that chilled air from refrigeration/storage module 515 returns to compartment 310 of refrigeration apparatus 570. As described above in detail, refrigeration/storage module 515 can be selectively operated as refrigerated storage space by positioning damper 486 to allow chilled air to flow through insulated duct 519 and operating circulating fan 523. As above, damper 486 can be manually operated by a user, or can be an automatic damper connected to controller 300 (see FIG. 10) through control circuit 306. Circulating fan 523 can be connected through control circuit 306 to controller 300 and can be operated when a user selects refrigerated operation of refrigeration/storage module 515. Likewise as described above in connection with other embodiments, a user can allow refrigeration/storage module 515 to achieve ambient temperature with damper 486 positioned to block flow of chilled air into refrigeration/storage module 515 and circulating fan 523 de-energized.

Figure 26:
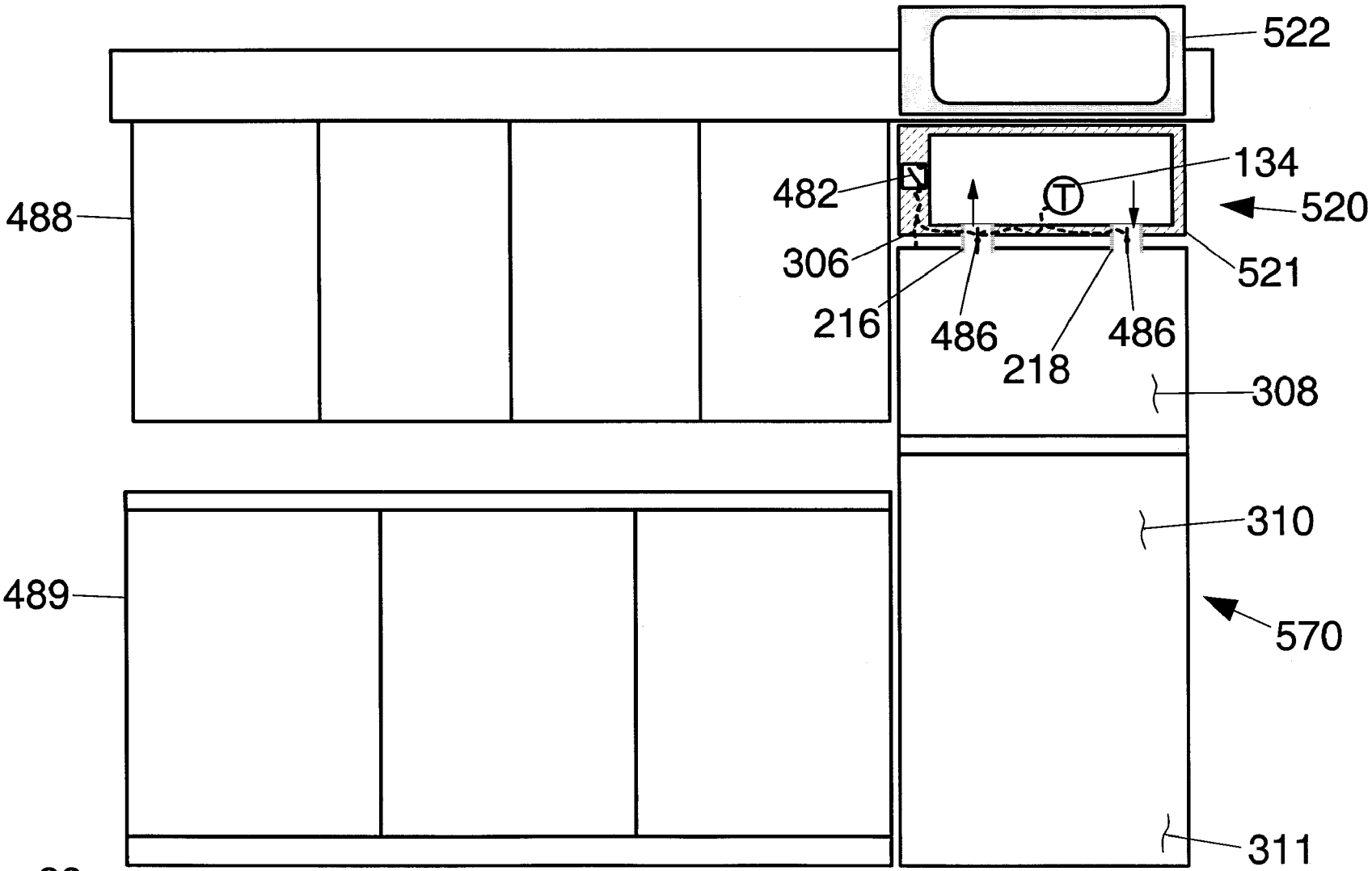
FIG. 26 is a schematic drawing illustrating another embodiment of a modular refrigeration system according to the invention.

Turning to FIG. 26, a refrigeration/storage module 520 can be positioned above refrigeration appliance 570 in the space between the top of refrigeration appliance 570 and a soffit or the ceiling in the location in the dwelling in which refrigeration appliance 570 is located. Refrigeration/storage module 520 can include an insulated cabinet 521, and insulated door 522 that can be hinged to insulated cabinet 521. Insulated door 522 can have a handle, not shown, to facilitate opening and closing insulated door 522. In FIG. 26 insulated door 522 is schematically illustrated as pivoting on a horizontal axis. Those skilled in the art will understand that insulated door 522 can be hinged to pivot on a vertical axis similar to insulated door 517 in FIG. 25 if desired. Refrigeration/storage module 520 can have a selector 482, as described above, and can have a temperature sensor 134 and temperature selector 136, not shown. Temperature sensor 134 and temperature selector 136, not shown, can be connected to controller 300 (FIG. 10) through control circuit 306. An insulated supply duct 216 and insulated return duct 218 can connect refrigeration/storage module 520 to refrigeration apparatus 570. Insulated supply and return ducts 216 and 218 can have a damper 486 to control flow of chilled air from refrigeration appliance 570 to refrigeration/storage module 520 and back to refrigeration appliance 570. As described above, refrigeration appliance 570 can be a combined satellite station/refrigeration appliance module/central cooling unit 282 (see FIG. 10)

that can include an evaporator fan 322 (see FIG. 10). The evaporator fan 322 can circulate chilled air through insulated supply 216 and return 218 ducts when dampers 486 are positioned to allow air flow through the ducts. Dampers 486 can be manually adjustable by a user to allow chilled air flow at a sufficient volume to maintain a desired temperature in the refrigeration/storage module 520, or can be automatic dampers that can be connected to a controller 300, not shown, to control the temperature in refrigeration/storage module 520 under based on input from a temperature sensor 134 and a temperature selector, both not shown. Thus, in FIGS. 25 and 26 refrigeration/storage modules 515 and 520 can be combined with a refrigerating appliance 570 and that can be selectively operated as refrigerated or ambient storage space to allow a user to have additional refrigerated or ambient temperature storage space as storage needs change.

As described in connection with FIGS. 20 and 23 a refrigeration/storage module can have a heating element 484 to allow a user to selectively raise the temperature in the module above the ambient temperature as well as refrigerate the module to below ambient temperatures. In each of the embodiments the refrigeration/storage module can have a flow controller to allow or block flow of chilled air into the refrigeration/storage module, and as in the embodiments illustrated in FIGS. 20 and 23, can have a heating element that can be selectively energized to heat the contents of the refrigeration/storage module. The flow controller, damper 486 or circulating fan 465, and heating element 484 can be connected to controller 300 (see FIG. 10) through control circuit 306. System controller 300 can be arranged to selectively operate at least one flow controller to allow chilled air to flow through at least one insulated duct to refrigerate the contents of the refrigeration/storage module to a desired below ambient temperature; or selectively operate the flow controller to block the flow of chilled air through at least one insulated duct to operate the refrigeration/storage module as an unconditioned (i.e. ambient temperature) storage space; or selectively operate the flow controller to block the flow of chilled air through the at least one insulated duct and selectively operate the heating element to heat the contents of the refrigeration/storage module to a desired above ambient temperature; or selectively operate the flow controller to allow or block the flow of chilled air into the refrigeration/storage module and selectively operate the heating element to sequence the storage temperature of the contents of the refrigeration/storage module through a predetermined temperature sequence cycle to cause physical or chemical effects in the contents of the refrigeration/storage module. For example, predetermined temperature sequence cycles can include defrosting, fermentation, leavening, quick set cooling and rapid cool down.

Figure 27A:
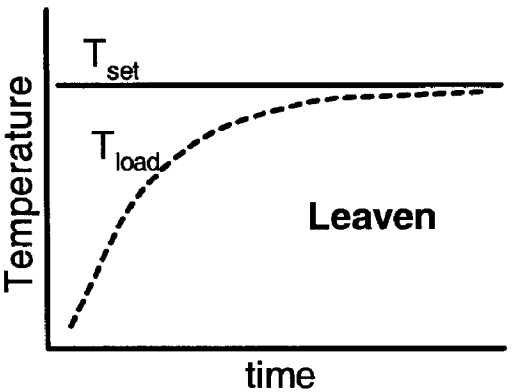
FIGS. 27A-27D are illustrations of temperature sequence cycles that can be provided in refrigeration/storage module according to the invention.
Figure 27B:
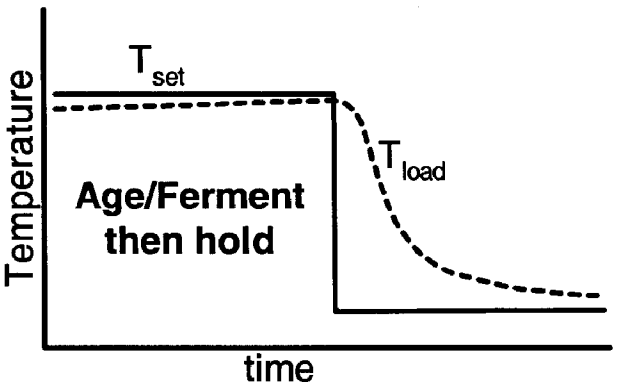
Figure 27C:
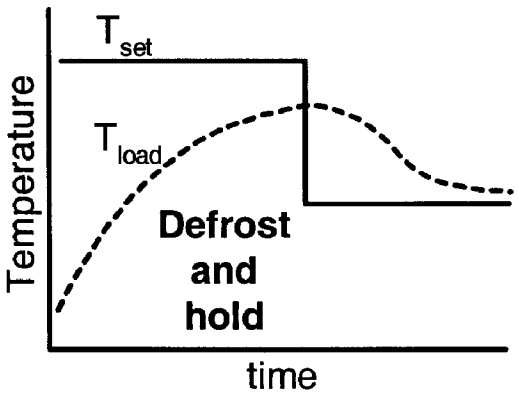
Figure 27D:
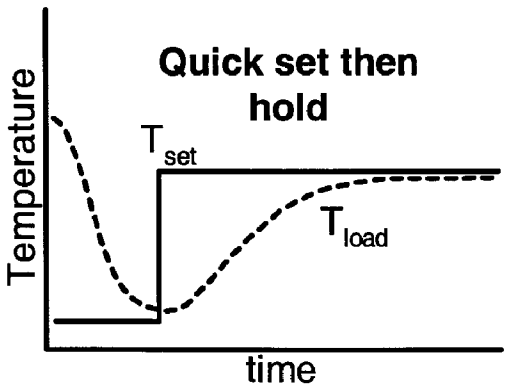

Turning to FIG. 27A-27D illustration of time and temperature conditions in four temperature sequence cycles can be seen. In FIG. 27A controller 300 can be programmed to cause the temperature in a refrigeration/storage module to rise to a predetermined set temperature to leaven the contents and then hold for a predetermined or open-ended time. In FIG. 27B controller 300 can be programmed to hold the contents of the refrigeration/storage module at a predetermined above ambient set temperature for a predetermined time to age or ferment the contents and then reduce the temperature of the contents to a holding temperature that can be above or below ambient temperature. In 27C controller 300 can elevate the temperature to defrost the contents and then hold the contents at a reduced, above freezing, temperature. In FIG. 27D controller can cause the temperature in refrigeration/storage module to quickly drop to chill the contents and then allow the temperature to rise to a set temperature. In the programs illustrated in FIGS. 27B, 27C and 27D the controller can be arranged to change from the higher to lower, or lower to higher temperatures based on elapsed time, or on input from a temperature sensor or other sensor such as a humidity, carbon dioxide or hydrocarbon (such as ethylene or other food stuff gases caused by ripening or decay) sensor so that the predetermined temperature sequence cycle is dependent on the condition/changed condition of the contents of the refrigeration/storage module. Those skilled in the art will understand that predetermined temperature sequence cycles in addition to those illustrated in FIG. 27 and described above can be used with refrigeration/storage modules described above. Likewise, those skilled in the art will understand that a controller can be arranged to allow a user to program a desired temperature sequence cycle using a user interface or other well known programming method.

Figures 28, 28A:
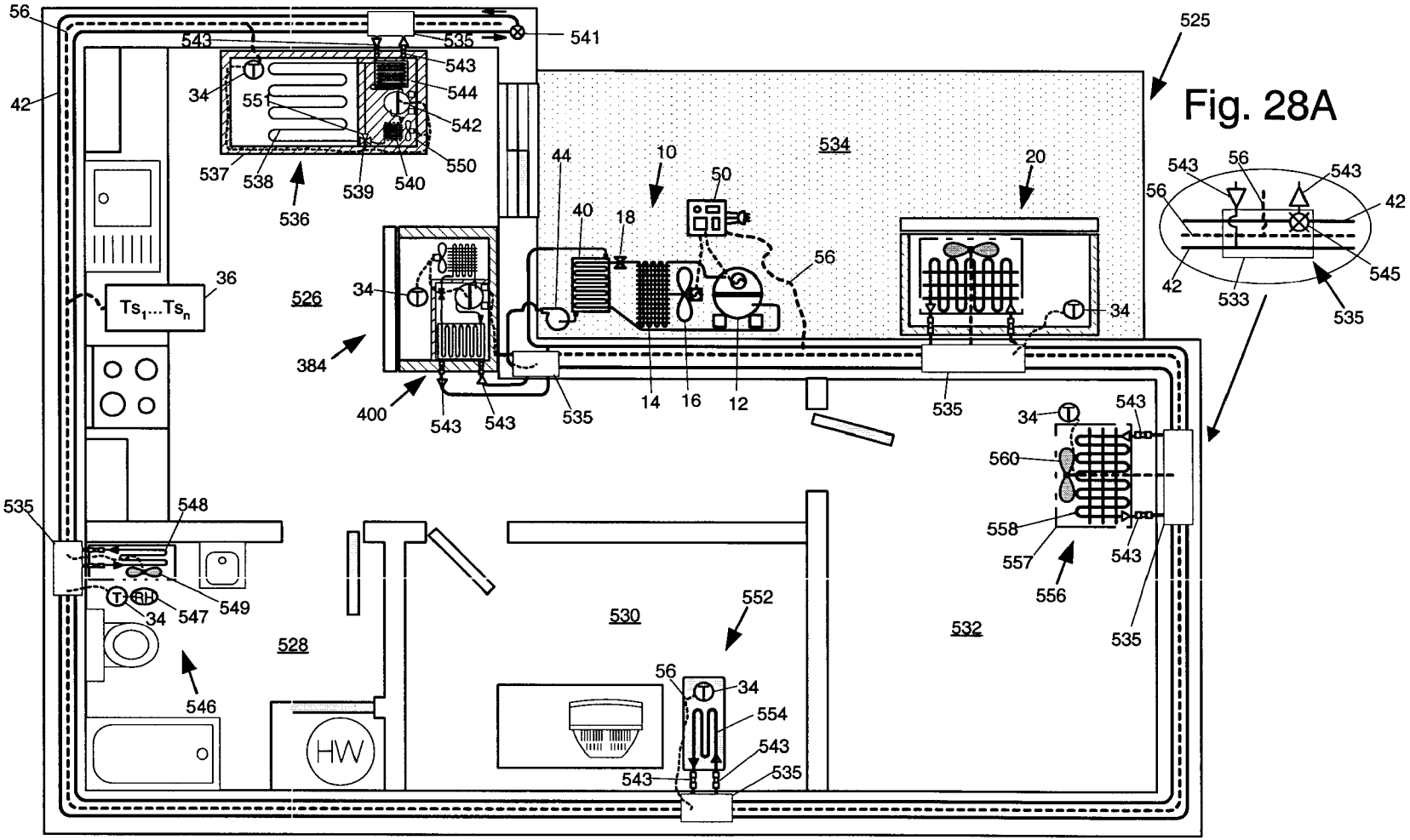
FIG. 28 is a schematic drawing illustrating a distributed refrigeration system according to the invention installed in a schematic floor plan of a dwelling.
FIG. 28A is an enlarged schematic drawing illustrating connection of a module to a supply and return system.
Figure 29:
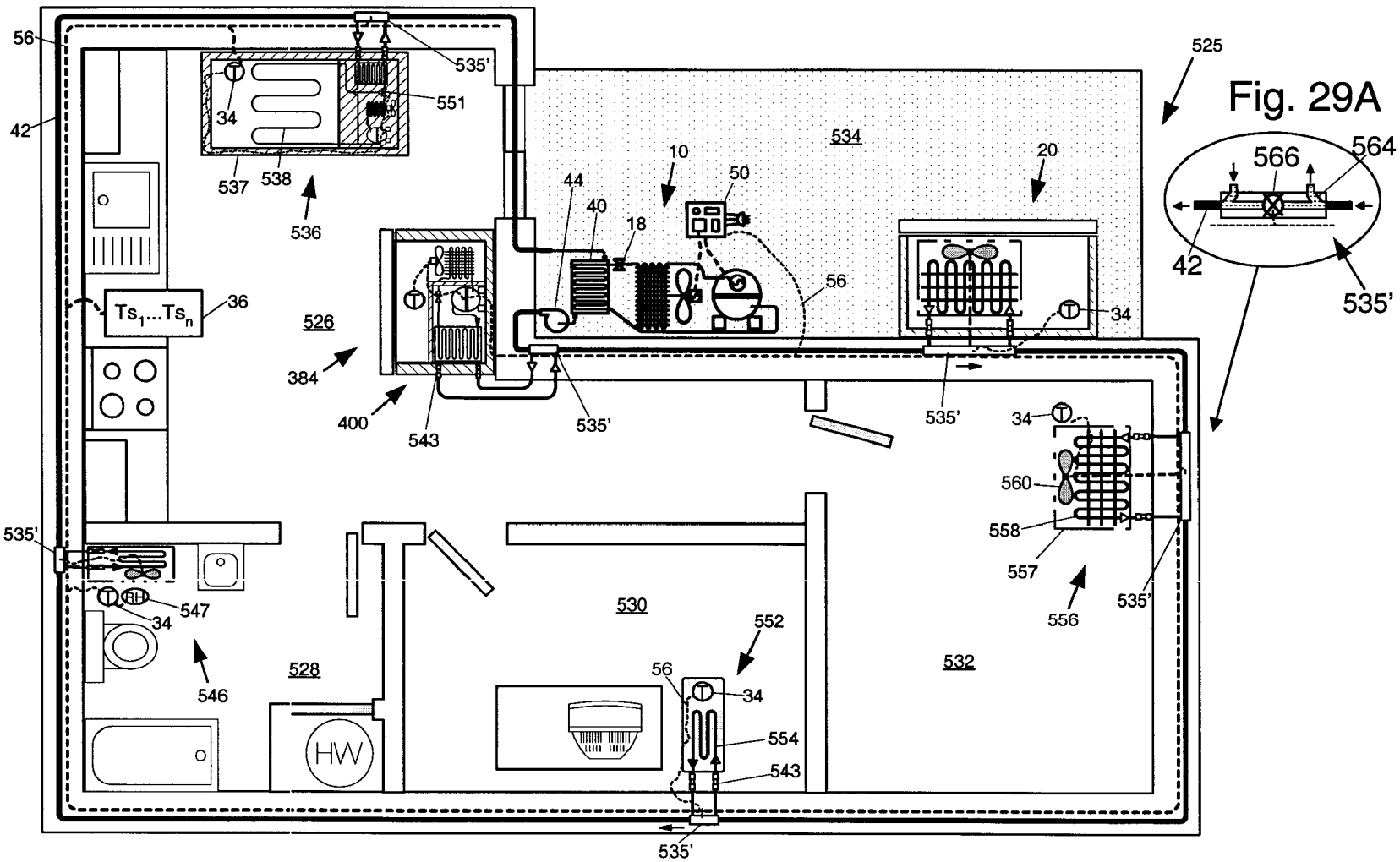
FIG. 29 is a schematic drawing illustrating another embodiment of a distributed refrigeration system according to the invention installed in a schematic floor plan of a dwelling.

Turning to FIGS. 28 and 29, a distributed refrigeration system according to the invention installed applied to a dwelling floor plan can be seen in schematic form. The residential dwelling 525 illustrated in FIGS. 28 and 29 can have a kitchen 526, bath 528, office or den 530, living room or family room 532 and patio 534. While a distributed refrigeration system according to the invention is illustrated in a simple dwelling in FIGS. 28 and 29, those skilled in the art will understand that distributed refrigeration systems according to the invention can be used in combination with any style dwelling having any desired number of rooms and floor plans. The distributed refrigeration system illustrated in FIGS. 28 and 29 can have a primary refrigeration machine, central cooling unit 10, that can be similar to the central cooling unit 10 illustrated and described in detail in connection with FIGS. 1, 12, 15, 17A and 17B and will not again be described in detail in connection with FIGS. 28 and 29. Central cooling unit 10 can include a controller 50 and can have temperature selectors 36 that can be located in a user interface at a remote location such as in the kitchen 526 as illustrated in FIGS. 28 and 29. While temperature selectors 36 are illustrated in a combined user interface those skilled in the art will understand that temperature selectors 36 can be combined with each remote refrigeration device if desired as is well known in the art. Central cooling unit 10 can be connected to a secondary cooling medium circuit. In the embodiment illustrated in FIG. 28 a secondary cooling medium circuit comprises insulated conduit 42 forming a loop leading from chilled liquid evaporator 40 in central cooling unit 10 around the perimeter of dwelling 525 and back to chilled liquid evaporator 40. As described above in detail pump 44 can circulate liquid coolant through insulated conduits 42. While insulated conduit 42 is positioned in perimeter walls in FIGS. 28 and 29, those skilled in the art will understand that insulated conduits 42 can be located in other walls and/or portions of the dwelling as desired to provide access to the secondary refrigeration loop at desired locations in the dwelling. A pressure differential valve 541 can be provided in the secondary cooling medium circuit to adjust any pressure differential between supply and return pressures. The secondary cooling medium circuit, also referred to as secondary refrigeration loop, can include a plurality of access points 535 (FIG. 28) and 535' (FIG. 29). An enlarged view of an access point 535 can be seen in FIG. 28A. Access point 535 can include a housing 533 than can enclose conduits 42 and can support remote device connectors 543 when a remote refrigeration device is connected to an access point. Remote device connectors 543 can be well known connectors for use with liquid coolant circuits and can be quick connect or permanent connections as desired. Access point 535 can also include an electrical connector, not shown, to make a suitable connection between control circuit 56 and the electrical component(s) in the remote refrigeration device. Access point 535 can also include a valve 545 that can be connected to control circuit 56. Valve 545 can open to allow chilled liquid refrigerant to flow into a remote refrigeration device when activated by controller 50. While central cooling unit 10 is shown in FIGS. 28 and 29, those skilled in the art will understand that an absorption central cooling unit as illustrated in FIG. 14 or a Stirling cycle central cooling unit as illustrated in FIG. 16 can be employed in the embodiments of FIGS. 28 and 29 as desired.

A variety of remote refrigeration devices can be connected to the secondary cooling medium circuit to provide distributed refrigeration for various purposes at spaced locations in a dwelling. Following are examples of remote refrigeration devices that can be utilized. Those skilled in the art will understand that the following examples are just that and that the examples should not be understood as limiting the invention to the remote refrigeration devices illustrated in FIGS. 28 and 29. One remote refrigeration device can be refrigerating module 20 located on patio 534. Refrigerating module 20 can be a patio cooler for beverages or refrigerated snacks. Refrigerating module 20 can be similar to refrigerating module 20 disclosed in connection with FIGS. 1, 12, 14, 16, 17A and 17B and will not be described again in detail in connection with FIGS. 28 and 29. Refrigerating module 20 can be connected to an access point 535 and 535' as described above and can operate as described above. Another remote refrigeration device can be a refrigerating module 384 combined with a cascade cooling unit 400. Refrigerating module 384 and cascade cooling unit 400 can be similar to refrigerating module 384 and cascade cooling unit 400 described in detail in connection with FIG. 15 and will not be described again in detail. Cascade cooling unit 400 can be connected with remote device connectors at access point 535 and 535' and can operate as described above in connection with FIG. 15. Another remote refrigeration device can be dehumidifier 546 that can be employed to reduce the humidity in bath 528 that can be generated during showers or baths. Dehumidifier 546 can be similar to refrigerating modules described above and can include a heat exchanger 548, a heat exchanger fan 549, a temperature sensor 34 and a humidistat 547. Heat exchanger fan 549, temperature sensor 34 and humidistat 547 can be connected to controller 50 through control circuit 56. Heat exchanger 548 can be connected to insulated conduits 42 in access point 535 and 535' utilizing remote device connectors 543 as described above. Dehumidifier 546 can have a condensate bucket, not shown, or can be connected to a drain for disposal of condensate as is well known in the art. Instead of connecting temperature sensor 34 and humidistat 547 to controller 50, a control panel, not shown, can be provided on dehumidifier 546 as will be readily understood by those skilled in the art. Another remote refrigeration device can be a CPU cooler 552 that can be arranged to cool a central processor of a computer or server. CPU cooler can include a heat exchanger 554 and a temperature sensor 34. CPU cooler 552 can connect to the secondary cooling medium circuit utilizing remote device connectors 543 to connect to an access point 535 and 535'. Temperature sensor 34 can connect to controller 50 via a suitable electrical connector in control circuit 56 in access point 535 and 535'. Another remote refrigeration device can be a local area cooler 556 that is illustrated in living room or family room 532. Local area cooler 556 can provide air conditioning or supplemental air conditioning for a room or portion of dwelling 525. For example, dwelling 525 may be located in a climate that does not require whole house or central air conditioning, but cooling for part of a day or part of the year can be satisfactorily addressed with a local area cooler 556 instead of a room air conditioner. Local area cooler 556 can have a cabinet 557 that can enclose a heat exchanger 558 and heat exchanger fan 560. Local area cooler 556 can include a temperature sensor 34 and temperature selector 36 that can be connected to controller 50, or alternately can be accessed on a control panel on cabinet 557 to control the local area cooler 556 at the device. Local area cooler 556 can be connected to access point 535, 535' utilizing remote device connectors 543 as described above. Local area cooler 556 can operate similar to a room air conditioner and can include a condensate pan for collecting condensate or can have a condensate drain line that can be connected to a dwelling drain line or can be directed outside for disposal as desired.

A second primary refrigeration machine can be connected to the secondary refrigeration loop to provide an additional source of cooling in the secondary cooling medium circuit. In the embodiment illustrated in FIGS. 28 and 29 the second primary refrigeration machine can be a chest freezer 536. Chest freezer 536 can have an insulated cabinet 537 and a freezer cooling circuit including a static evaporator 538, expansion device 539, condenser 540, compressor 542 and condenser fan 550. Chest freezer 536 can also have a heat rejecting element that can be a chilled liquid evaporator 544 that can be connected to insulated conduits 42 at an access point 535, 535' utilizing remote device connectors 543 that can provide additional cooling in the secondary refrigeration loop. Chest freezer 536 can also have a temperature sensor 34 and temperature selector 36 that can be connected to controller 50 through control circuit 56 as described above. Those skilled in the art will understand that chest freezer 536 can have a suitable insulated lid or closure, not shown, and that temperature selector 36 can be positioned on a control panel on chest freezer 536 if desired instead of on a remote user interface as illustrated. When chest freezer 536 is operating suction line heat exchanger or chilled liquid evaporator 544 can absorb heat from liquid coolant being circulated in insulated conduits 42 thus supplementing the refrigerating capacity of the distributed refrigeration system. Further, the freezer cooling circuit can include a bypass valve 551 that can be integrated with the expansion device 539 connected to control circuit 56 that can allow central controller 50 to bypass evaporator 538 to make the cooling capacity of chest freezer 536 available in chilled liquid evaporator 544 to provide additional cooling for the distributed refrigeration system. While a secondary primary refrigeration machine is illustrated as a chest freezer in the embodiments of FIGS. 28 and 29, those skilled in the art will understand that other refrigeration machines such as a central air conditioner condensing unit, other configuration freezers as well as refrigerator freezers, ice makers, wine coolers and the like having a cooling unit can be used as an additional primary refrigeration machine in a distributed refrigeration system if desired.

In the embodiment illustrated in FIG. 29 and FIG. 29A the secondary cooling medium circuit can have a single insulated conduit 42 connecting the access points 535' with the chilled liquid evaporator 40 and pump 44. Access points 535' can have a housing 564 and can include a valve 566 that can be connected to controller 50 through control circuit 56. Valve 566 can close forcing chilled liquid cooling circulating in insulated conduit 42 to divert through the remote device when valve 566 is closed by controller 50. Access point 535' can have a suitable electrical connector, not shown, to facilitate connection of remote refrigeration devices to controller 50. The single line secondary cooling medium circuit illustrated in FIG. 29 can otherwise operate similar to the two line supply and return line system illustrated in FIG. 28.

The refrigerating modules, refrigeration/storage modules, satellite stations, combined satellite stations and central cooling units described above have been selected to explain the invention. However, the invention is not limited to the specific examples of modules, satellite stations and central cooling units and that these elements can take any desired form and can be combined as desired within the scope of the invention. The invention is not limited to refrigeration modules and equipment located in any particular geometrical orientation. The central cooling unit and receiving modules need not be positioned on the same or similar horizontal plane since appropriate pumps and fans can adjust for differences in elevation resulting from desired location of cooling units and modules. While use of quick connect fittings to connect satellite stations to refrigerant lines in the distributed refrigeration systems is described above, those skilled in the art will understand that quick connect fittings are not necessary to practice the inventions described in this application and that instead any well known refrigerant line connection arrangements can be used as desired.

The controllers for the central cooling units, refrigerating modules, satellite stations, combined satellite stations and central cooling units and refrigeration/storage modules described above, including the control circuits, thermostats, temperature selectors and selector switches, can be arranged to function as plug-n-play controls, components and devices, or can be arranged to function as part of an appliance network that can be part of a home network. Co-pending International Applications PCT/2006/022420, Software Architecture System and Method for Communication with, and Management of, at Least One Component Within a Household Appliance, filed on Jun. 8, 2006; PCT/2006/022503, Components and Accessories for a Communicating Appliance, filed on Jun. 9, 2006; and PCT/2006/022528, Comprehensive System for Product Management, filed Jun. 9, 2006; and U.S. patent application Ser. No. 11/619,767, Host and Adaptor for Docking a Consumer Electronic Device In Discrete Orientation, filed on Jan. 4, 2007, all assigned to the assignee of this application, disclose architectural elements for plug-n-play controls and modular systems that can be used in the practice the inventions described in this application. Co-pending International Applications PCT/2006/022420, PCT/2006/022503, PCT/US2006/022528 and co-pending U.S. patent application Ser. No. 11/619,767 are incorporated herein by reference in their entirety.

While the invention has been specifically described in connection with certain specific embodiments thereof, it is to be understood that this is by way of illustration and not of limitation, and the scope of the appended claims should be construed as broadly as the prior art will permit.

The invention claimed is:

1. A distributed refrigeration system in a kitchen and other locations in a residential dwelling comprising:

a primary refrigeration machine positioned outside the residential dwelling having a cooling circuit including a primary heat exchanger for providing cooling;

at least one secondary refrigeration loop positioned in the residential dwelling utilizing a cooling medium fluid comprising;

a plurality of access points located in the residential dwelling each including a control circuit connector and an electrical connector;

a secondary cooling medium circuit connecting the primary heat exchanger and the plurality of access points to convey cooling medium fluid from the primary heat exchanger to the plurality of access points, and to return cooling medium fluid to the primary heat exchanger; and a pump for circulating cooling medium fluid in the cooling medium circuit;

a controller and a control circuit associated with the residential dwelling connected to the primary refrigeration machine and to the access points;

a plurality of remote refrigeration devices each associated with the residential dwelling to provide distributed refrigeration at a location in the residential dwelling and arranged to connect to the secondary refrigeration loop at one of the plurality of access points including:

first and second connectors to receive cooling medium fluid from the secondary cooling medium circuit and return cooling medium fluid to the secondary cooling medium circuit and an electrical connector to connect to the access point electrical connector;

a remote refrigeration device heat exchanger connected to the first and second connectors and arranged to receive cooling medium fluid from and return cooling medium fluid to the secondary cooling medium circuit to cool the remote refrigeration device;

a sensor arranged to sense a predetermined condition of the remote refrigeration device and arranged to connect to the access point control circuit connector; and a selector arranged to allow a user to set the desired predetermined condition for the remote refrigeration device and arranged to connect to the access point control circuit connector; and a user interface located in the residential dwelling connected to the controller to allow a user to select the desired predetermined condition for the respective ones of the plurality of remote refrigeration devices.

2. The distributed refrigeration system according to claim 1, wherein the first and second connectors comprise an inlet to receive cooling medium fluid from the secondary cooling medium circuit and an outlet to return cooling medium fluid to the secondary cooling medium circuit.

3. The distributed refrigeration system according to claim 2, wherein the secondary cooling medium circuit comprises an insulated supply conduit and an insulated return conduit.

4. The distributed refrigeration system according to claim 3, wherein the first and second connectors comprise an inlet connected to the insulated supply conduit and an outlet connected to the insulated return conduit.

5. The distributed refrigeration system according to claim 2, wherein the secondary cooling medium circuit comprises a single insulated conduit.

6. The distributed refrigeration system according to claim 1, further including a second primary refrigeration machine positioned in the residential dwelling having a cooling circuit including a heat exchanger arranged for providing cooling and a heat exchanger element connected in the secondary cooling medium circuit arranged to transfer heat from the cooling medium fluid to the second primary refrigeration machine cooling circuit.

7. The distributed refrigeration system according to claim 6, wherein the second primary refrigeration machine comprises a refrigeration apparatus having a compressor, condenser, expansion device, a heat exchanger element connected in the secondary cooling medium circuit and an evaporator connected in a cooling circuit.

8. The distributed refrigeration system according to claim 1, wherein at least one of the plurality of the remote refrigeration devices comprises a local area cooler arranged to provide air conditioning or supplemental air conditioning at a location in the residential dwelling.

9. The distributed refrigeration system according to claim 8, wherein the local area cooler comprises a heat exchanger and a fan for circulating air over the heat exchanger.

10. The distributed refrigeration system according to claim 1, wherein the secondary cooling medium circuit comprises an insulated conduit to convey cooling medium fluid.

11. The distributed refrigeration system according to claim 1, wherein the primary refrigeration machine comprises a central cooling unit having a compressor, condenser, expansion device and chilled liquid evaporator connected in a cooling circuit.

12. The distributed refrigeration system according to claim 1, wherein at least one of the plurality of remote refrigeration devices comprises a compact refrigerator.

13. The distributed refrigeration system according to claim 1, wherein at least one of the remote refrigeration devices comprises a dehumidifier.

14. The distributed refrigeration system according to claim 1, wherein at least one of the remote refrigeration devices comprises a CPU cooler for a computer.

15. The distributed refrigeration system according to claim 1, wherein at least one of the remote refrigeration devices comprises a cascade cooling unit arranged to provide refrigerated temperatures below the temperature of the cooling medium fluid circulating in the secondary refrigeration loop.

16. A distributed refrigeration system in a kitchen and other locations inside and outside a residential dwelling comprising:

a central cooling unit adjacent the residential dwelling selected from the group including a vapor compression system having a chilled liquid evaporator, an absorption system having a chilled liquid evaporator and a Stirling cycle cooler having a chilled liquid heat exchanger;

a controller and a control circuit associated with the residential dwelling;

a plurality of access points located inside and outside the residential dwelling each access point including first and second liquid coolant connectors, a control circuit connector and an electrical connector;

a circulation pump;

a secondary cooling medium circuit associated with the residential dwelling comprising, insulated conduit connecting the chilled liquid evaporator, the plurality of access point liquid coolant connectors and the circulation pump and containing liquid coolant;

at least one remote refrigeration device connected to an access point located outside the dwelling comprising;

at least one remote device connector arranged to connect to an access point to receive liquid coolant from the first liquid coolant connector, return liquid coolant to the second liquid coolant connector, and to connect to the access point electrical connector;

a remote device heat exchanger arranged to receive liquid coolant from the remote device connector and return the liquid coolant to the remote device connector;

a sensor arranged to sense a predetermined condition of the remote refrigeration device and to connect to the access point control circuit connector; and a selector arranged to allow a user to set the desired predetermined condition for the remote refrigeration device and to connect to the access point control circuit connector;

at least one remote refrigeration device connected to an access point located in the kitchen or other location inside the residential dwelling comprising;

at least one remote device connector arranged to connect to an access point to receive liquid coolant from the first liquid coolant connector, return liquid coolant to the second liquid coolant connector, and to connect to the access point electrical connector;

a remote device heat exchanger arranged to receive liquid coolant from the remote device connector and return the liquid coolant to the remote device connector;

a sensor arranged to sense a predetermined condition of the remote refrigeration device to connect to the access point control circuit connector; and a selector arranged to allow a user to set the desired predetermined condition for the remote refrigeration device and to connect to the access point control circuit connector; and a user interface located in the residential dwelling connected to the controller to allow a user to select the desired predetermined condition for the respective remote devices.

17. The distributed refrigeration system according to claim 16, wherein the remote devices comprise one or more of the following: a compact refrigerator; a local area cooler; a cascade cooling unit refrigerator or freezer; a CPU cooler and a dehumidifier.

* * * * *